US006722838B2

(12) United States Patent
Svyatsky et al.

(10) Patent No.: US 6,722,838 B2
(45) Date of Patent: Apr. 20, 2004

(54) METHOD AND SYSTEM FOR HIGH SPEED TRAY UNLOADING AND MAIL TRANSPORTING

(75) Inventors: Eduard Svyatsky, Libertyville, IL (US); Pashkeev Nikolai Vladimirovich, Kiev (UA); Sheihon Boris Markovich, Kiev (UA); Svyatsky Adolf Michailovich, Kiev (UA); Vadim Belyaev, Sebastopol (UA)

(73) Assignee: Bowe Bell & Howell Company, Durham, NC (US)

( * ) Notice: Subject to any disclaimer, the term of this patent is extended or adjusted under 35 U.S.C. 154(b) by 0 days.

(21) Appl. No.: 09/829,725

(22) Filed: Apr. 10, 2001

(65) Prior Publication Data

US 2002/0146308 A1 Oct. 10, 2002

(51) Int. Cl.[7] ..... B65H 29/42
(52) U.S. Cl. ..... 414/404; 414/810
(58) Field of Search ..... 414/403, 404, 414/405, 409, 416.05, 416.06, 419, 810; 198/462.1; 399/258; 221/75

(56) References Cited

U.S. PATENT DOCUMENTS

| | | | | | |
|---|---|---|---|---|---|
| 1,134,988 | A | * | 4/1915 | Bellinger | 40/658 |
| 2,279,643 | A | * | 4/1942 | Silver | 211/11 |
| 3,191,762 | A | | 6/1965 | Brietzke | |
| 3,712,487 | A | * | 1/1973 | Eberle | 414/795.1 |
| 3,729,108 | A | * | 4/1973 | Rice | 198/379 |
| 3,799,324 | A | * | 3/1974 | Hall | 198/347.1 |
| 3,863,789 | A | | 2/1975 | Hunter et al. | |
| 3,995,851 | A | * | 12/1976 | Casper | 271/179 |
| 4,819,578 | A | * | 4/1989 | Koiso et al. | 198/659 |
| 4,969,561 | A | * | 11/1990 | Yang | 211/59.2 |
| 5,070,986 | A | * | 12/1991 | Hoffman et al. | 194/237 |
| 5,187,524 | A | * | 2/1993 | Cherian | 156/173 |
| 5,275,523 | A | * | 1/1994 | Stewart et al. | 131/96 |
| 5,307,941 | A | * | 5/1994 | Siegal | 211/11 |
| 5,354,170 | A | | 10/1994 | Schweingruber et al. | |
| 5,564,882 | A | * | 10/1996 | Litterst | 134/126 |
| 5,569,016 | A | * | 10/1996 | Mokler | 271/182 |
| 5,765,676 | A | * | 6/1998 | Kalm | 198/396 |
| 5,875,882 | A | * | 3/1999 | Pollock | 198/659 |
| 5,933,696 | A | * | 8/1999 | Howard et al. | 399/117 |
| 6,398,008 | B1 | * | 6/2002 | Suga | 198/404 |

FOREIGN PATENT DOCUMENTS

| | | | | |
|---|---|---|---|---|
| EP | 0 292 773 A2 | | 11/1988 | |
| GB | 2 140 329 A | * | 11/1984 | B04B/1/16 |
| JP | 63300008 | | 7/1988 | |
| WO | WO 98/23393 | | 6/1998 | |

* cited by examiner

*Primary Examiner*—Eileen D. Lillis
*Assistant Examiner*—Charles A. Fox
(74) *Attorney, Agent, or Firm*—McDermott, Will & Emery

(57) ABSTRACT

A method and apparatus for high speed tray unloading and mail transporting includes a tray unloading apparatus which receives a continuous stream of mail trays and sequentially unloads them in proper orientation onto a conveyor assembly; a dual conveyor system for delivering the unloaded mail to a transport system; and a spiral transport system having optimal drive means for controllably moving mail pieces from one location to another.

28 Claims, 44 Drawing Sheets

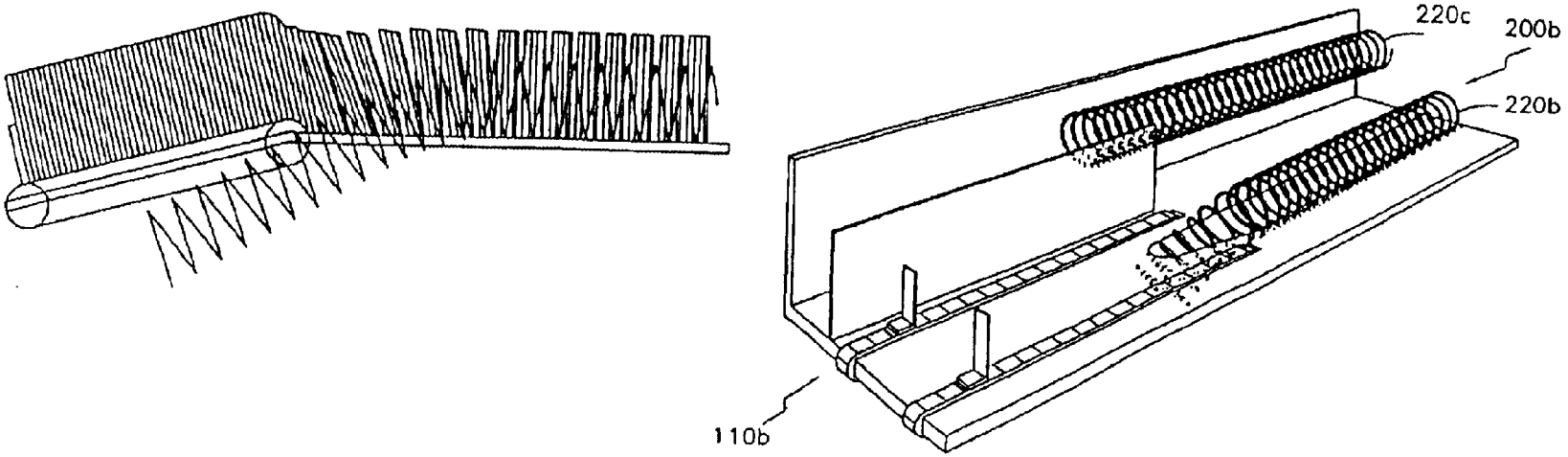
FIG. 45
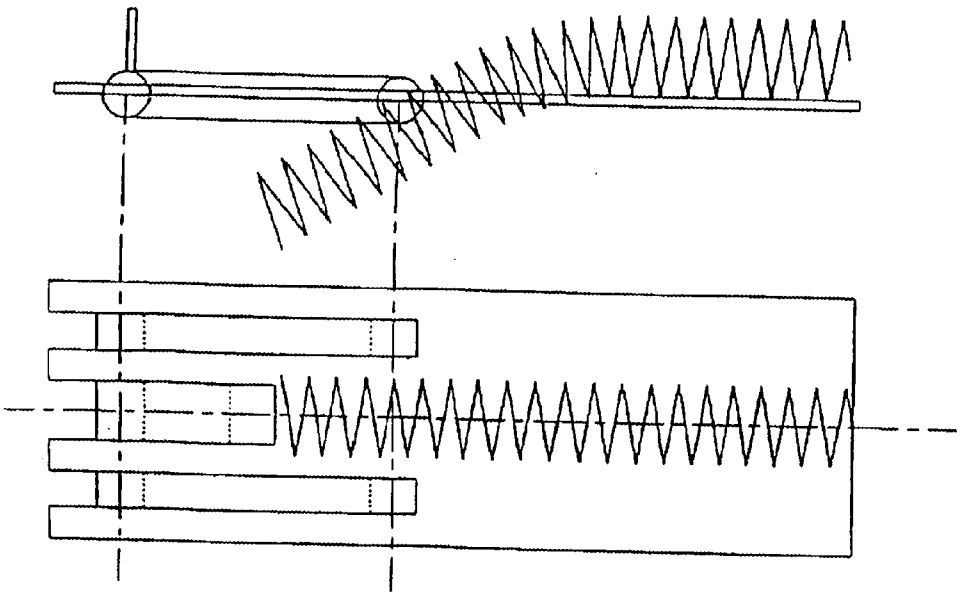

METHOD AND SYSTEM FOR HIGH SPEED TRAY UNLOADING AND MAIL TRANSPORTING

The present invention relates to a method and system for high speed tray unloading and mail transporting. In particular, the method and system of the present invention comprises three novel components. First is a tray unloading apparatus which sequentially receives mail trays containing any number of mail pieces, and continuously unloads the mail onto a conveyor system in proper orientation. Second is a dual conveyor belt system which collects the mail and delivers the mail to a transport system. Third is a transport system comprising a spiral having optimal drive means for controllably moving small groups of mail from one location to another, for example from one mail processing apparatus component to another.

BACKGROUND OF THE INVENTION

Many businesses and postal services utilize high speed mail processing machines to rapidly process and/or transport collected mail pieces. Collected mail pieces are placed into mail carrier trays for transportation to a post office. At the post office, these trays must be unloaded, and the mail must be transported to a sorting machine for sorting by addresses.

While there are numerous prior art apparatus for processing mail, there are no known apparatus to receive a series of mail trays containing mail, continuously unload these trays in proper orientation, and then controllably deliver the mail to a desired mail processing machine in a fast and efficient manner.

Tray unloading has long been a manual process. Recently, automated devices for unloading mail trays have been disclosed in U.S. Pat. Nos. 5,906,468 and 5,713,713, both entitled "Pivotal Tray Unloading Apparatus," issued to Vander Syde et al. on May 25, 1999 and Feb. 3, 1998, respectively, and U.S. Pat. No. 5,772,383 entitled "Pivotal Mail Tray Unloader," issued to Kalika et al. On Jun. 30, 1998. These patents are all assigned to the assignee of the present application.

The apparatus disclosed in these patents, and in particular the Vander Syde et al. '468 patent, provides for automated removal of mail from a tray, removal of the tray, and placement of the mail on a transport. However, such devices are relatively complicated, having numerous movable components to manipulate the tray, and is relatively time consuming. The tray must be grasped and rotated both front to back and side to side. Further, the tray removal requires numerous movable parts, including pneumatic cylinders. Such multiple movements and parts can result in a relatively lengthy and non-continuous operation, and overall slower processing times. Further, the apparatus could be subject to lengthy down times if any of these components fatigue or fail. Due to the numerous components, this apparatus is relatively expensive to manufacture and maintain. The present invention provides a substantial improvement and advantage over this prior art apparatus.

U.S. Pat. No. 5,271,710 entitled "Device for Loading Articles Onto an Unstacking Magazine and a Loading Method Using this Device," issued to Decharran et al. on Dec. 21, 1993, discloses a device which assists an operator in the unloading of trays of flat articles. Unlike the present invention, the unloading operation of this device remains mostly manual. The trays are manually moved over a tipping trough in a deck, whereupon the tray is tipped. The deck then tilts to raise the bin so that the articles can slide out of the tray and onto a conveyor. At all times, the operator must use its hands to support and guide the articles and prevent them from falling.

French Patent No. 2,706,331 illustrates an apparatus for unloading trays of flat articles. The articles are standing on edge in the tray, which sits on a conveyor. The tray is then turned on edge sideways, into a holding area. The tray is next removed, leaving the contents in the holding area. Finally, the holding area is pivoted ninety degrees, placing the flat articles back on edge on the conveyor. This device, unlike the present invention, does not re-orient the contents of the tray, i.e., does not turn articles which stacked flat up onto their edge. Further, it appears that this device also remains largely manual in operation.

There are other known devices for removing the contents of a container in industries unrelated to mail processing. Such known devices in general are inappropriate for mail processing applications, where the contents must be precisely handled and positioned. Specifically, the mail which are placed flat in the tray, stacked on top of each other, must be made to stand on edge, and then must be precisely transferred from the unloading apparatus to a conveyor system while being properly supported at all times, without manual intervention. Such known prior art devices cannot adequately achieve the same.

For example, U.S. Pat. No. 2,951,603 entitled "Container Handling Machine," issued to Preuss on Sep. 30, 1957, discloses a container handling machine, and in particular a machine for unloading fruit from a crate. The machine includes a relatively complicated system of belts and rollers in association with a wheel for inverting the crates. Once inverted, the fruit remains on an inner conveyor belt which surrounds the wheel, while the crate rides up a pair of belts along the sides of the wheel. However, this machine in not suitable for mail processing. The machine does not precisely control and position the contents of the crate. This machine simply inverts the crate and could not orient mail pieces stacked flat up onto their edge. Further, the crate removal belts of this machine extend slightly into the crate, and thus would not function with respect to mail processing, as the belts would hinder removal of the mail from the tray.

Other prior art devices for emptying the content of boxes are used in other industries, for example: U.S. Pat. No. 5,275,523 entitled "Apparatus for Removing Cigarettes from a Package that Encloses the Same," issued to Stewart et al., which utilizes a pair of wheels to grasp cut open packages of cigarettes and rotates them to a vertical position whereupon the cigarettes fall out of the package, which is then discharged; U.S. Pat. No. 2,735,561 entitled "Box Dumping Machine," issued to Van Doren on Feb. 21, 1956, which includes a pair of clamping members, movable along a pair of belts, which grasp the box and dump the contents (fruit) as the clamped box travels along the belt path; and U.S. Pat. No. 2,424,252 entitled "Box Dumping Machine," issued to Orlando on Jul. 22, 1947, which discloses an arm the grasps a box of fruit, then rotates one hundred eighty degrees, during which time the fruit dumps out of the box and down a chute. Again, such prior art devices are wholly inapplicable to mail processing and cannot achieve the advantages and improvements achieved by the present invention.

With respect to spiral transports, there are known devices for a transport system comprising a spiral for transporting paper and other flat articles. Such prior art devices generally fall into one of two groups. The first group is a coil having an end drive. When the end is rotated, the coil rotates therewith. The second group is a helix or screw type drive, having a central shaft extending the length of the spiral transport, from which the helix extends. When the central shaft is rotated, the helix rotates therewith.

Examples of coil transports are disclosed in U.S. Pat. No. 5,544,876 issued to Ruch on Aug. 13, 1996; U.S. Pat. No. 4,378,938 issued to Staniszewski on Apr. 5, 1983; U.S. Pat. No. 3,377,929 issued to Ware et al. on Apr. 16, 1968; U.S. Pat. No. 2,826,413 issued to Brodie et al. on Mar. 11, 1958; U.S. Pat. No. 2,778,638 issued to Whillock et al. on Jan. 22, 1957; U.S. Pat. No. 2,048,870 issued to Kannee on Jul. 28, 1936; U.S. Pat. No. 1,576,243 issued to Mentges on Mar. 9, 1926; U.S. Pat. No. 277,806 issued to Stonemetz et al. on May 15, 1883; and in German Patent Application No. DE 2330225 A1 issued Jan. 9, 1975.

The problem with known coil transports is that they cannot operate at very high speeds or over any great length. These coils are typically supported only at the drive end, so that the exit end remains open or unimpeded for the article to transfer out of the coil. Thus, the length of the coil is limited by the structural integrity of the coil itself, and as such must remain relatively short. Further at relatively high speeds, due to the unbalanced nature of the coil, these coils begin to vibrate, shake or otherwise move in an undesirable manner and even break up or fatigue, thus becoming ineffective or inoperable. The present invention, however, overcomes these limitations, allowing for any length coil to be drive at high speeds by its novel driving means.

Examples of helix transports are disclosed in U.S. Pat. No. 5,271,710 issued to Decharran et al. on Dec. 21, 1993; U.S. Pat. No. 4,884,795 issued to Vander Syde on Dec. 5, 1989; U.S. Pat. No. 4,875,309 issued to Long, III on Oct. 24, 1989; U.S. Pat. No. 4,432,540 issued to Akers et al. on Feb. 21, 1984; European Patent Application No. EP 0947453 A1 published on Oct. 6, 1999; French Patent Application No. FR 2727948 A1 published on Jun. 14, 1996; PCT Patent Application No. WO 90/12745 published Nov. 1, 1990; United Kingdom Patent Application No. GB 2020613 A published Nov. 21, 1979; and United Kingdom Patent No. GB 1524306 published Sep. 13, 1978.

These known helix or screw type transports generally suffer from some of the same problems as the coil transports. While the length can be longer, it is still limited, even where the screw is supported at two ends. At high speeds, these transports are unbalanced and start vibrating or suffer other undesirable movement which can jeopardize the structural integrity of the screw conveyor. Additionally, the central shaft can interfere with the articles being transported, or otherwise prevent or limit the articles from more fully entering the helix. Again, the present invention overcomes these limitations.

Accordingly, there is a need for a method and apparatus for high speed mail tray unloading and mail transporting in a smooth, efficient and continuous manner. The present invention fulfills such a need.

BRIEF SUMMARY OF THE INVENTION

The present invention comprises a method and system for high speed mail tray unloading and mail transporting. Specifically, the present invention comprises a tray unloading apparatus which receives a continuous stream of trays of mail and sequentially unloads the mail in proper orientation onto a conveyor assembly; a dual conveyor system for collecting and delivering the unloaded mail to a spiral transport system; and a spiral transport system having optimal drive means for controllably moving mail from one location to another.

The tray unloading apparatus comprises a tray control module and a tray removing module. A full tray incoming transport delivers mail trays to the tray control module. The tray control module then inverts the tray. A tray guide prevents the tray from falling out of the tray control module while the tray is being inverted. Once the tray is inverted, the tray removing module lifts the inverted tray away, leaving the contents on the tray control module. The tray control module then delivers the contents to the conveyor assembly.

The conveyor assembly is a dual conveyor system comprising a supply belt transport and a collector belt transport. The supply belt transport receives the mail from the tray control module, and transports the mail to the collector belt transport, where the mail from successive trays is collected in one continuous uninterrupted package and delivered to the spiral transport system. A mail support paddle module is positionable behind the last mail piece of a group to prevent the mail from falling.

The spiral transport system comprises a spiral set in a base, and driven by optimal drive means comprising, in one embodiment, an inner shaft and two outer shafts, each in contact with the spiral to drive the spiral. As such, the spiral rotates about a central axis, but has no axial shaft, and the drive means is not co-axial with the central axis of the spiral. The spiral receives mail from the collector belt, and controllably transports them along the spiral to any desired location, for example within a mail processing apparatus, or from one mail processing apparatus to the infeed system of another mail processing apparatus.

Accordingly, it is the principal object of the present invention to provide a method and system for high speed mail tray unloading and mail transporting.

It is also an object of the invention to provide a method and apparatus for sequentially receiving mail trays containing mail, continuously unloading the mail onto a conveyor system in proper orientation, delivering the mail to a transport system, and controllably moving mail pieces to a desired location.

It is an additional object of the present invention to provide a tray unloading apparatus which sequentially receives mail trays containing mail, and continuously unloads the mail onto a conveyor system in proper orientation.

It is another object of the present invention to provide a dual conveyor system which collects the mail and delivers the mail to a transport system.

It is a further object of the present invention to provide a transport system comprising a spiral having optimal drive means for controllably moving mail pieces from one location to another, for example within a mail processing apparatus or between mail processing apparatus.

Numerous other advantages and features of the invention will become readily apparent from the detailed description of the preferred embodiment of the invention, from the claims, and from the accompanying drawings in which like numerals are employed to designate like parts throughout the same.

BRIEF DESCRIPTION OF THE DRAWINGS

A fuller understanding of the foregoing may be had by reference to the accompanying drawings wherein:

FIG. 45 is a perspective view of another alternate embodiment of the interface between the collector belt transport and the spiral transport system of the present invention.

DETAILED DESCRIPTION OF THE PREFERRED EMBODIMENT OF THE PRESENT INVENTION

Figure 1:
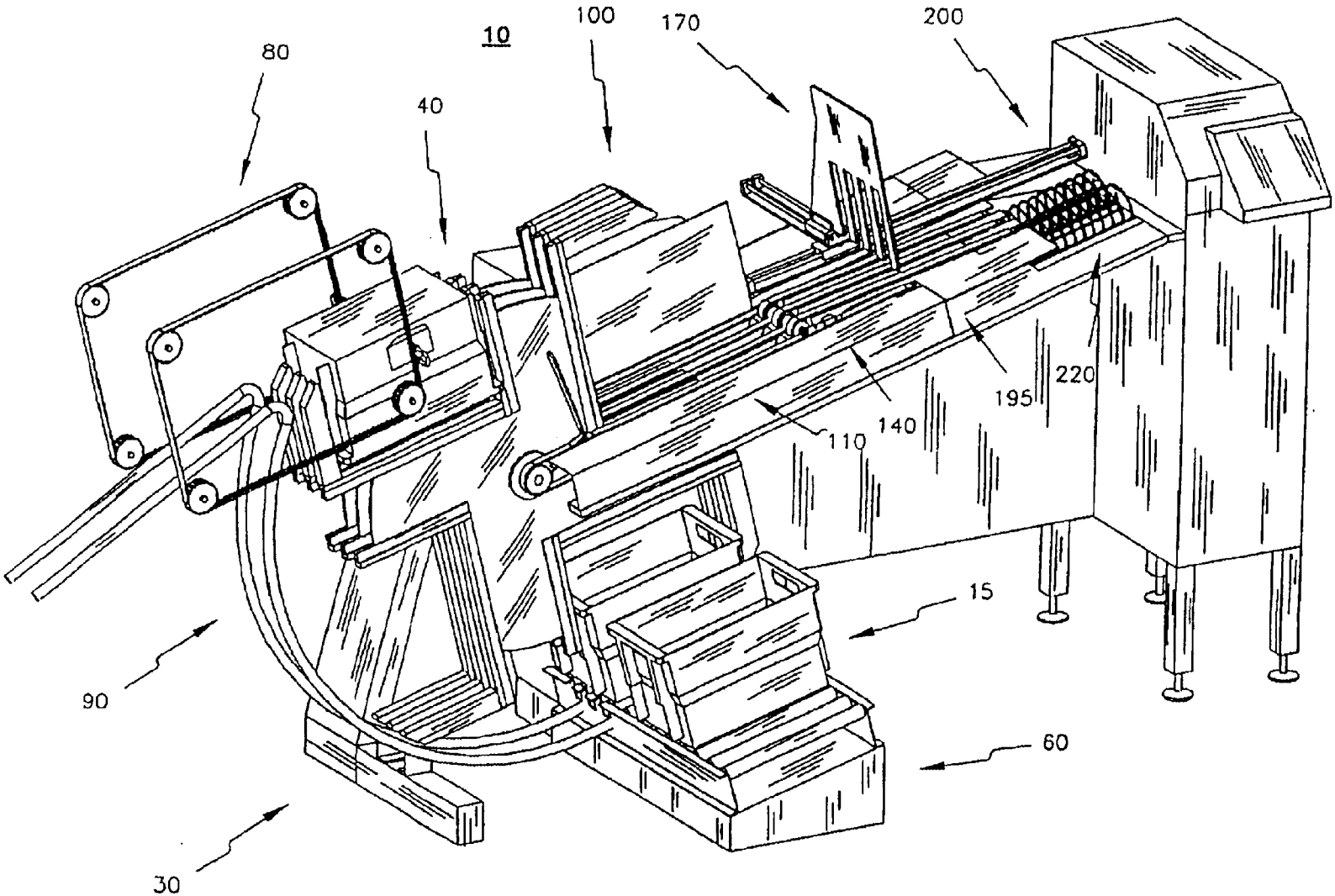
FIG. 1 is a perspective view of the present invention.

While the invention is susceptible of embodiment in many different forms, there is shown in the drawings and will be described herein in detail a preferred embodiment of the invention. It should be understood however that the present disclosure is to be considered an exemplification of the principles of the invention and is not intended to limit the spirit and scope of the invention and/or claims of the embodiment illustrated.

FIG. 1 illustrates the present invention 10 which is comprised of three main components, a tray unloading apparatus 30, a conveyor assembly 100, and a spiral transport system 200. The tray unloading apparatus 30 sequentially and continually unloads trays of mail, and controllably delivers the unloaded mail to the conveyor assembly 100. The conveyor assembly 100 transports the unloaded mail away from the tray unloading apparatus 30 and delivers the mail to the spiral transport system 200. The spiral transport system 200 receives and spaces small groups of mail and transports them to a desired location.

As can be seen in FIG. 1, tray unloading apparatus 30 includes a tray control module 40, full tray incoming transport 60, tray removing module 80, and tray guide 90. The tray control module 40 sequentially receives and positions trays 15 in such a manner as to unload the trays and deliver the unloaded mail to the conveyor assembly 100, as will be described in more detail below. Full tray incoming transport 60 supplies the tray control module 40 with trays 15. Tray removing module 80 sequentially removes trays 15 from tray control module 40 at a desire time during the process. Tray guide 90 guides the trays 15 at in select areas during the process.

Conveyor assembly 100 includes a supply belt transport 110 and a collector belt transport 140 for transporting the mailpieces along a table 195, from the tray control module 40 to the spiral transport system 200. The conveyor assembly 100 further includes a mail support paddle module 170 which supports the collected mailpieces.

Spiral transport system 200 includes a spiral 220 which receives the mail pieces from the conveyor assembly 100 and transports the mailpieces to a desired location, for example within a mail processing apparatus, or from one mail processing apparatus to the infeed system of another mail processing apparatus.

Figure 2:
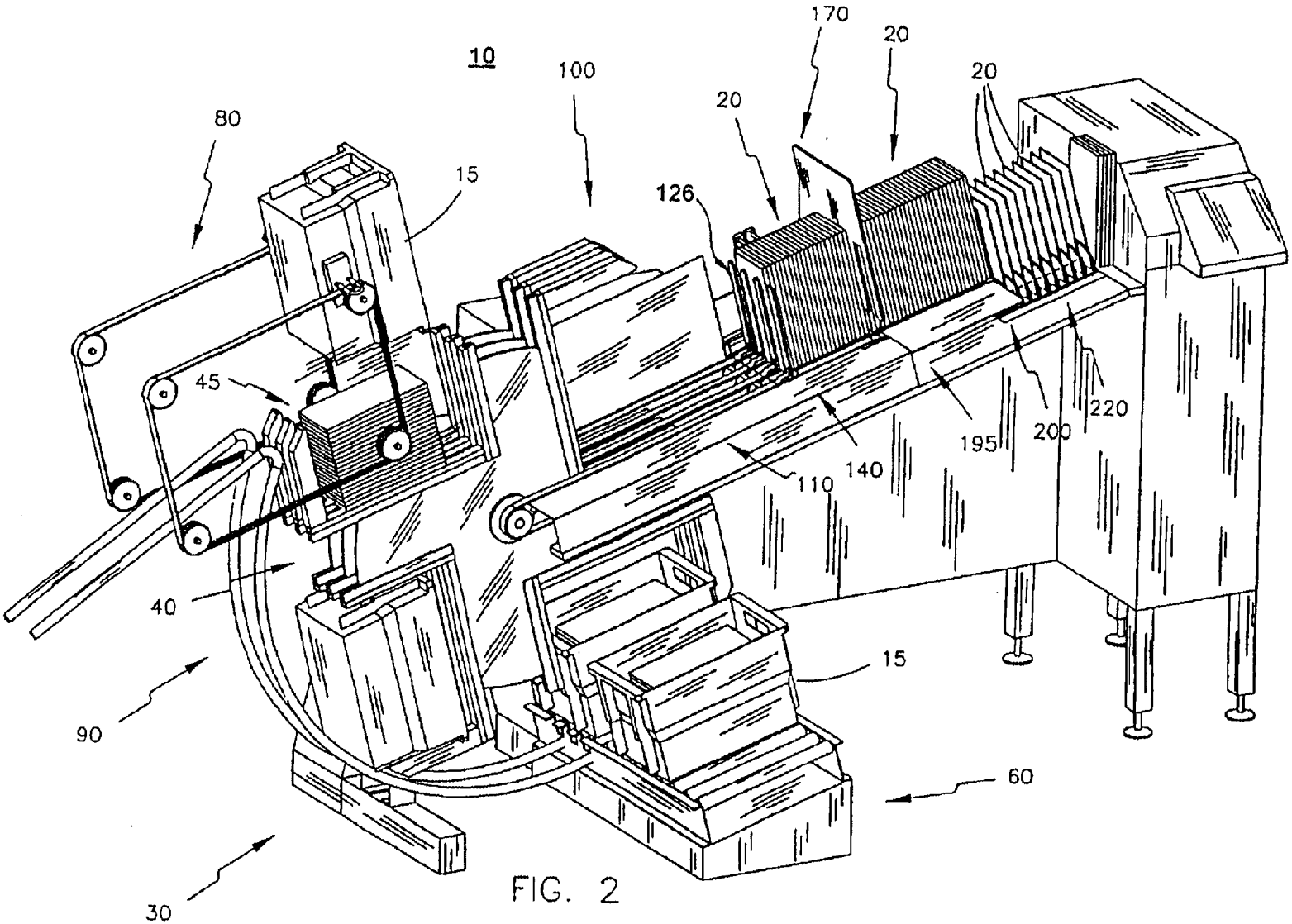
FIG. 2 is a perspective view of the present invention in use, showing mail in the system.

FIG. 2 is a perspective view of the present invention showing the progression of the mail or mailpieces 20 therethrough. As can be seen, trays 15 of mail 20 are delivered to the tray ports 45 of tray control module 40 via full tray incoming transport 60. The tray control module 40 engages successive trays 15 in ports 45 as module 40 rotates to invert the trays 15. Tray guide 90 prevents the trays 15 from falling out from the ports 45 during inversion. Tray removing module 80 removes the inverted trays 15 from tray control module 40, thus leaving the contents on the tray control module 40. Tray guide 90 further guides the empty trays 15 to a desired location once removed. Tray control module 40 then, upon further rotation, delivers the unloaded mailpieces 20 to the conveyor assembly 100.

Once the mail is on the conveyor assembly 100, the mail 20 rests on edge on supply belt transport 110 and is supported via fingers 126. The supply belt transport 110 conveys the mailpieces 20 along an inclined table 195, to the collector belt transport 140 where the mailpieces are collected in a continuous, uninterrupted package. The mail support paddle module 170 is moved into position behind the incoming stack of mailpieces 20 and supports the uninterrupted package on the collector belt transport 140. Once collected, the mailpieces are conveyed by the collector belt transport 140 to the spiral transport system 200.

As can be seen, the mailpieces 20 enter between coils of the spiral, individually or in small groups, and are transported in spaced relation by the spiral 220 to a desired location such as a further mail processing component. The number of mailpieces that can enter the spiral between coils of the spiral depends on the thickness of each mailpiece and the spacing between the coils of the spiral.

Figure 3:
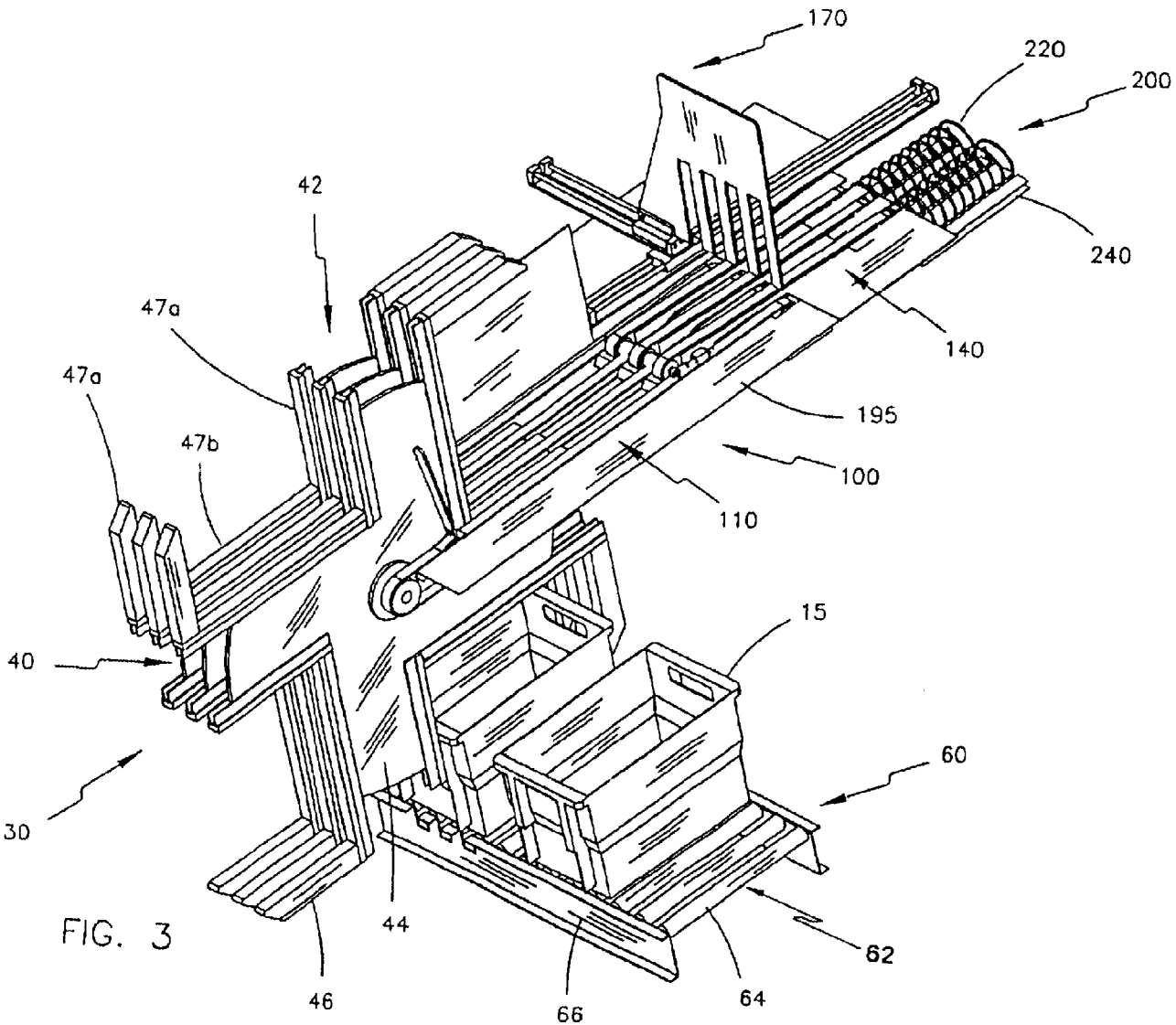
FIG. 3 is a perspective view of the main components of the present invention.

FIG. 3 is a perspective view of the tray control module 40, the conveyor assembly 100, and the spiral transport system 200. As can be seen, tray control module 40 comprises a drum assembly 42 which is preferably made up of a number of spaced apart drum disks 44 (three shown), each having a plurality of spaced tray holder members 46 (four shown), which form the tray ports 45 to selectively engage and position trays 15. While three drum disks 44 are illustrated, any suitable number are contemplated. Further, while four tray hold members 46 are shown on each drum disk 44, any number are contemplated. The drum disks 44 are spaced apart to allow the tray holder members 46 to freely pass between the belts of the supply belt transport 110, as well as the rollers 64 of the roller conveyor 62, and the slots 68 (see FIG. 7) of the roller supports 66, of the full tray incoming transport 60, as will be described in more detail later. Tray holder members 46 each include tray engaging members 47*a* and an upper member 47*b*.

Also seen in FIG. 3 are supply belt transport 110 and collector belt transport 140 which convey mailpieces 20 along table 195, mail support paddle module 170 which supports the mailpieces 20 being conveyed by the collector belt transport 140, and spiral 220 which conveys the mailpieces 20 along base 240.

Figure 4:
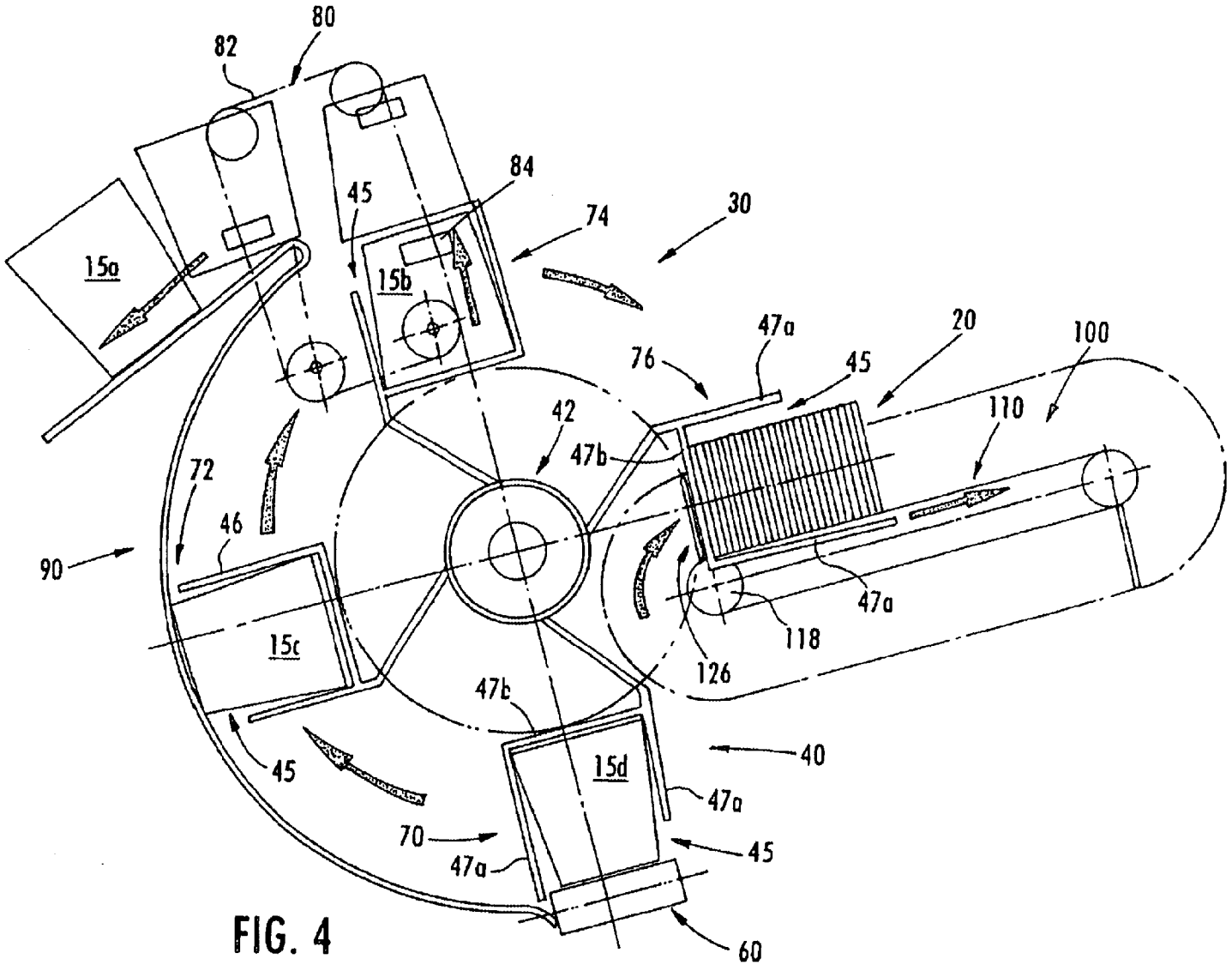
FIG. 4 is a schematic side view of the tray unloading apparatus of the present invention.

FIG. 4 is a schematic side view of the tray unloading apparatus 30 of the present invention. As shown, the tray control as module has four tray ports 45, equally spaced apart ninety degrees from each other. Thus, each time the tray control module 40 rotates ninety degrees, the ports 45 are always located in precisely one of four locations.

Full tray incoming transport 60 introduces a first tray 15*a* into the first of the four tray ports 45, positioned at the bottom of tray control module 40, at first location 70. Drum assembly 42 is then rotated ninety degrees and momentarily stops, moving the first tray 15*a* into a sideways position, at second location 72. Tray guide 90 prevents the tray 15*a* from falling out from tray port 45. At this time, a second tray 15*b* is introduced into the second of the four tray ports 45 which has moved into the first location 70. Drum assembly 42 is again rotated ninety degrees and momentarily stops, moving the first tray 15*a* into an upside down position, situated between two spring loaded friction pads 84, at third location 74, and moving the second tray 15*b* to the second location 72. At this time, a third tray 15*c* is introduced into the third of the four tray ports 45, at the first location 70.

Once a tray 15 is in the third location, tray removing module 80 is activated to remove the tray 15 from the tray port 45. Tray removing module 80 includes a pair of belt conveyors 82 located adjacent each side of the tray 15 at the third location. Friction pads 84 are attached to the belts 82 and travel along the belt path of belts 82. Tray 15 is removably engaged between the pair of friction pads 84. The friction pads 84 travel up with belt conveyors 82, lifting the tray 15 from the tray port 45. The contents of the tray 15, mailpieces 20, remain on the tray holder members 46 in the third location. As friction pads 84 continue to travel along with belt conveyors 82, tray 15 engages tray guide 90, releasing the tray 15 from friction pads 84. The released tray then rides down tray guide 90 to any desired location.

Drum assembly 42 is again rotated ninety degrees, moving the mailpieces 20 removed from the first tray and located in the third location 74, onto the supply belt transport 110 of conveyor assembly 100, at the fourth location 76. At this time, the second tray 15*b* moves to the third location 74, and the third tray 15*c* to the second location 72. Also at this time, a fourth tray 15*d* is introduced into the fourth of the four tray ports 45 in the first location 70, as shown in FIG. 4.

In the process of this drum rotation from the third location 74 to the fourth location 76, mail is oriented from a lay down, stacked flat position on the upper member 47*b* of the tray holder members 46, to an on edge position on member 47*a*, and leaning against upper member 47*b* of the tray holder members 46. As rotation to the fourth location is completed, the tray engaging member 47*a* supporting the mail on edge, passes between the belts of the supply belt transport 110, at which time the mail on edge contacts and rests on the conveyor belt transport 110, and is disengaged from the tray engaging member 47*a*.

Once mailpieces 20 are in the fourth position 76 and rest on supply belt transport 110, the supply belt transport 110 starts moving and convey the mailpieces 20 out from tray holder members 46. The fingers 126 of supply belt transport 110 move from their home position and pass freely between the spaced apart tray holder members 46 to engage and support the back side of the stack of mailpieces. After all of the mail has been moved out of the port 45, the emptied tray holder members 46 are then free to pass between the belts of supply belt transport 110. The drum assembly 42 will not immediately rotate, but will pause until the supply belt transport 110 finishes delivering the mail to the collector belt transport 140, and then returns the fingers 126 to their home position. The drum assembly 42 will then rotate again to continually unload successive trays 15.

Figure 5:
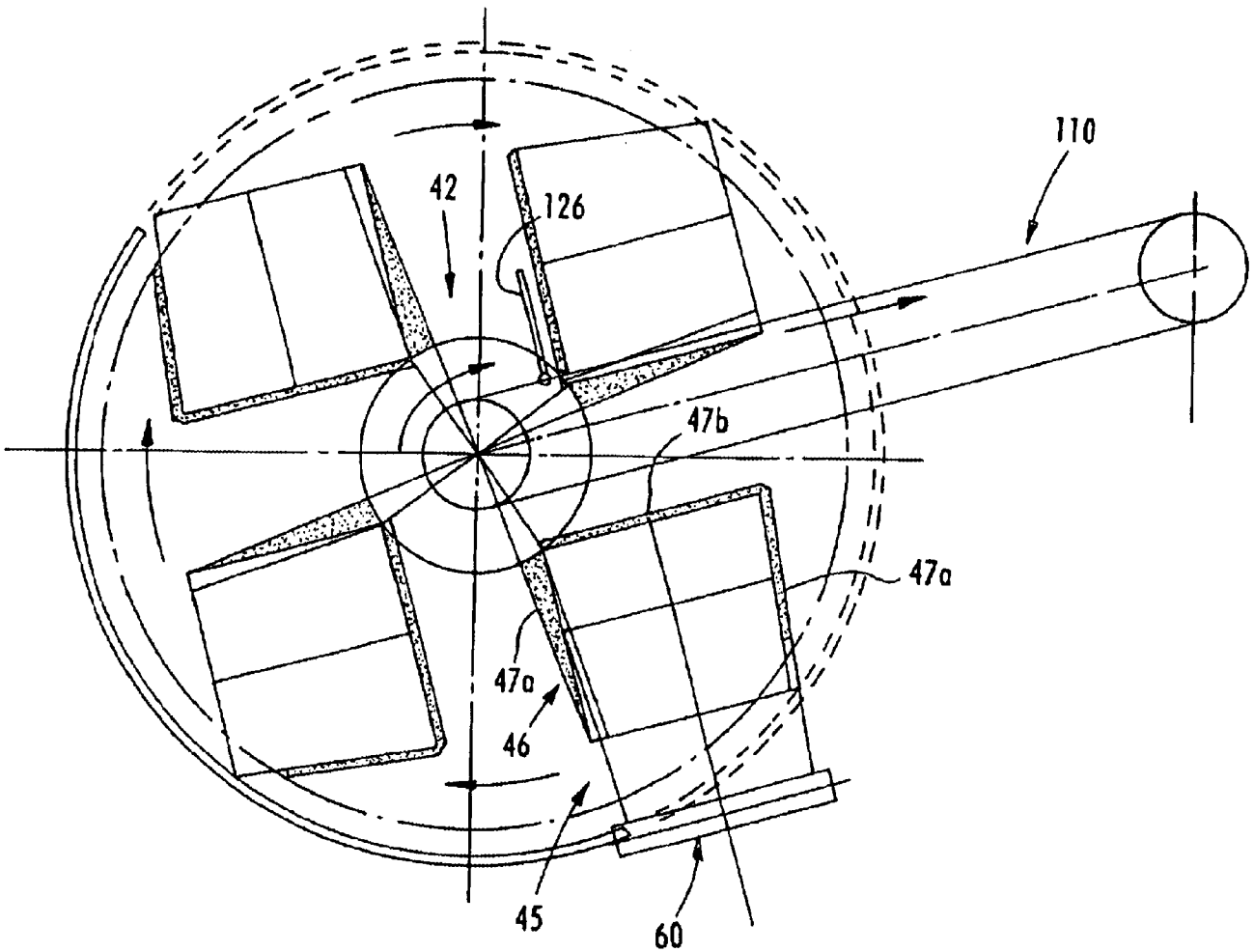
FIG. 5 is a schematic side view of the an alternate embodiment of the tray unloading apparatus of the present invention.

As can be seen in FIG. 4, the end pulleys 118 of the supply belt transport 110 are offset from the center of the drum assembly 42. However, it is foreseen that the supply belt transport can be concentric with the center of the drum assembly 42, as shown in FIG. 5. In this embodiment, the roller conveyor 60 must be spaced from the ports 45 to allow enough room for the tray engaging members 47 to clear the roller conveyor. This spacing results in the tray being only partially in the port initially, and then being pushed into the port during rotation of the drum assembly 42. Additionally, the fingers 126 must pivot back to allow the mailpieces in the third location to rotate to the fourth location without interfering with the mailpieces during rotation.

Figure 6:
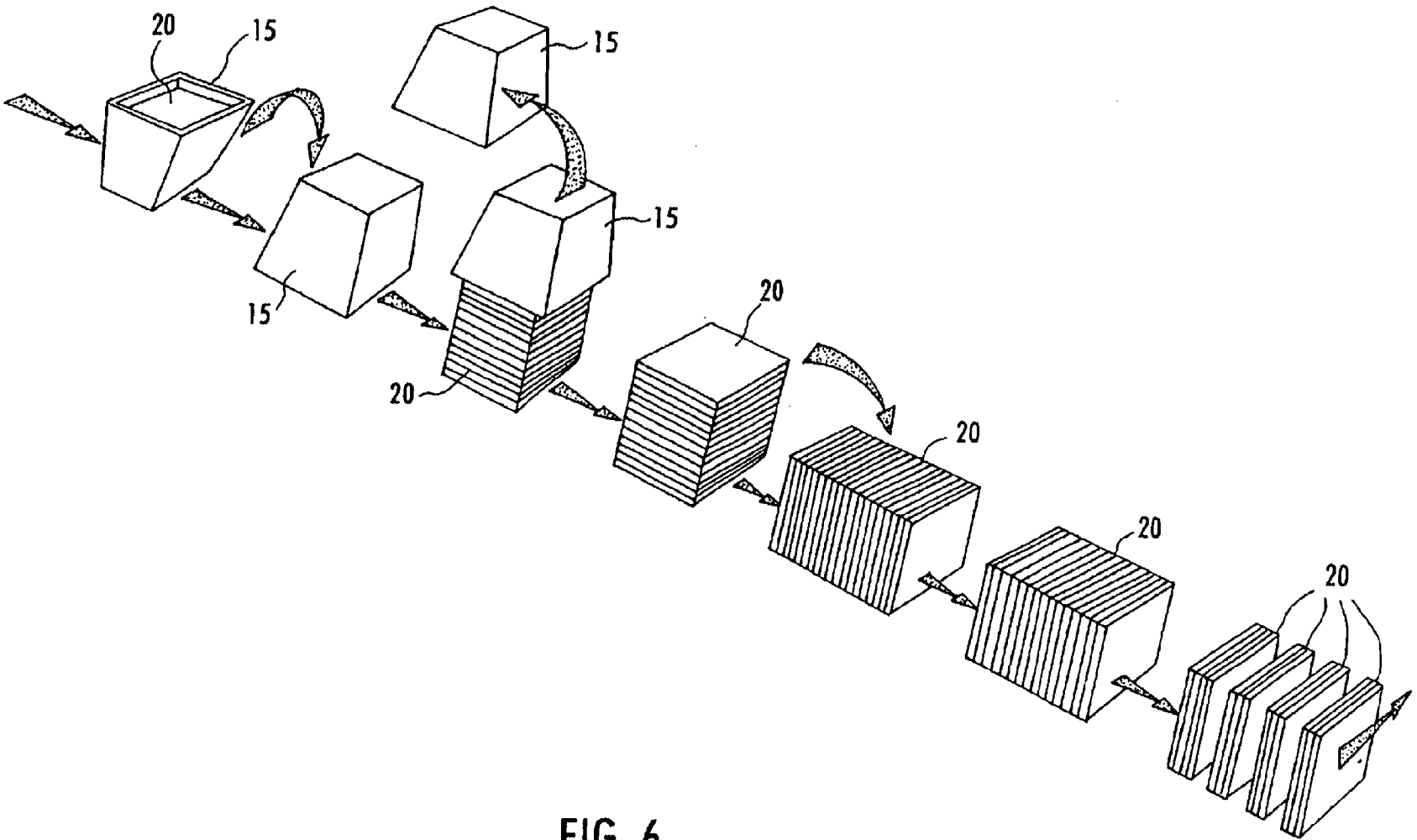
FIG. 6 is a diagram of the mail flow of the present invention.

FIG. 6 illustrates a flow diagram of the mailpieces 20 as processed by the present invention 10. Full tray 15 is inverted as it is moved from the first position to the third position. The inverted tray is then removed. The mailpieces 20 now lying flat, are turned on edge as they are moved from the third position to the fourth position. The mailpieces 20 are then transported to the spiral transport system 200 where they are spaced between the coils of the spiral 220 and are transported to a desired location.

Figure 7:
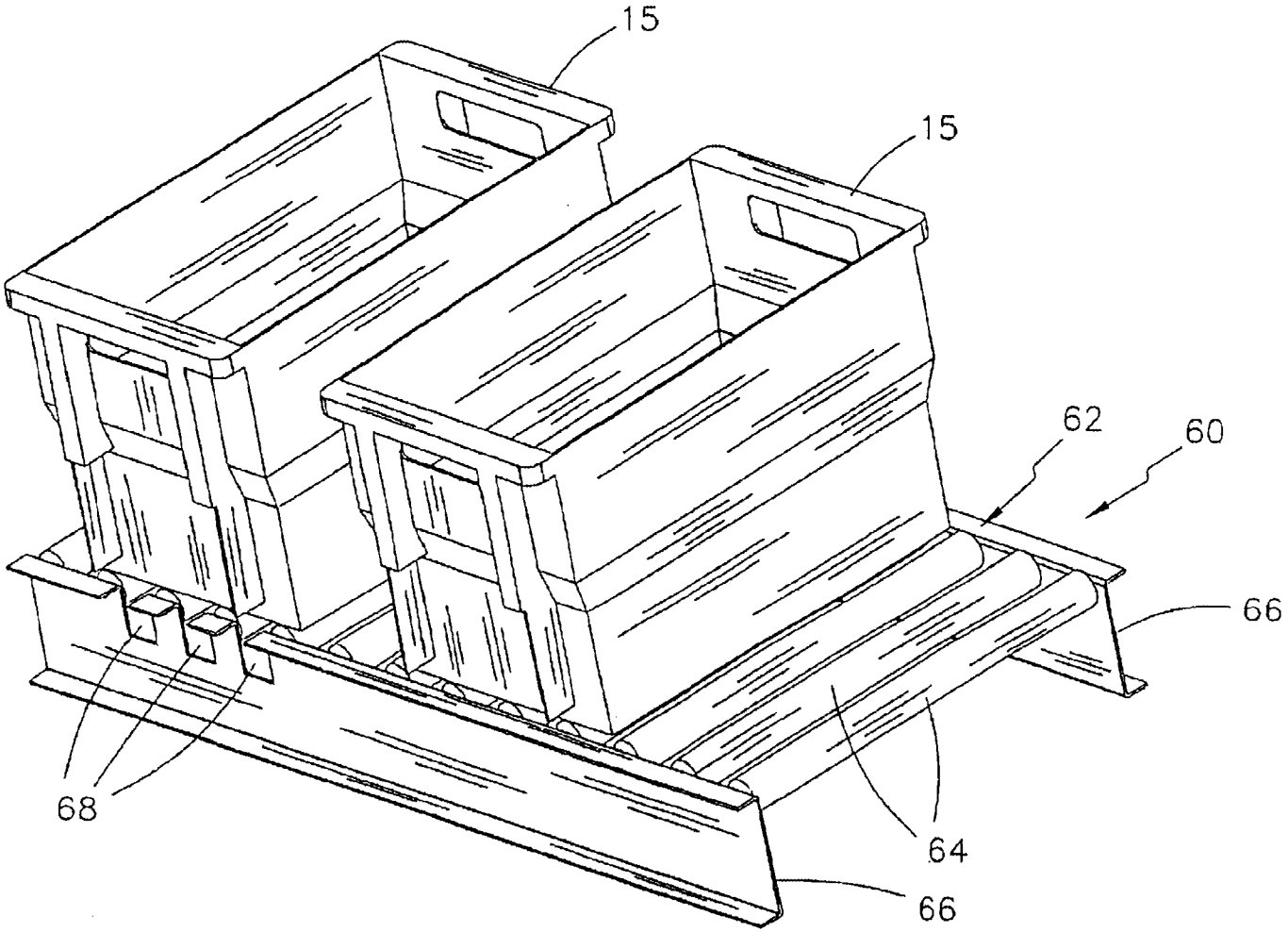
FIG. 7 is a perspective view of the full tray incoming transport of the present invention in use, showing trays on the roller conveyor.

FIG. 7 is a perspective view of the full tray incoming transport 60 of the present invention having trays 15 thereon. As can be seen, full tray incoming transport 60 comprises roller conveyor 62 having a plurality of spaced apart rollers 64 mounted in roller supports 66. Roller supports 66 have slots 68 through which tray holder members 46 can pass as they engage the tray and rotate from the first position to the second position. Trays ride upon rollers 64 of roller conveyor 62.

Figure 8:
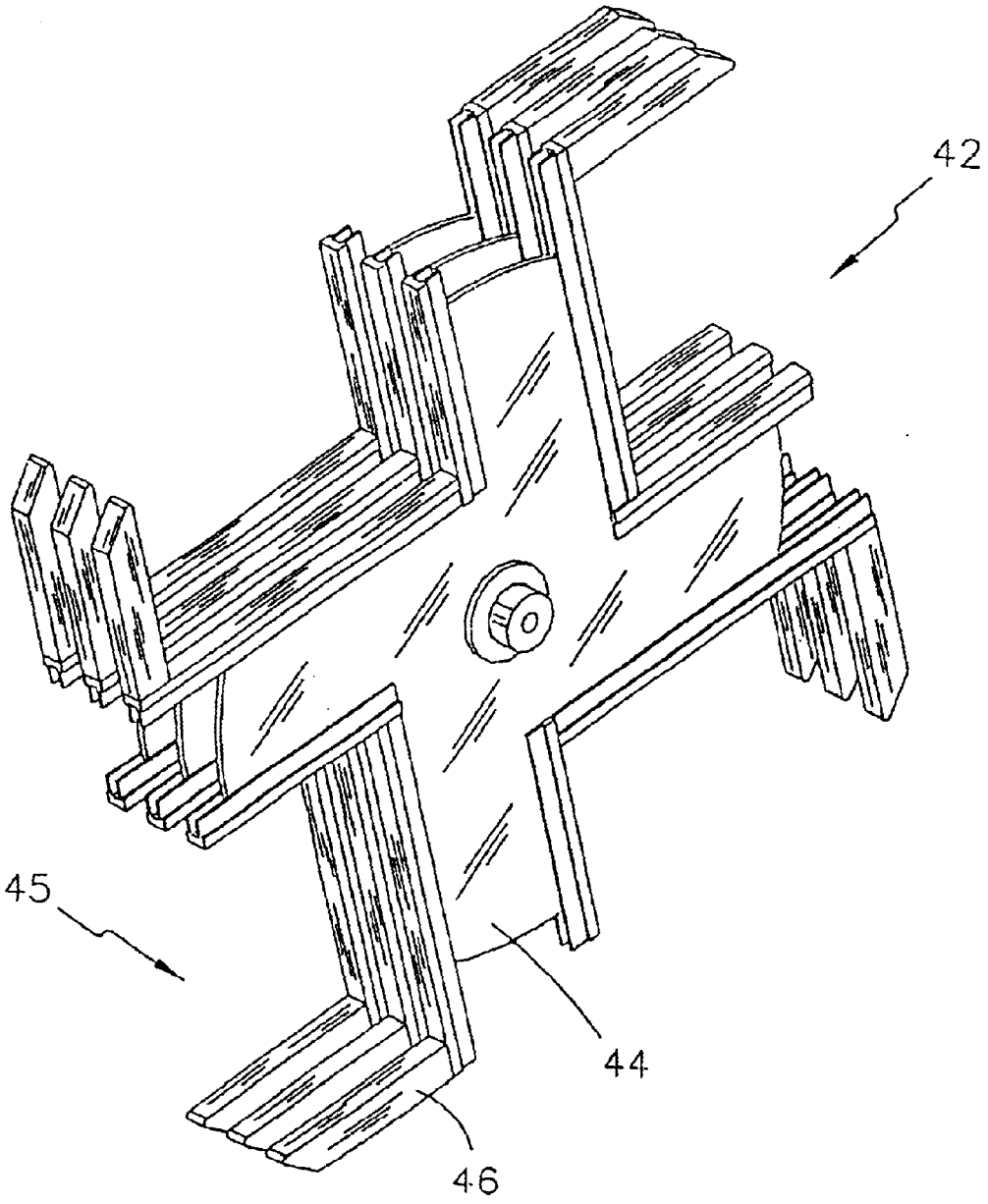
FIG. 8 is a perspective view of the drum assembly of the present invention.

FIG. 8 illustrates a perspective view of the drum assembly 42 of the present invention 10. As can be seen, a plurality (three shown) of drum disks 44, each having a plurality (four shown) of tray holder members 46, are mounted together in spaced relation on a shaft to form drum assembly 42.

Figure 9:
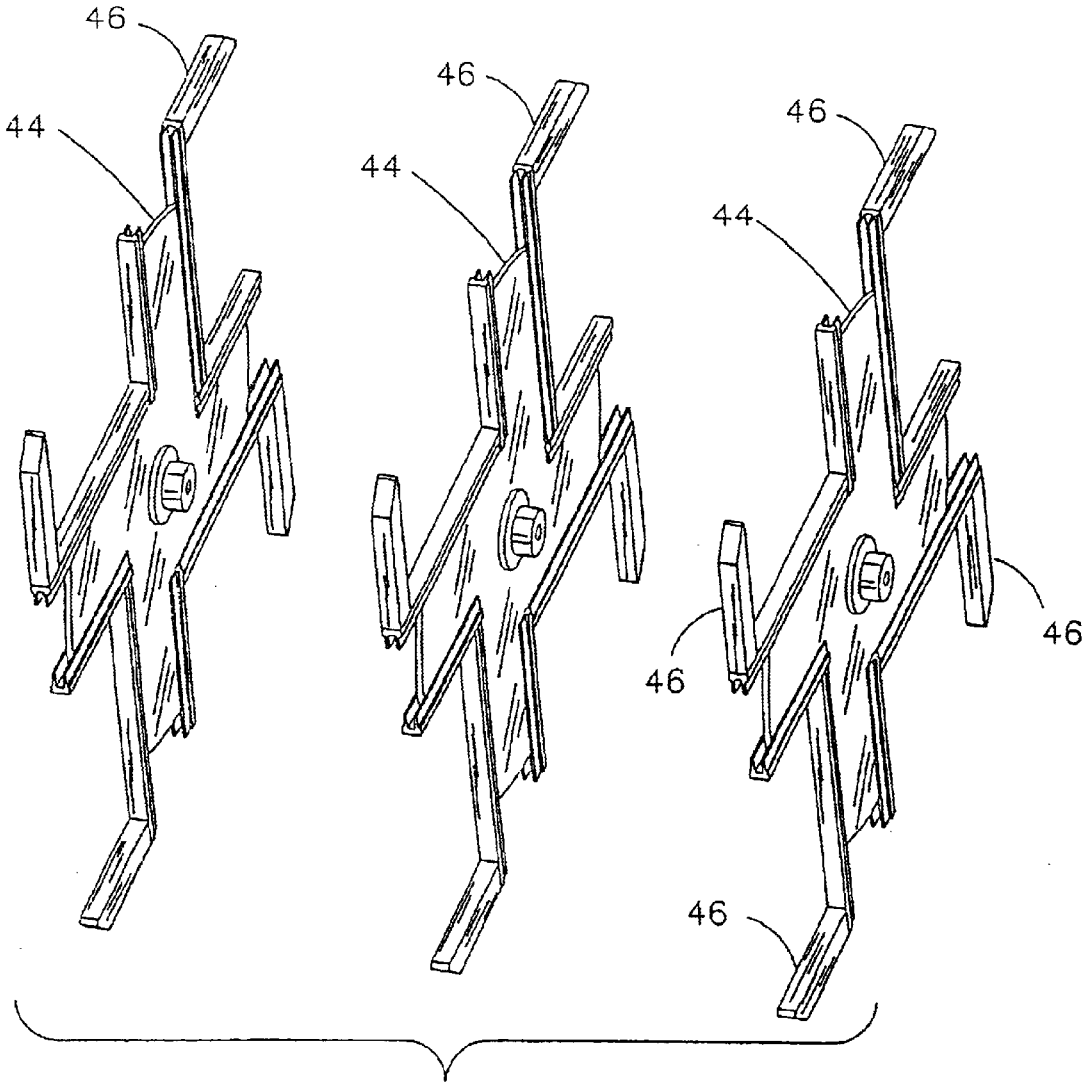
FIG. 9 is an exploded perspective view of the drum assembly of the present invention.

FIG. 9 is an exploded perspective view of the drum assembly 42 of FIG. 8. Each drum disk 44 has four tray holder members 46. Thus, the combined drum disks 44 form four distinct ports 45 where trays can be held. Thus, as illustrated, the drum assembly 42 can hold four trays, and/or their contents, at a single time. However, drums with any number of ports are contemplated, where a larger drum could have more ports if desired.

Figure 10:
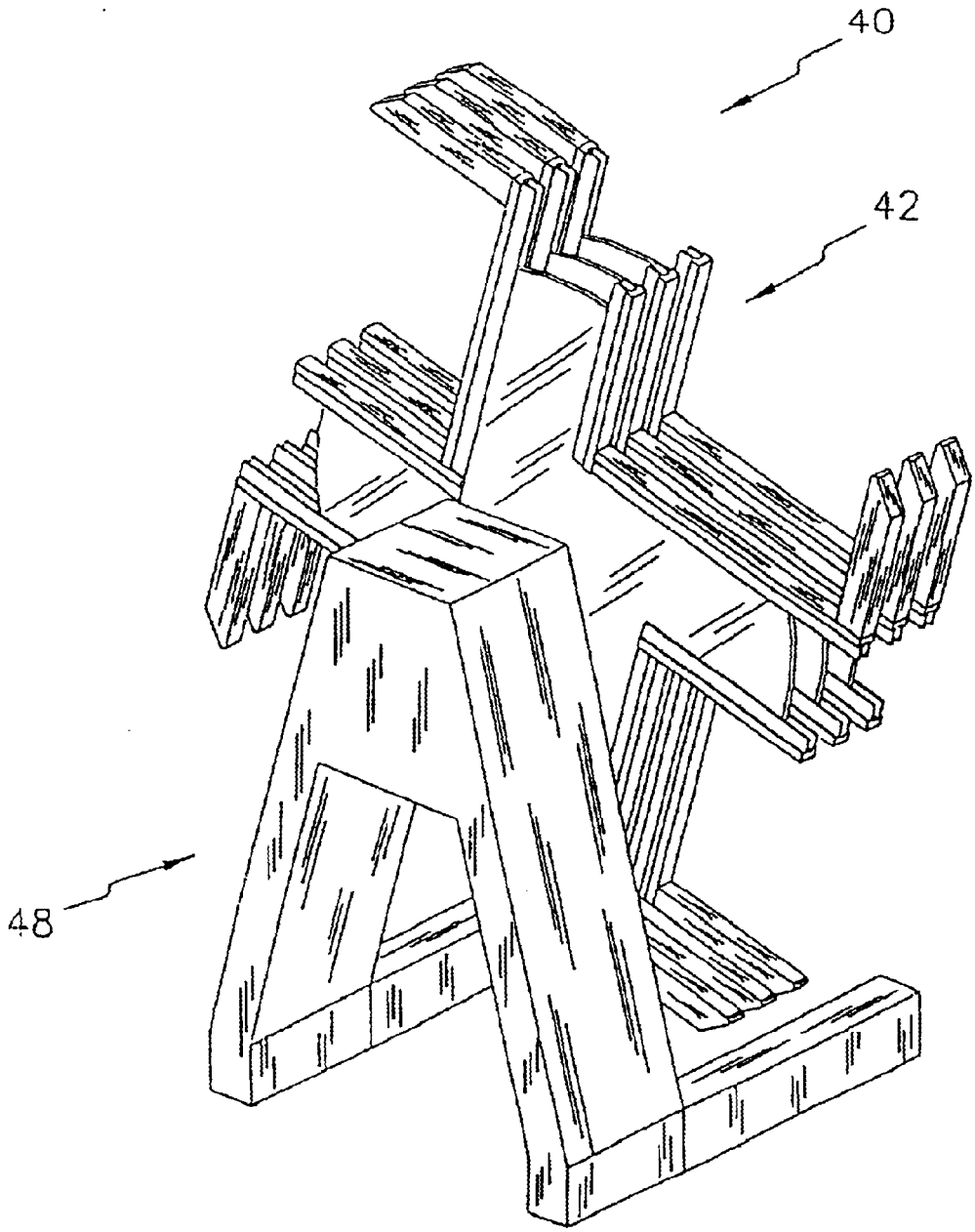
FIG. 10 is a perspective view of the drum assembly mounted to the drum mount of the present invention.

FIG. 10 is a perspective view of the drum mount 48 of the present invention 10. The drum assembly 42 of the tray control module 40 is mounted for rotation via its shaft to drum mount 48. Any suitable drive means is contemplated for controllable rotation of the drum assembly 42.

Figure 11:
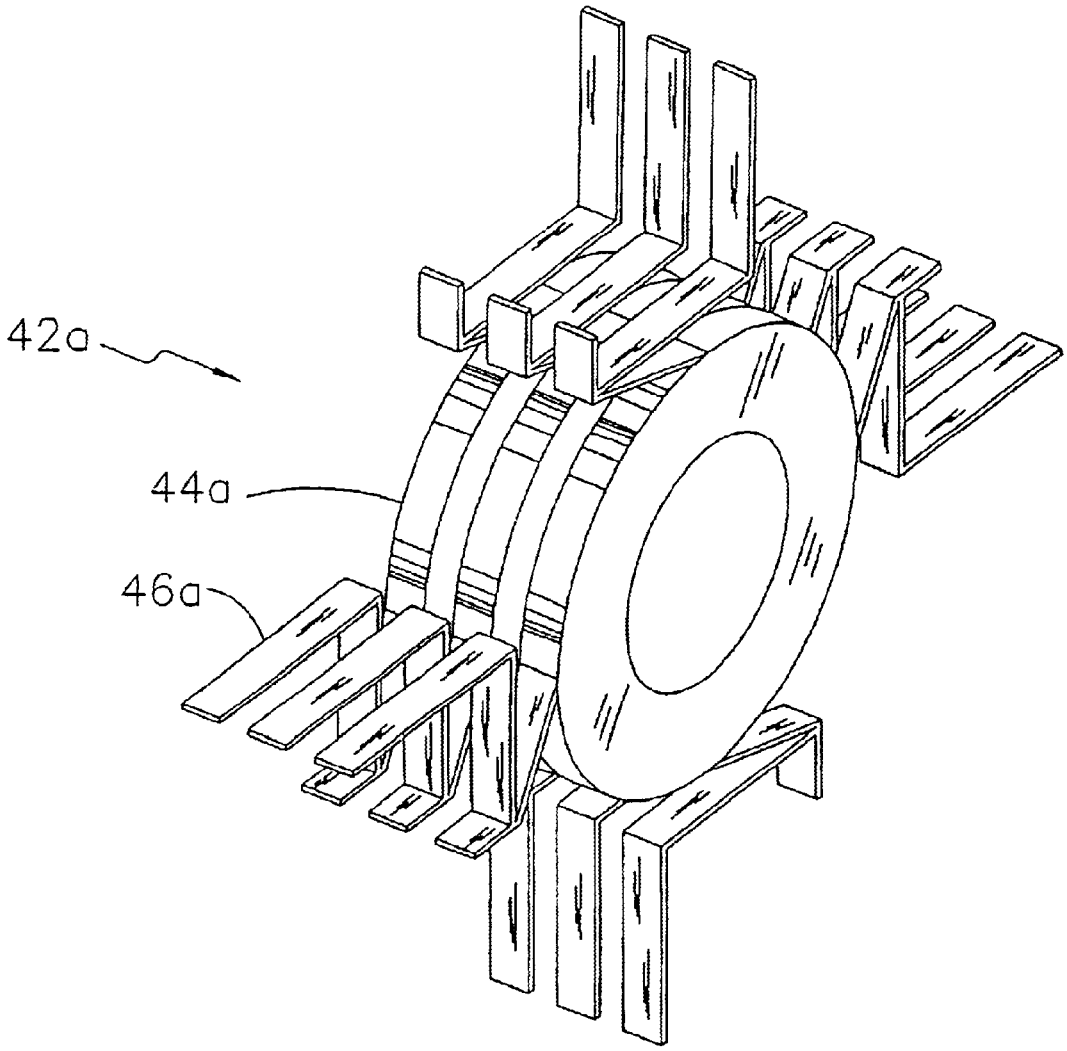
FIG. 11 is a perspective view of an alternate embodiment of the drum assembly of the present invention.

FIG. 11 is a perspective view of an alternate embodiment of the drum assembly 42*a* of the present invention. Drum assembly 42*a* includes drum disk 44*a* and tray holder members 46*a*. As should be understood, drum disk 44*a* and tray holder members 46*a* could take any suitable shape that would accomplish the purposes of the tray control module of the present invention.

Figure 12:
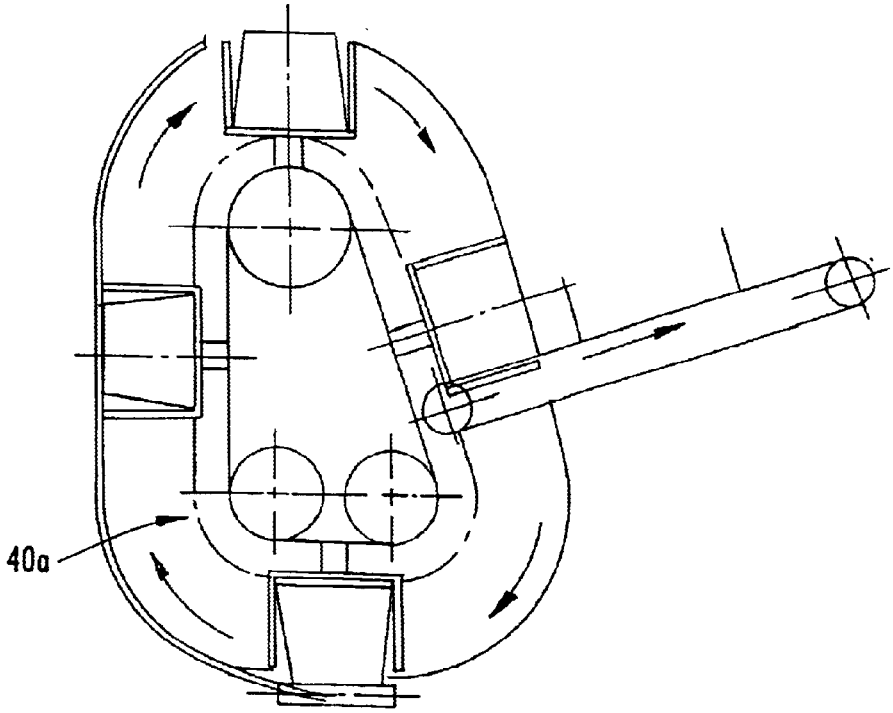
FIG. 12 is a side elevational view of an alternate embodiment of the tray control module of the present invention.
Figure 13:
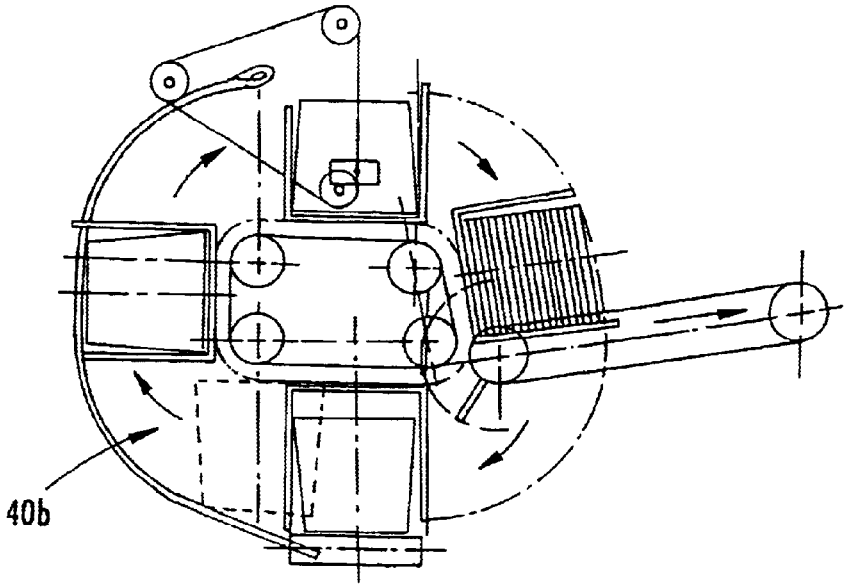
FIG. 13 is a side elevational view of another alternate embodiment of the tray control module of the present invention.

Similarly, it is foreseen that the tray control module can take any geometrical configuration. For example, FIG. 12 is a side elevational view of an alternate embodiment of the tray control module 40*a* of the present invention. Instead of a drum disk, tray holder members ride along a triangular belt or chain conveyor, or any suitable conveyor/drive system. FIG. 13 is a side elevational view of another alternate embodiment of the tray control module 40*b* of the present invention, wherein the belt or chain conveyor is substantially rectangular. In either embodiment, the remainder of the tray control module and its function remains the same as described above with respect to FIG. 4.

Figure 14:
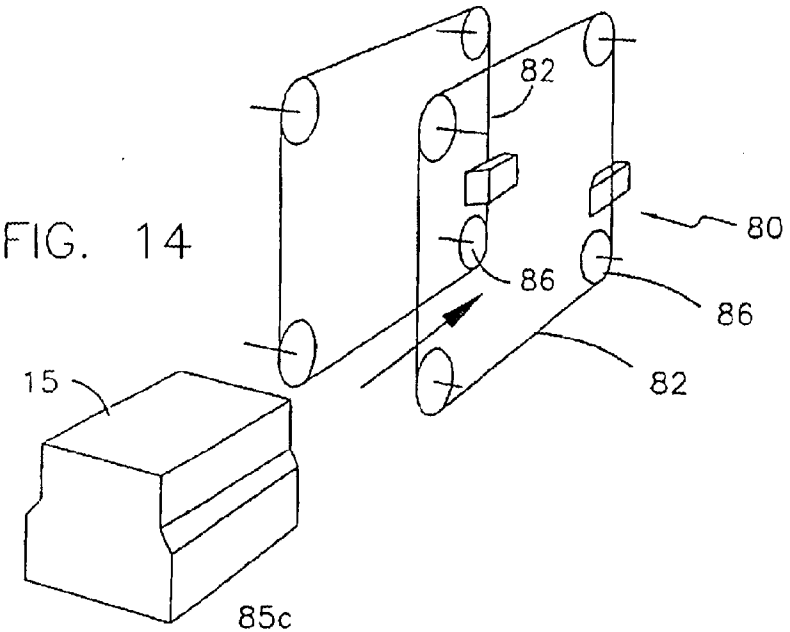
FIG. 14 is a schematic perspective view of the empty tray removing module of the present invention.

Referring now to FIG. 14, tray removing module 80 of the present invention 10 is illustrated. As tray control module 40 rotates tray 15 to the third position, the tray 15 is brought into position between two spring loaded friction pads 84. Friction pads travel along belt conveyors 82 mounted around drive pulleys 86. However, any suitable drive means for the friction pads is contemplated.

Figure 15:
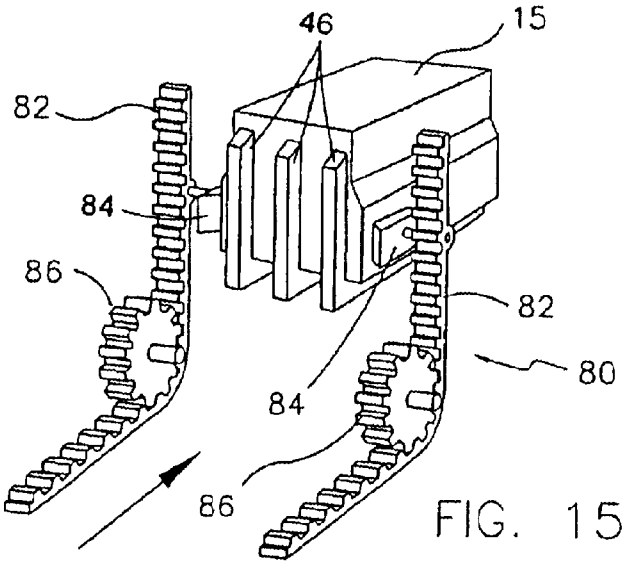
FIG. 15 is a partially broken away perspective view of the empty tray removing module of the present invention.

FIG. 15 is a partially broken away perspective view of the tray removing module 80 of the present invention 10. Tray removing module 80 includes belt conveyors 82 which can be in the form of timing belts as shown, or any suitable conveyor/drive system such as belts, chains, and the like. Friction pads 84 are suitably attached to belt conveyors 82, which are driven by drive pulleys 86. As can be seen, the drum assembly 42 (not shown) with tray 15 in tray holder members 46 moves the tray 15 into engagement with the friction pads 84. Thus, when the belts 82 are driven, friction pads 84 lift the tray away from the tray holder members 46, leaving the mailpieces 20 laying flat on the upper member 47*b* of the tray holder members 46.

Figure 16:
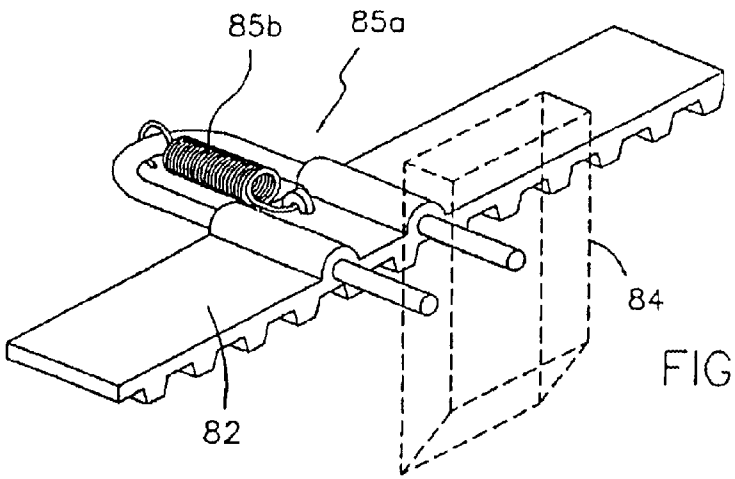
FIG. 16 is a partially broken away perspective view of the friction pad mounting of the empty tray removing module of the present invention.

FIG. 16 is a partially broken away perspective view of the friction pad mounting of the present invention 10. The friction pads 84 are suitably attached in belts 82 via a U-shaped pad mount 85*a*. Preferably, a spring 85*b* applies an inward tension to the friction pads to enhance the grip on the tray 15. As can be seen, friction pad 84 preferably includes a sloped or beveled face which allows the tray to securely wedge between the friction pads. It should be understood however that the friction pads could take any suitable size or shape.

Figure 17:
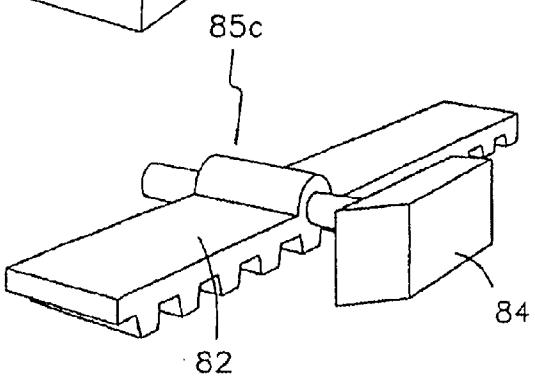
FIG. 17 is a partially broken away perspective view of an alternate embodiment of the friction pad mounting of the empty tray removing module of the present invention.

FIG. 17 illustrates an alternate embodiment of the friction pad mounting of the present invention 10. The friction pads 84 are suitably attached in belts 82 via a pad mount 85*c*, which can for example take the form of a shaft fastened in the belt 82, as illustrated.

Figure 18A:
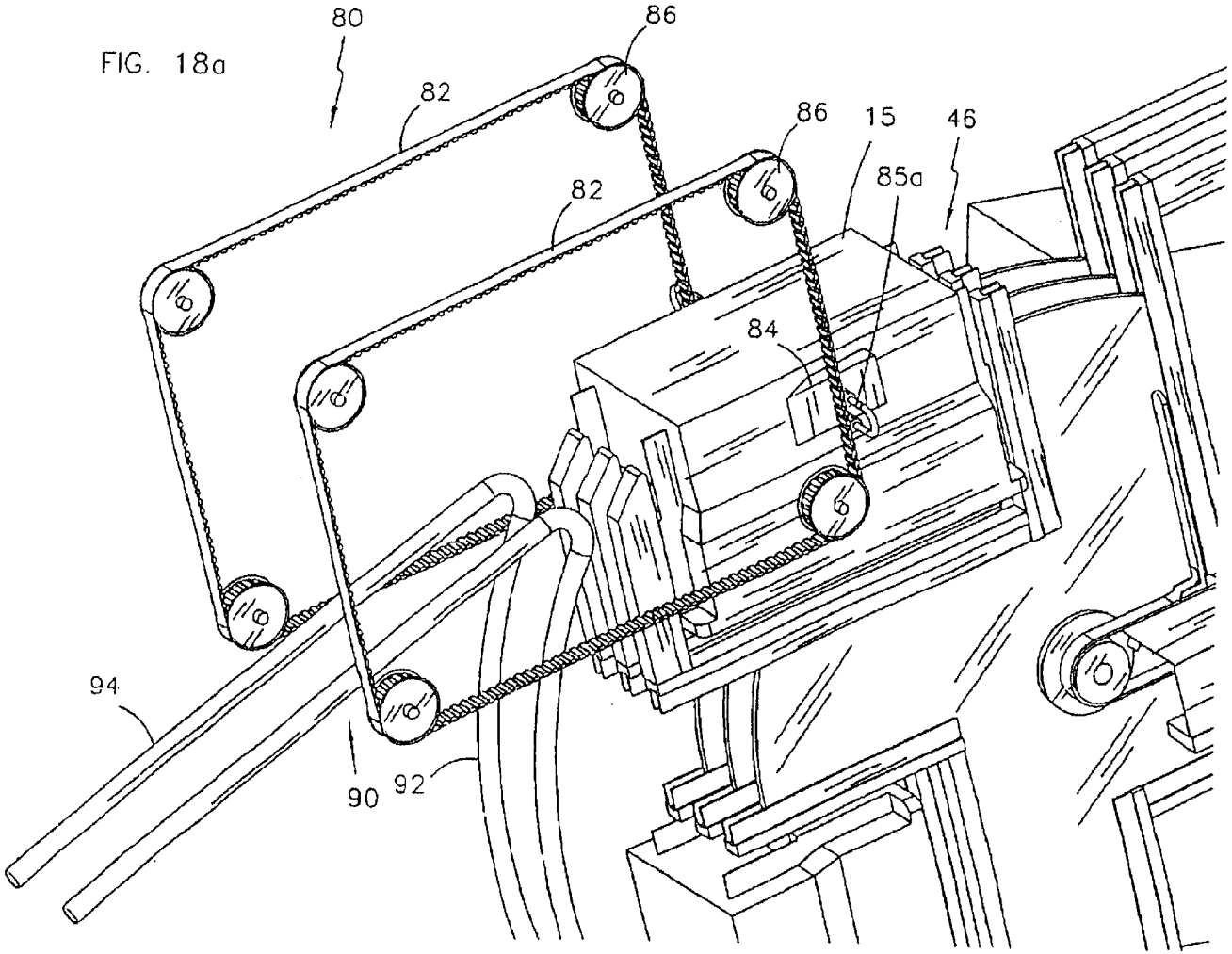
FIG. 18A is a perspective view of the initial stage of the tray removal process in the tray removing module of the present invention.

FIG. 18A is a perspective view of the initial stage of the tray removal process of the present invention 10. In this stage, the belt conveyors 82 are stationary at a point where the friction pads are located at a home position. A tray 15 in tray holder members 46 is introduced between the friction pads 84 (second pad not visible) of the tray removing module 80 as the tray 15 is rotated to the third position by the drum assembly 42. Belt conveyors 82 positioned around drive pulleys 86 are then activated. As the belt conveyor is driven, pad mount 85*a* and attached friction pads 84 in belts 82 move along with the belts, causing the tray 15 engaged between the pads 84 to travel along the belt conveyor path. Empty tray portion 94 of tray guide 90 is positioned between belt conveyors 82 as will be described in more detail below. It should be understood that tray guide portion 94 could be separate from tray guide portion 92, i.e., there could be two separate tray guides.

Figure 18B:
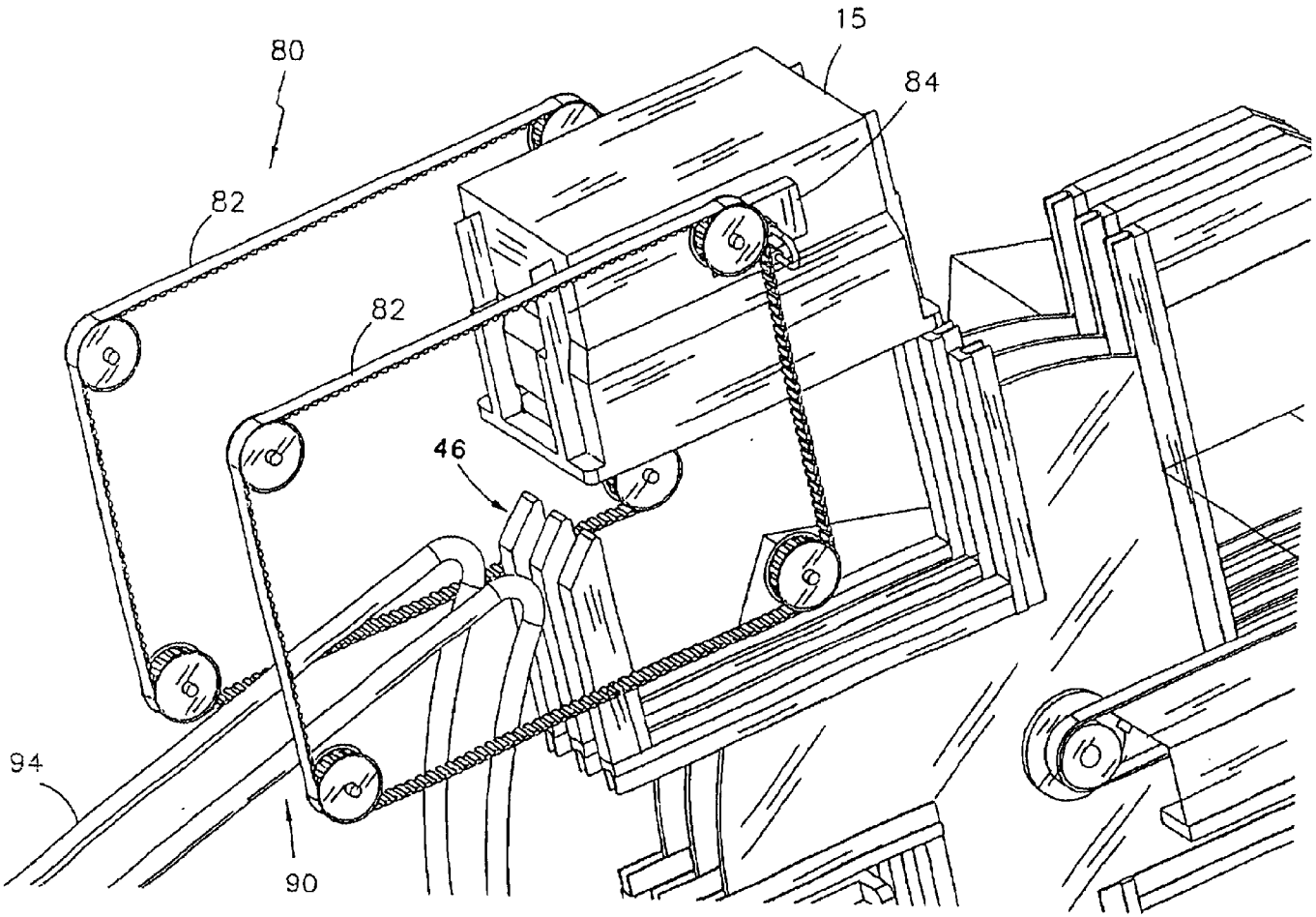
FIG. 18B is a perspective view of the separation stage of the tray removal process in the tray removing module of the present invention.

FIG. 18B is a perspective view of the separation stage of the tray removal process of the present invention (mail is not shown). The belt conveyors 82 of the tray removing module 80 are driven and the friction pads 84 move vertically, upwards to lift the upside down tray 15 out of the tray holder members 46.

Figure 18C:
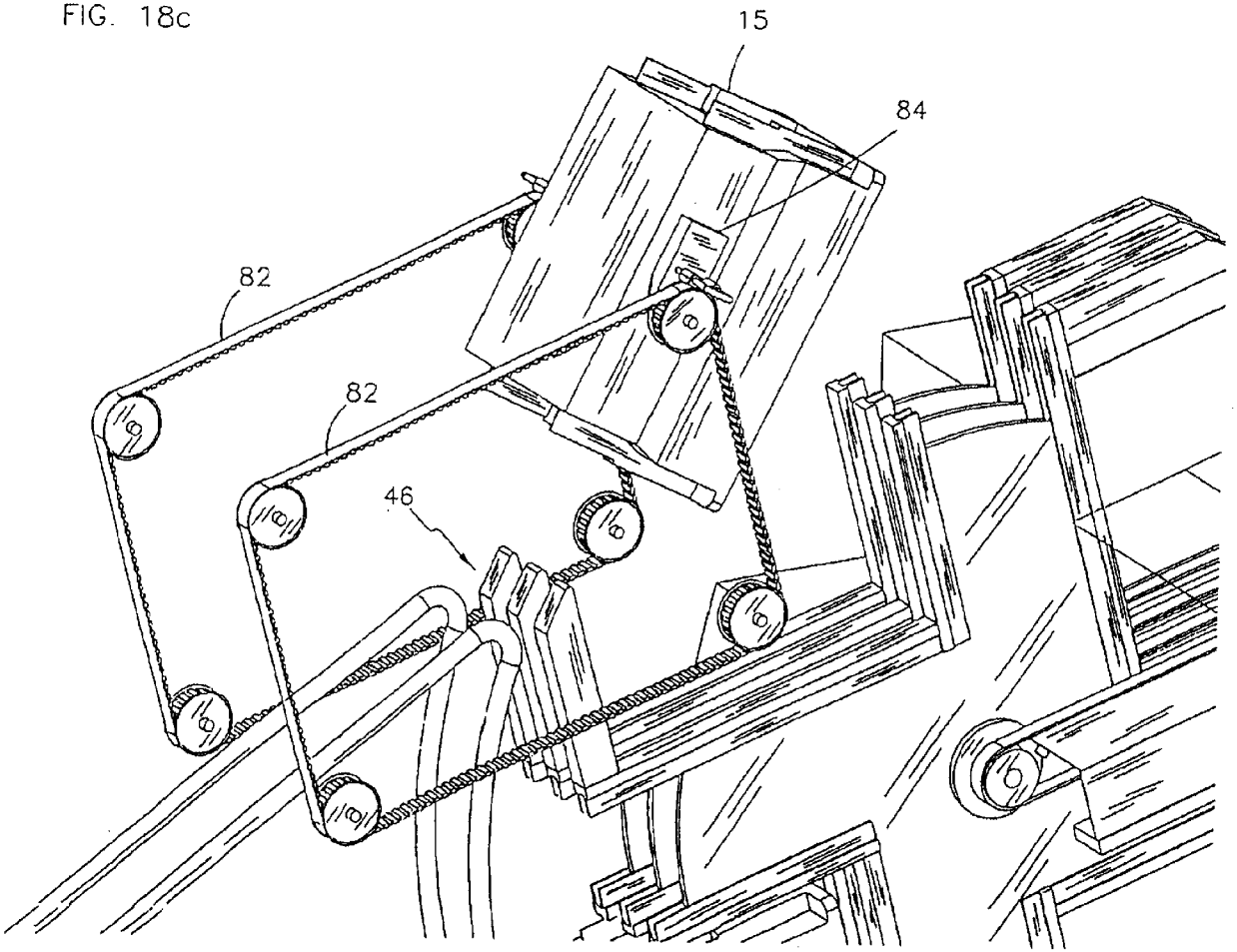
FIG. 18C is a perspective view of the first turn stage of the tray removal process in the tray removing module of the present invention.

FIG. 18C is a perspective view of the first turn stage of the tray removal process of the present invention 10. Friction pads 84, and tray 15 therebetween, continue to travel along the belt conveyor path, making a first turn to transition from vertical movement to horizontal movement.

Figure 18D:
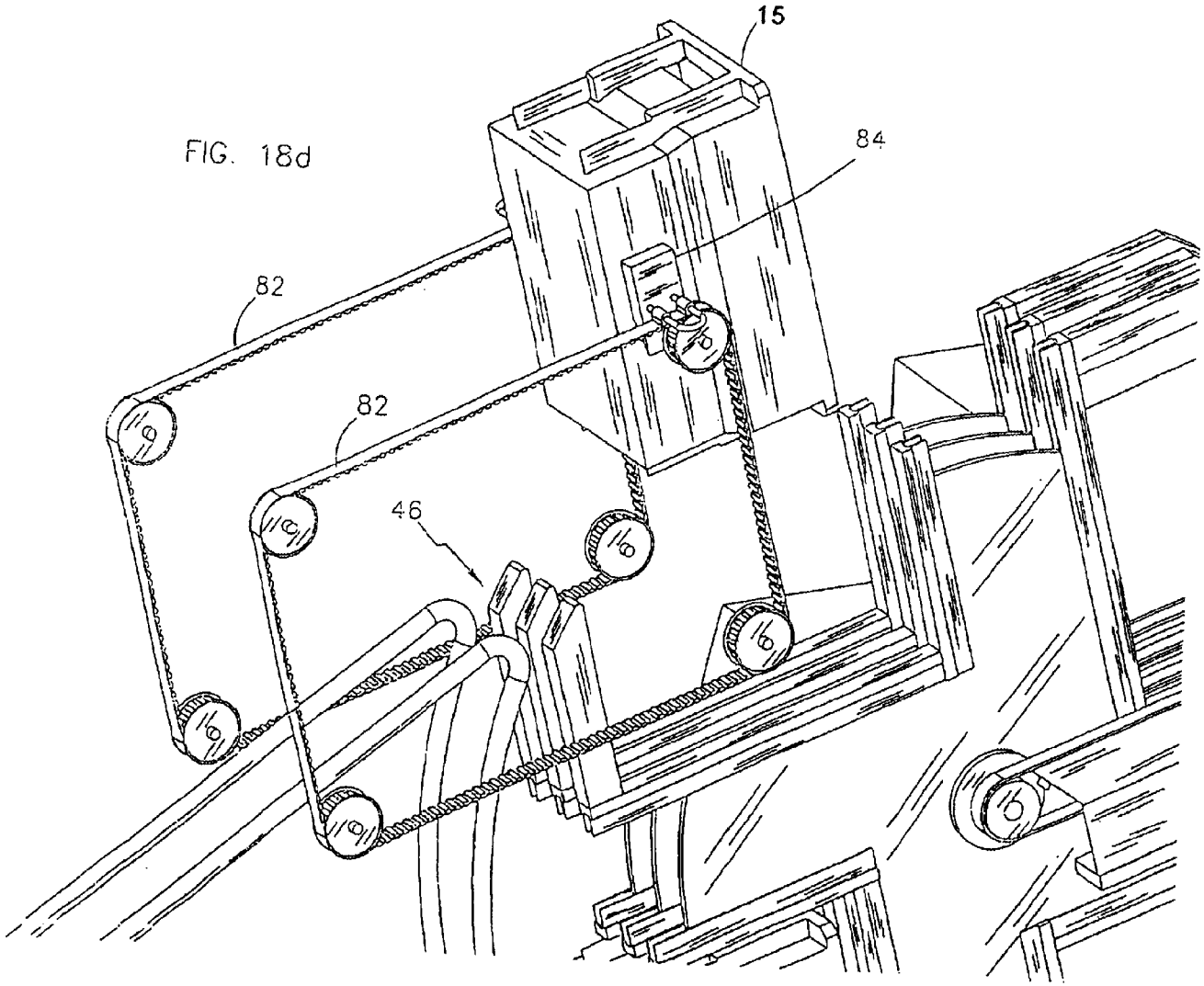
FIG. 18D is a perspective view of the completion of the first turn stage of the tray removal process in the tray removing module of the present invention.

FIG. 18D is a perspective view of the completion of the first turn stage of the tray removal process of the present invention. Friction pads 84 now move horizontally along the belt conveyor path. The upside down tray 15 has been rotated ninety degrees, on its side.

Figure 18E:
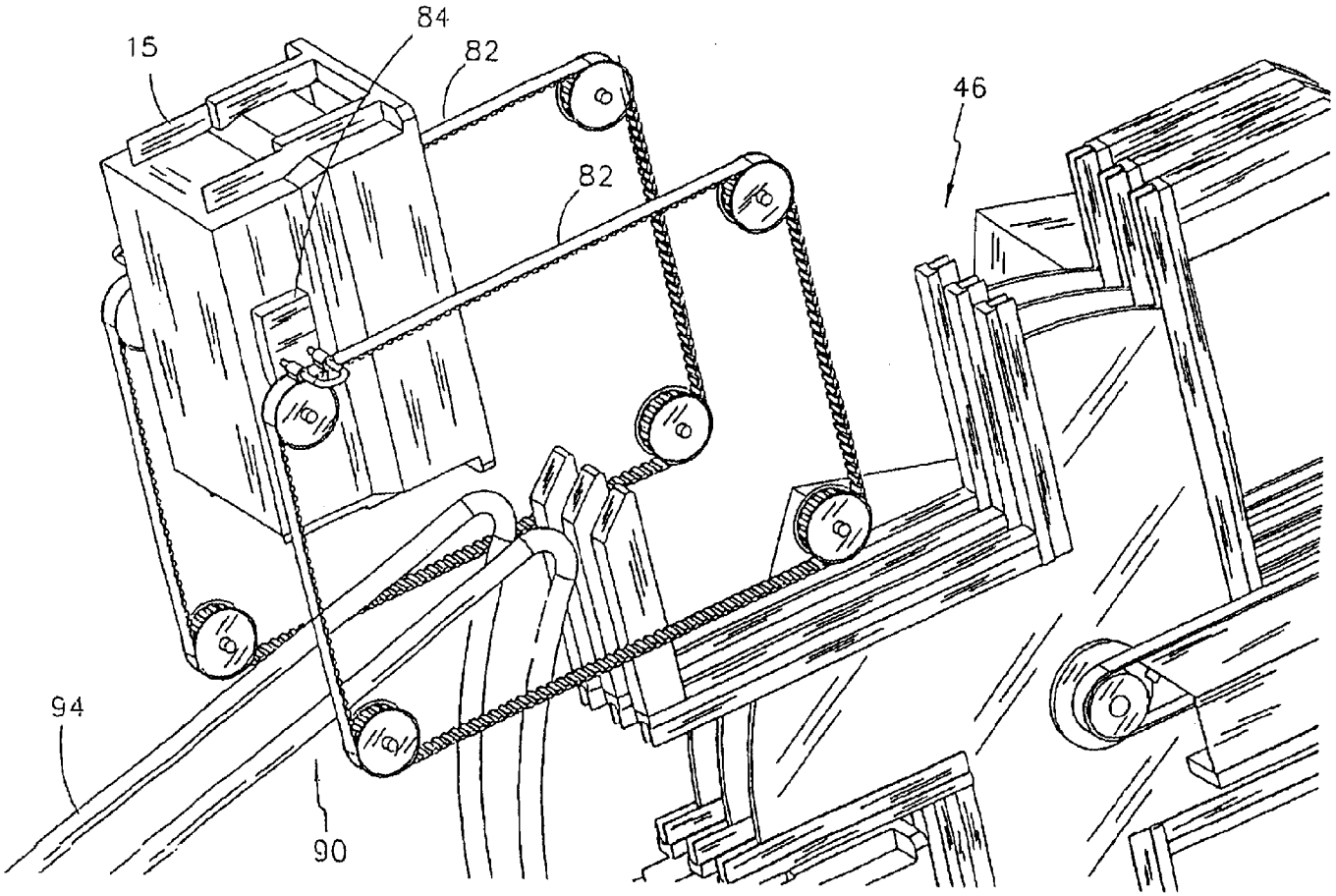
FIG. 18E is a perspective view of the transfer stage of the tray removal process in the tray removing module of the present invention.

FIG. 18E is a perspective view of the transfer stage of the tray removal process of the present invention 10. Friction pads 84 have transferred the tray 15 horizontally between the first turn and the second turn, to a position above the empty tray portion 94 of the tray guide 90.

Figure 18F:
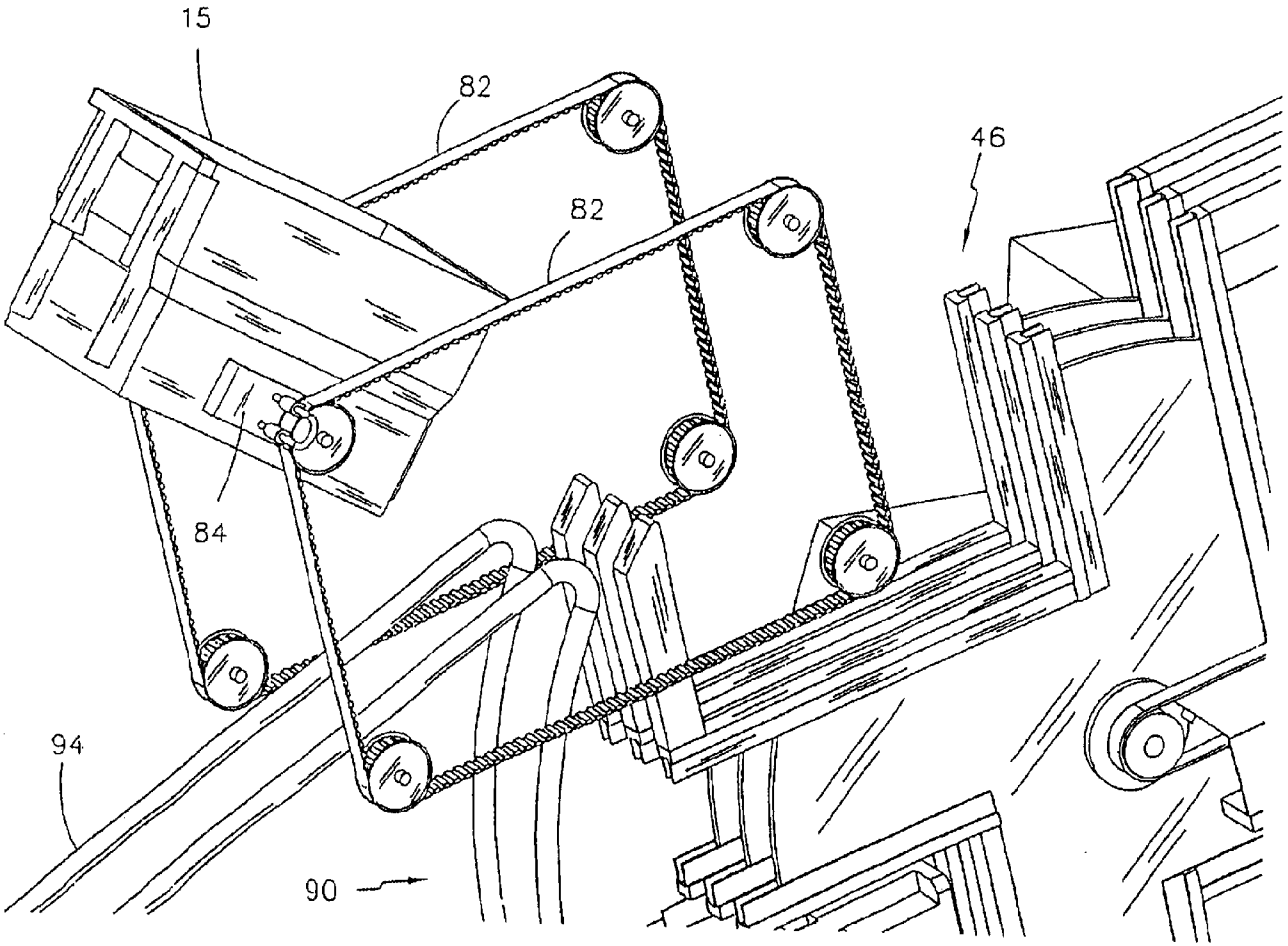
FIG. 18F is a perspective view of the second turn stage of the tray removal process in the tray removing module of the present invention.

FIG. 18F is a perspective view of the second turn stage of the tray removal process of the present invention 10. Friction pads 84, and tray 15 therebetween, continue to travel along the belt conveyor path, making a second turn to transition from horizontal movement back to vertical movement.

Figure 18G:
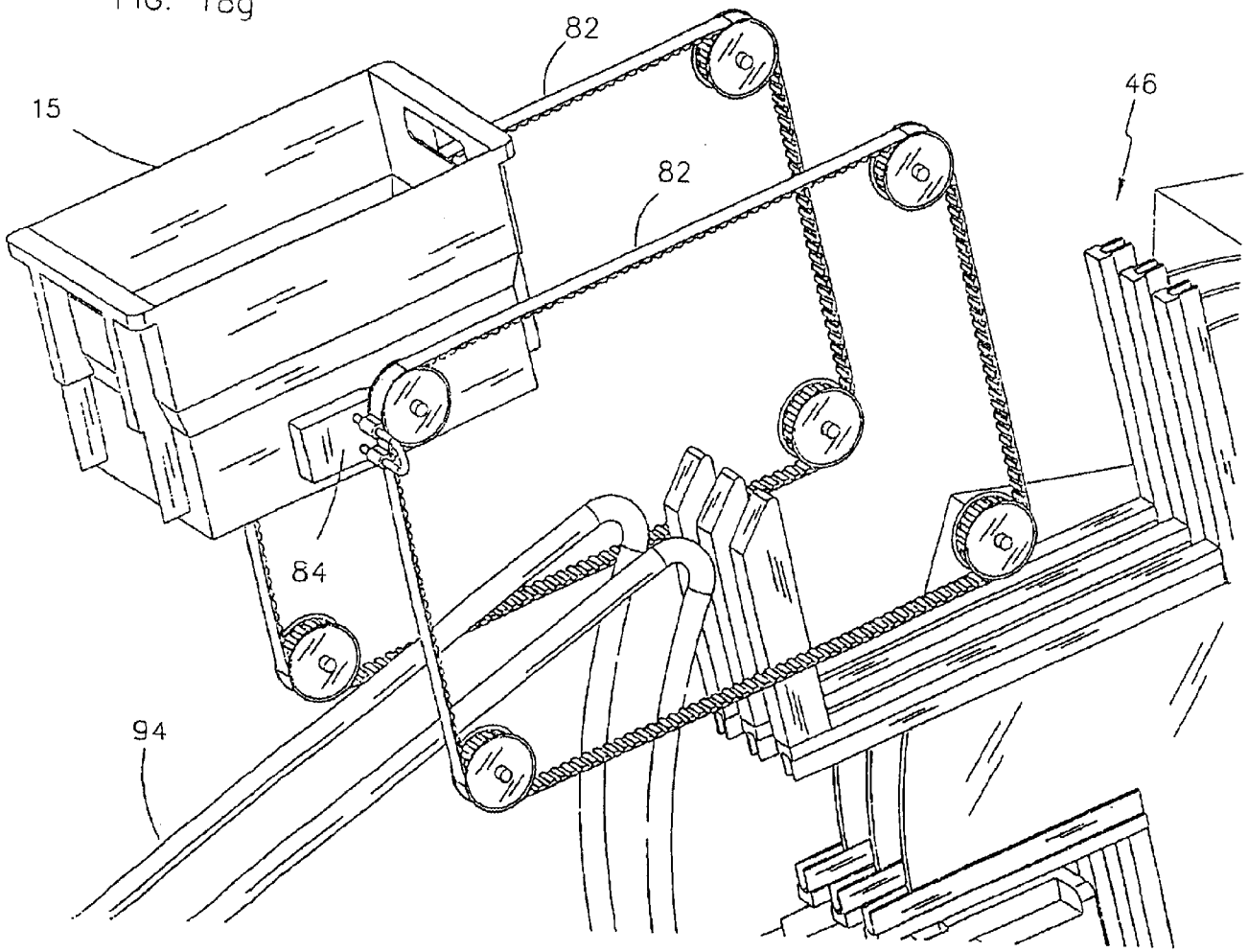
FIG. 18G is a perspective view of the completion of the second turn stage of the tray removal process in the tray removing module of the present invention.

FIG. 18G is a perspective view of the completion of the second turn stage of the tray removal process of the present invention 10. Friction pads 84 now move vertically, downward along the belt conveyor path. The tray 15 has again been rotated ninety degrees, and is now in an upright position.

Figure 18H:
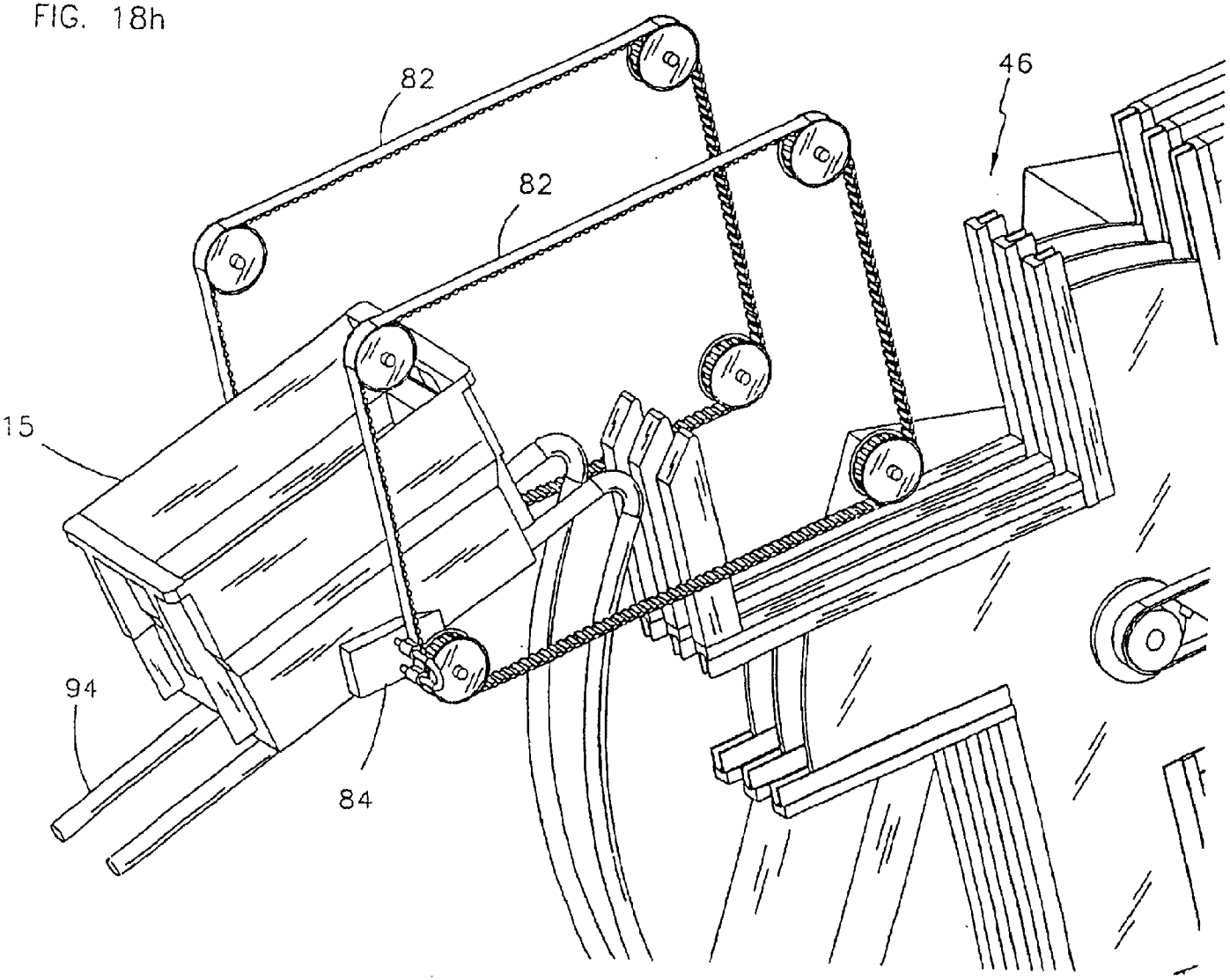
FIG. 18H is a perspective view of the release of the tray during the removal process in the tray removing module of the present invention.

As the friction pads 84 move down the belt conveyor path, the upright tray 15 will contact the empty tray portion 94 of tray guide 90, stopping the downward movement of the tray 15, as shown in FIG. 18H. Friction pads 84 will continue to move along the belt conveyor path, releasing or sliding from contact with tray 15, and returning to their original, home starting position. The friction pads 84 stop in their home position and wait for a new tray to arrive. Tray 15, having been freed from the friction pads 84, is free to slide down the inclined empty tray portion 94 of the tray guide 90 to any desired location.

Figure 19:
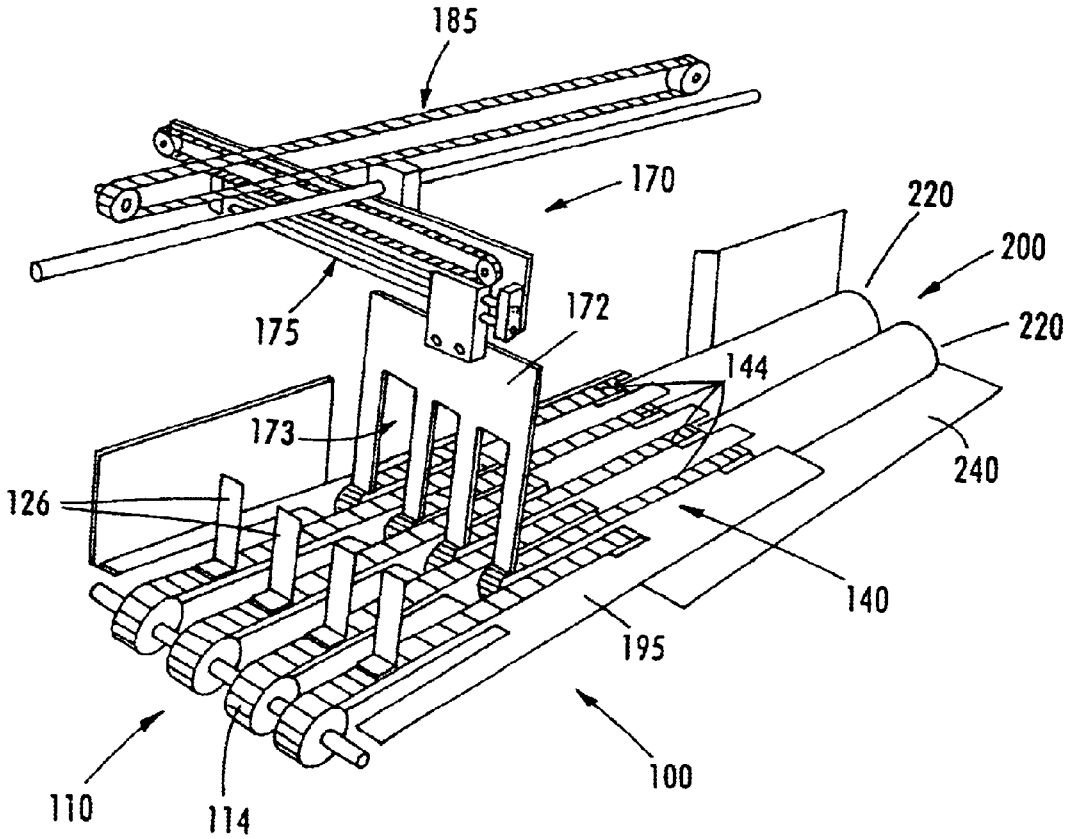
FIG. 19 is a perspective view of the dual conveyor assembly, mail support paddle module and spiral transport system of the present invention.

Referring now to FIG. 19, a perspective view of the conveyor assembly 100, mail support paddle module 170 and spiral transport system 200 of the present invention 10 is illustrated. Conveyor assembly 100 includes supply belt transport 110 and collector belt transport 140, which overlap or mesh at the end of supply belt transport 110 and the beginning of the collector belt transport 140. Conveyor assembly 100 is preferably set at an incline of approximately fifteen degrees (or any suitable incline) to facilitate control of the mailpieces as they are transported. Supply belt transport 110 includes a plurality of spaced apart belts 114 for transporting mailpieces along table 195, and having fingers 126 attached thereto for supporting mail during transportation. Since the conveyor assembly 100 is inclined, the mailpieces are transported on edge by the belts and supported on the back by the fingers 126 as the supply belt transport conveys the mailpieces to the collector belt transport 140.

The package of mail which is unloaded from the trays is limited in size by the capacity of the tray. The content of each tray is transferred to the supply belt transport one after another and generates a gap between the packages of mail. For the purpose of eliminating this gap, the supply belt transport delivers each package of mail to the collector belt transport, where one large, uninterrupted mail stack is built and transferred to the spiral transport system.

Collector belt transport 140 includes a plurality of spaced apart belts 144 whereupon one large mail stack is collected or built, and transported to the spiral transport system 200. A mail support paddle module 170 having a selectively positionable paddle 172 is located proximate collector belt transport 140. Paddle 172 is positioned to support the mailpieces on the collector belt transport 140. Successive groups of mailpieces are transported by the supply belt transport 110 to the back of the paddle 172, which supports mailpieces on the collector belt transport 140. The paddle 172 is then moved out and to the back of each successive group of mailpieces. The collector belt transport 140 then pivots up to allow the supply belt transport 110, and fingers 126, to return to their home position. In this manner, the mailpieces are collected on the collector belt transport, which delivers the mailpieces to the spiral transport system 200.

Spiral transport system 200 includes one or more spirals 220 (two shown). Spirals 220 controllably transport the mailpieces in spaced relationship determined by the size and pitch of the coil, along base 240, to any desired location.

Belts 114 of supply belt transport 110 have fingers 126. Paddle 172 of mail support paddle module 170 is shown positioned at the beginning of collector belt transport 140, and is positionable along an x-axis drive assembly 185 and a y-axis drive assembly 175. Paddle 172 has notches 173, which align with the fingers 126 of supply belt transport 140, and allow the fingers 126 to pass therethrough. In this manner, both the fingers 126 and the paddle 172 can engage the same mailpiece at the same time without interference, which allows the fingers to return to their home position.

Figure 20:
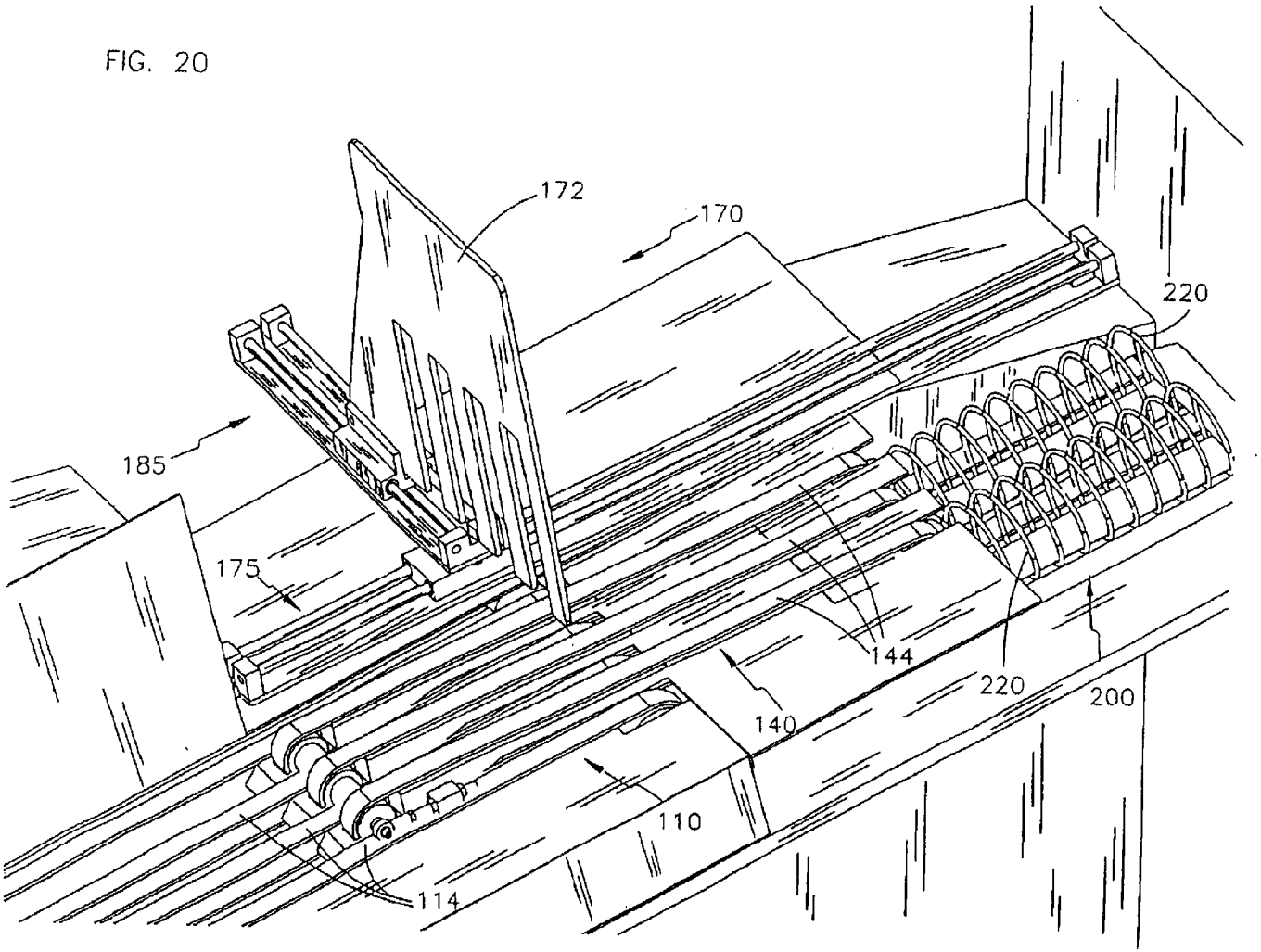
FIG. 20 is an enlarged perspective view of the dual conveyor assembly and the spiral transport system of the present invention.

FIG. 20 is an enlarged perspective view of the conveyor assembly 100 and the spiral transport system 200 of the present invention 10. As previously described, belts 114 of supply belt transport 110 mesh with belts 144 of collector belt transport 140. Mail support paddle module 170 which is positionable via x-axis drive assembly 175 and y-axis drive assembly 185, is mounted adjacent or proximate the collector belt transport 140 and a spiral transport 200. Spirals 220 of spiral transport system 200 are located just below collector belt transport 140, in such a manner as to receive mailpieces sliding down from transport 140 to the spirals 220. A guide could be placed proximate the end of transport 140 to ensure that the mailpieces drop into the spirals 220 in proper position.

Figure 21:
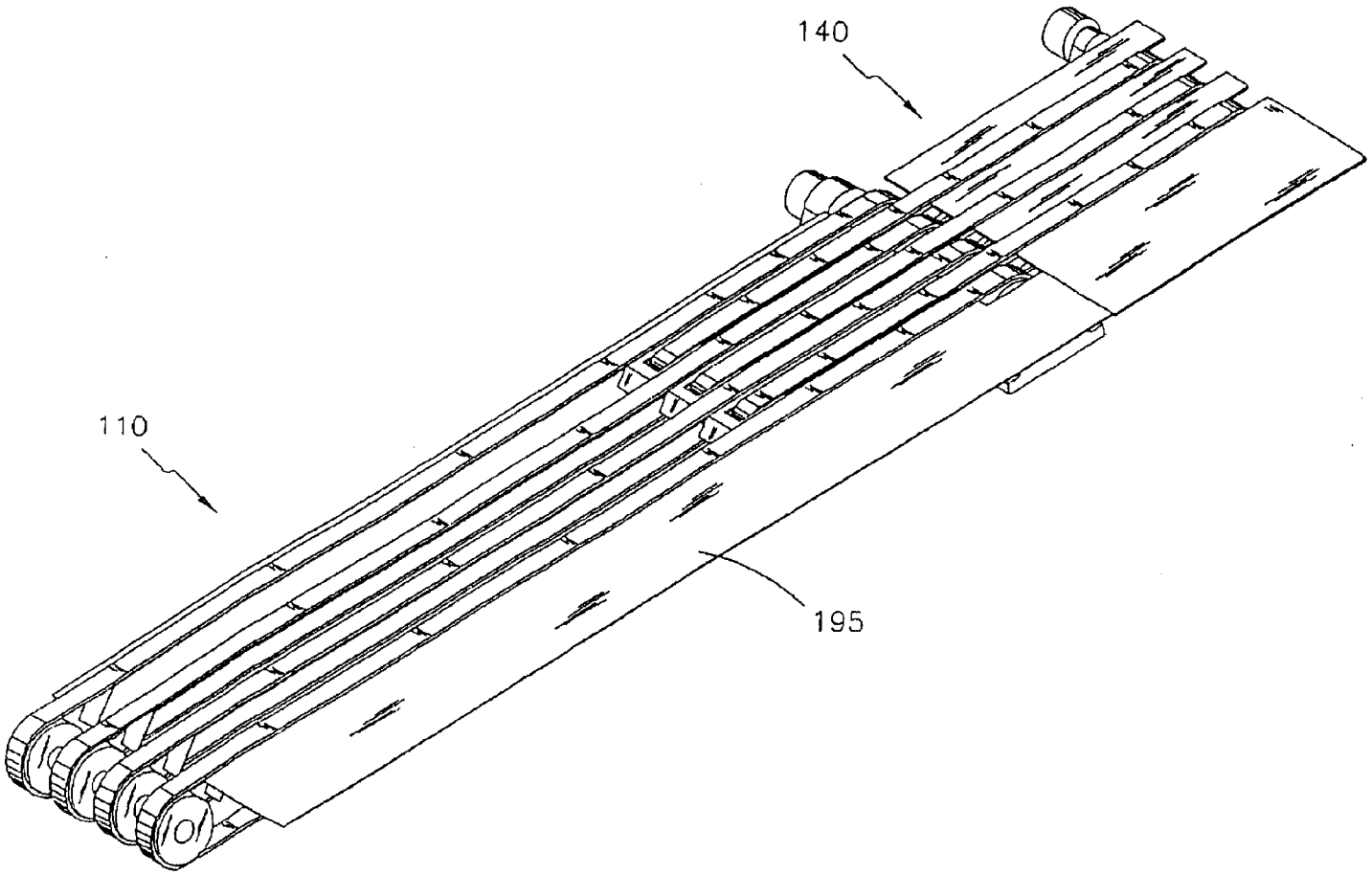
FIG. 21 is a perspective view of the dual conveyor system with table of the present invention.

FIG. 21 is a perspective view of the dual conveyor assembly 100, comprised of supply belt transport 110 and collector belt transport 140, with table 195. As should be readily understood, table 195 includes a plurality of slots corresponding to the location of the conveyor belts of conveyor assembly 100, to allow proper operation of the same.

Figure 22:
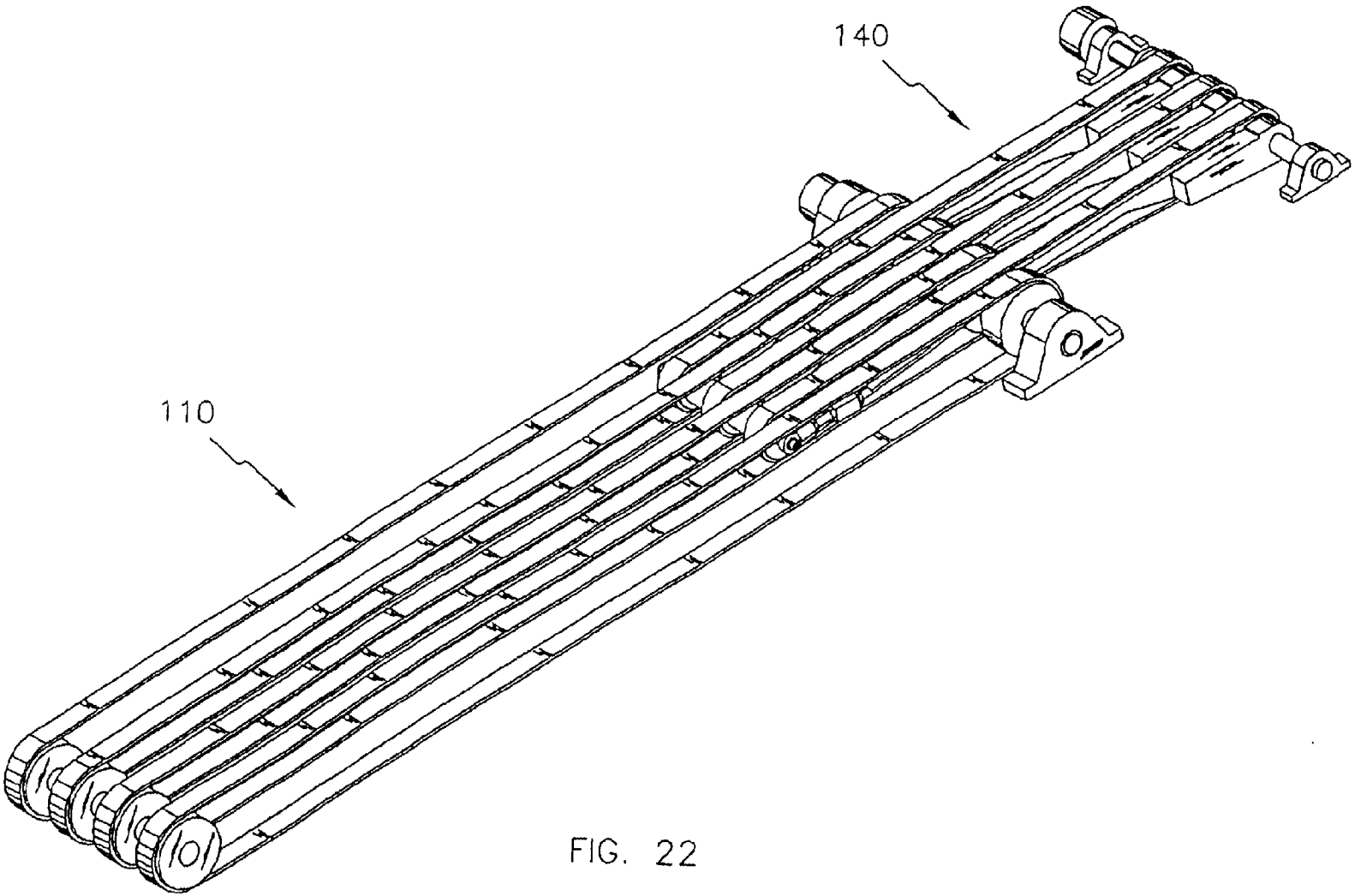
FIG. 22 is a perspective view of the dual conveyor system without table of the present invention.

FIG. 22 is a perspective view of the dual conveyor assembly 100, comprised of supply belt transport 110 and collector belt transport 140, without the table.

Figure 23:
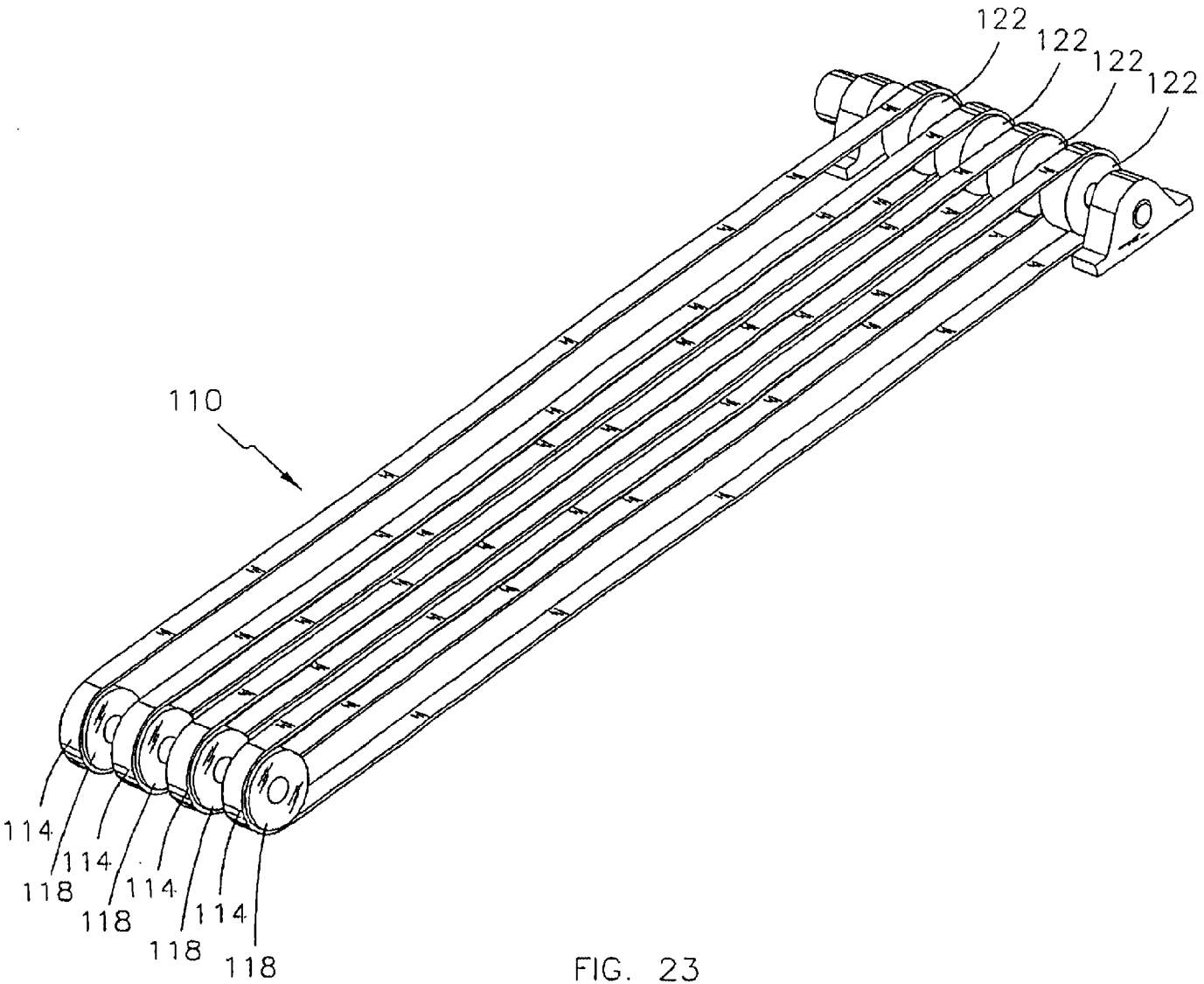
FIG. 23 is a perspective view of the supply belt transport of the present invention.

FIG. 23 is a perspective view of the supply belt transport 110 of the present invention. Belts 114 are mounted around idler pulleys 118 at one end, and drive pulleys 122 at the other end. Belts 114 have fingers 126 (not shown) attached thereon as described next.

Figures 24, 25, 26:
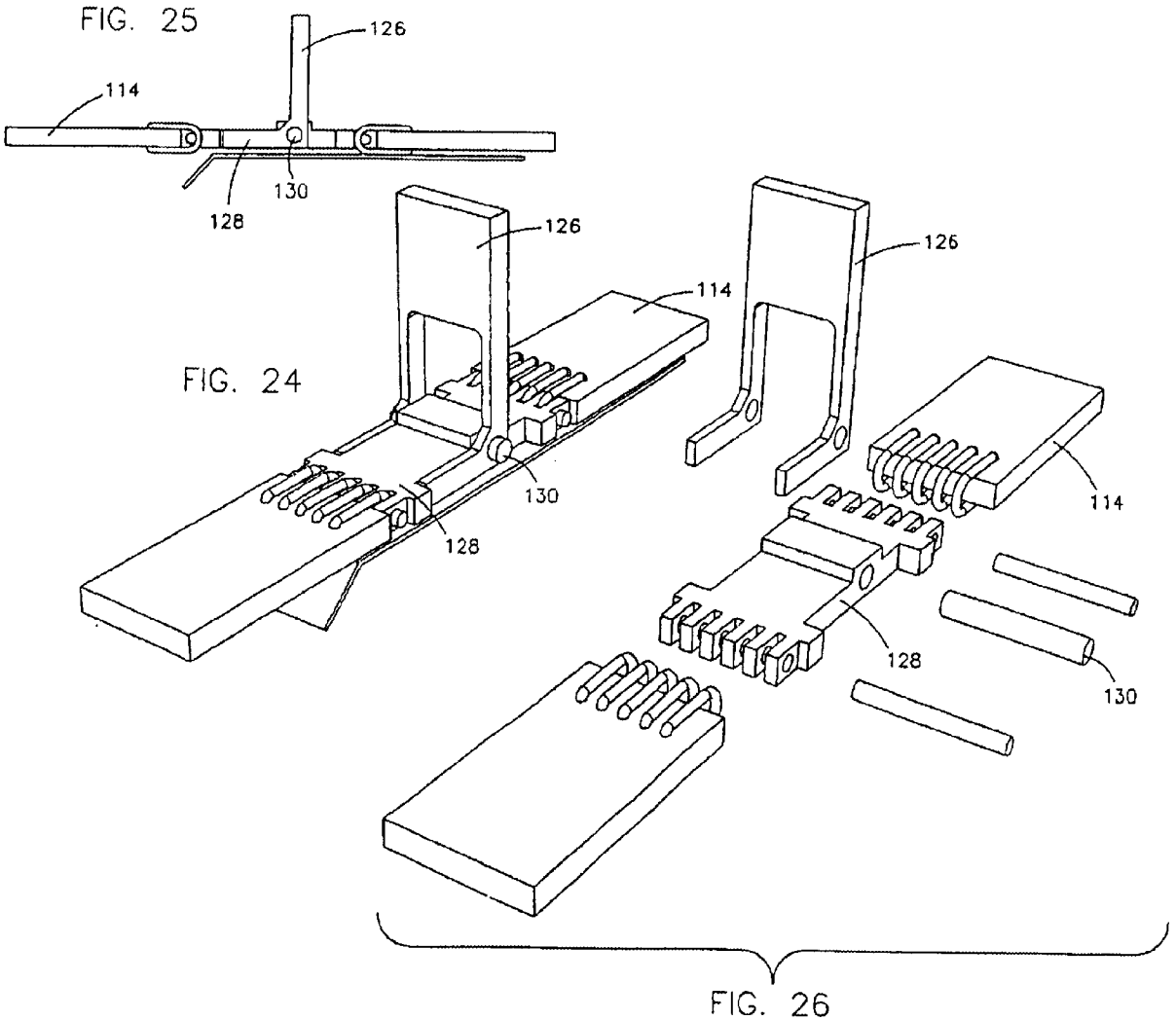
FIG. 24 is a partially broken away perspective view of the supply transport belt finger assembly of the present invention.
FIG. 25 is a side view of FIG. 24.
FIG. 26 is an exploded perspective view of FIG. 24.

FIG. 24 is a partially broken away perspective view of the belt 114 with finger 126. Finger 126 is attached to the belt 114 via a finger mount 128 and finger pivot 130. The finger pivot 130 holds finger 126 in finger mount 128, which is suitably fastened in belt 114. FIG. 25 is a side view of FIG. 24, showing finger 126 pivotally attached to finger mount 128 via finger pivot 130. Finger mount 130 is suitably attached to belt 114. FIG. 26 is an exploded perspective view of FIG. 24, showing belt 114, finger 126, finger mount 128 and finger pivot 130.

Figure 27:
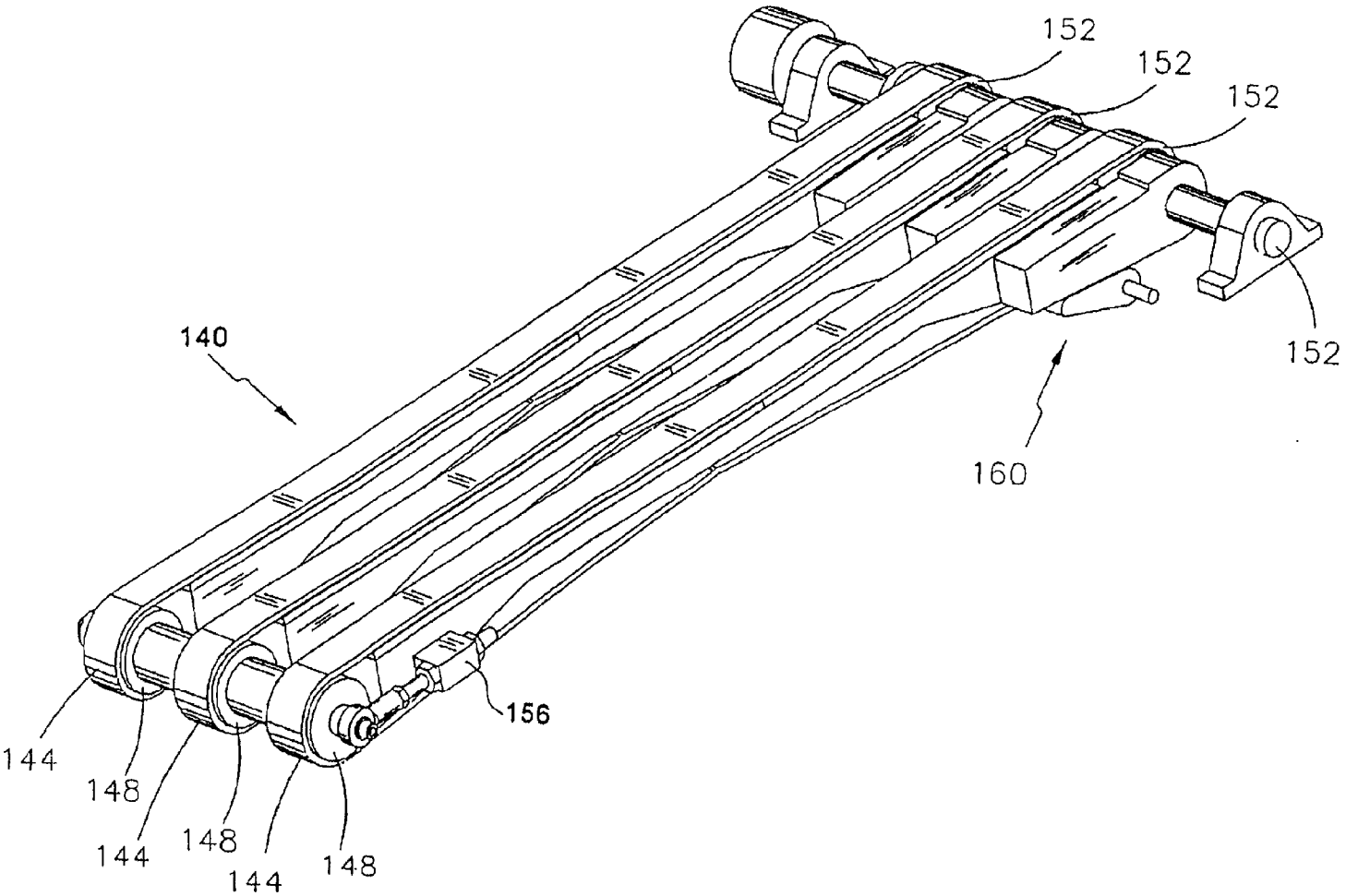
FIG. 27 is a perspective view of the collector belt transport assembly of the present invention.

FIG. 27 is a perspective view of the collector belt assembly 140 of the present invention. Belts 144 are mounted around idler pulleys 148 at one end, and drive pulleys 152 at the other end. A tensioner 156 is provided to adjustably tension belts 144 as desired. Additionally, a cam 160 or any suitable pivot means is provided to pivot up the collector belt assembly 140 about its drive shaft 162, to lift the bottom of the mailpieces off of and above supply belts 114, so that the supply belt transport 110 is free to return to its initial location, where the fingers 126 are in their home position. In the same manner, it is foreseen that the supply belt transport could pivot down and out of contact with the mailpieces, while the collector belt transport remains stationary, so as to allow the transport to reverse direction without interfering with the mailpieces on the collector belt transport.

Figure 28:
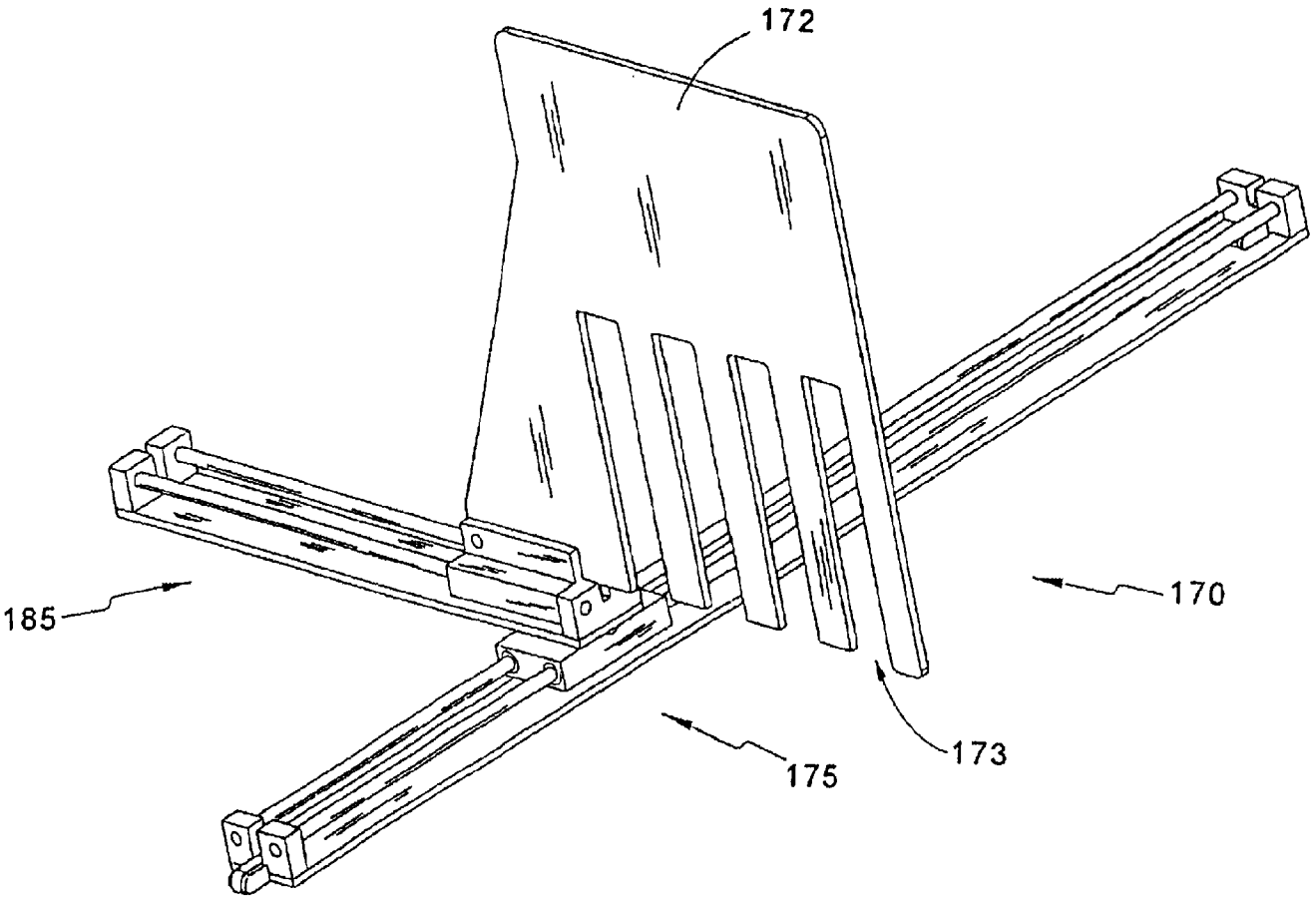
FIG. 28 is a perspective view of the mail support paddle module of the present invention.

FIG. 28 is a perspective view of the mail support paddle module 170 of the present invention 10. Mail support paddle module 170 is comprised of a paddle 172, having notches 173, mounted on a y-axis drive assembly 185, which in turn is mounted on an x-axis drive assembly 175. Accordingly, paddle 172 can move along both an x-axis and a y-axis. When a new group of mailpieces is supplied to collector belt transport 140 by supply belt transport 110, the paddle is moved out of contact with the collected mailpieces via y-axis drive assembly 185, is moved to the back end of the new group of mailpieces via the x-axis drive assembly 175, and then is moved back into engagement with the newly collected mailpieces via the y-axis drive assembly 185. Any suitable drive means and mountings for the paddle 172 are contemplated.

Figures 29A, 29B:
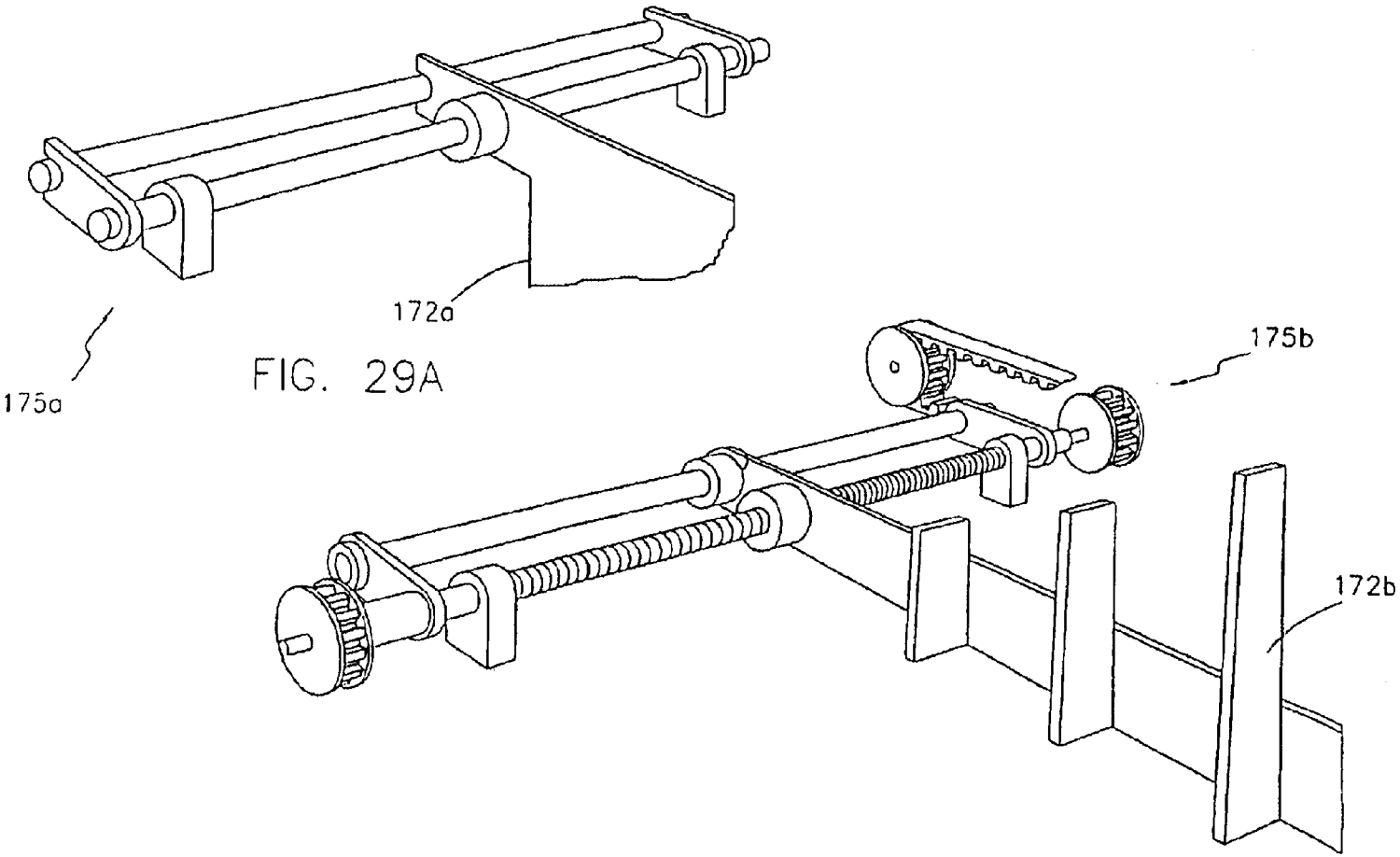
FIG. 29A is a perspective view an alternate embodiment of the mail support paddle module of the present invention with an upper mounting location.
FIG. 29B is a perspective view an alternate embodiment of the mail support paddle module of the present invention with a lower mounting location.

FIG. 29A is a perspective view an alternate embodiment of the mail support paddle module of the present invention with an upper mounting location. Paddle 172*a* is rotatably mounted on an x-axis drive assembly 175*a*. The paddle 172*a* can rotate out of contact with the collected mailpieces, travel along the x-axis via x-axis drive assembly 175*a,* and then rotate back into contact with the newly collected mailpieces.

FIG. 29B is a perspective view an alternate embodiment of the mail support paddle module of the present invention with a lower mounting location. The paddle 172*b* can rotate out of contact with the collected mailpieces, travel along the x-axis via x-axis drive assembly 175*b,* and then rotate back into contact with the newly collected mailpieces.

Figure 30:
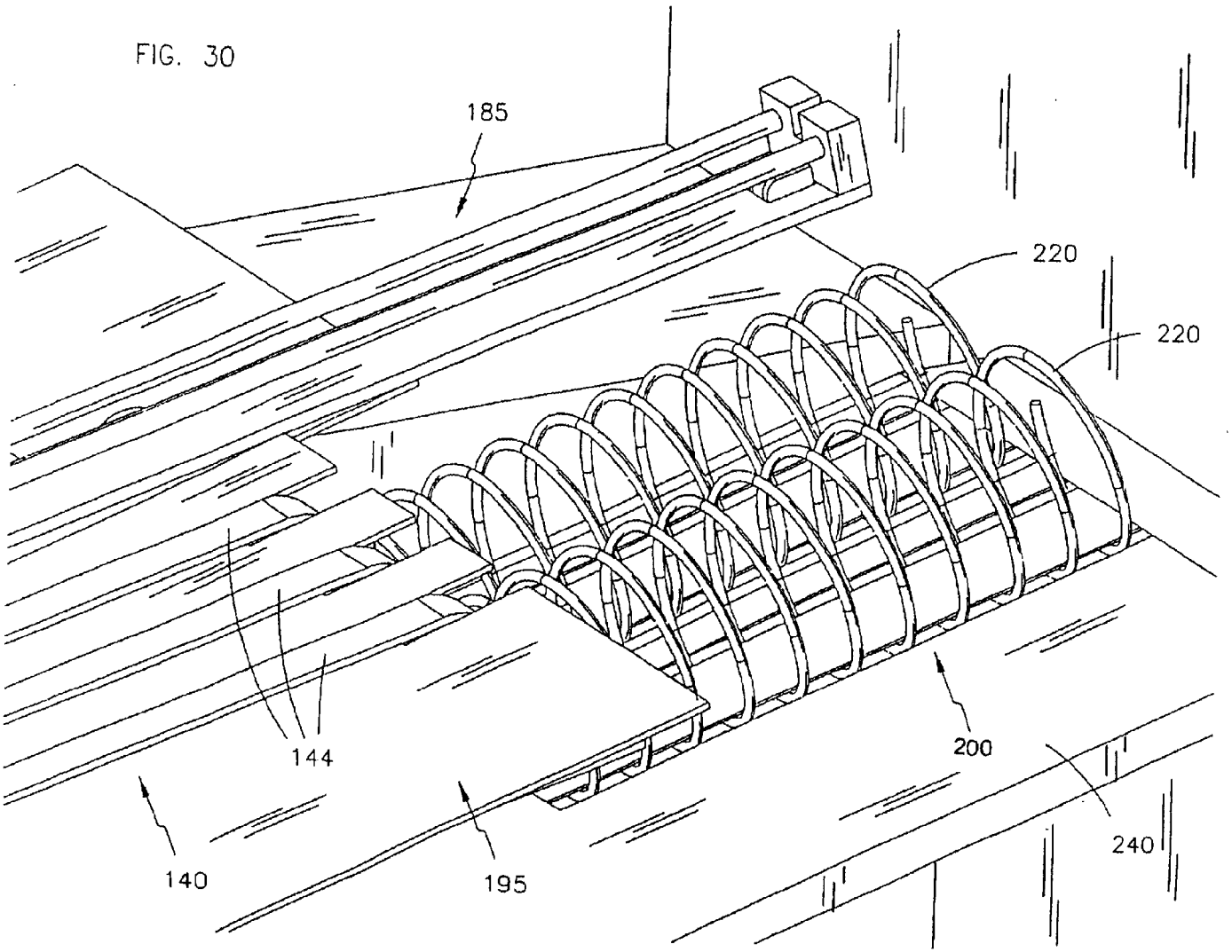
FIG. 30 is a perspective view of the interface between the collector belt transport and the spiral transport system of the present invention.

Referring now to FIG. 30, a perspective view of the interface between the collector belt transport 140 and the spiral transport system 200 of the present invention 10 is illustrated. Belts 144 of collector belt transport 140 convey mailpieces off of table 195 and into the spirals 220 of the spiral transport system 200. Spirals 220 transport mailpieces along base 240 in a spaced relationship determined by the dimensions of the coil of the spiral.

Figure 31:
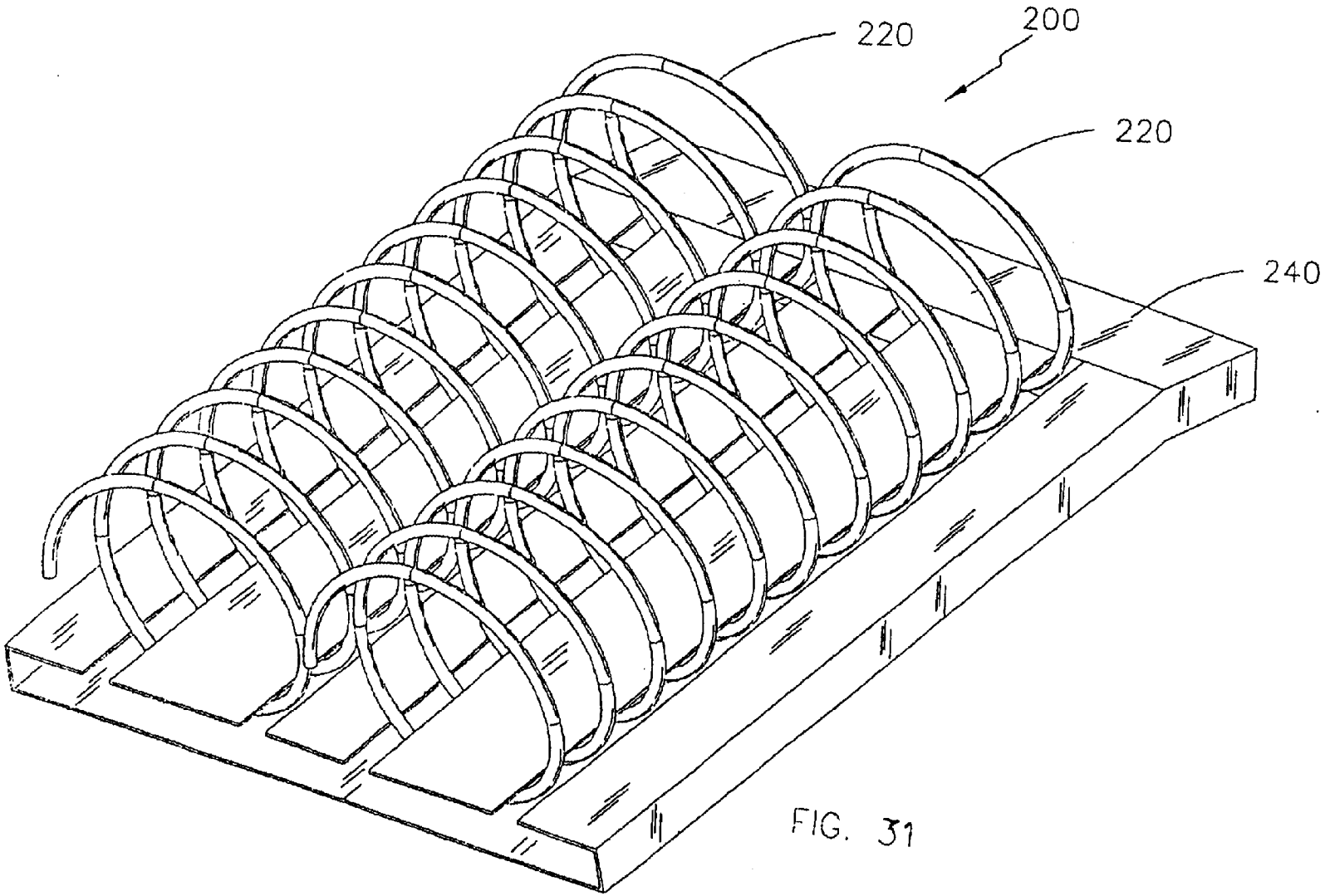
FIG. 31 is a perspective view of the spiral transport system of the present invention.

FIG. 31 is a perspective view of the spiral transport system 200 of the present invention. As can be seen, spirals 220 are operatively mounted for rotation in base 240. A portion of the spiral 220 is set below the base 240 to facilitate proper transport of the mailpieces. Additionally, the drive means of the spiral are also located in or below this base, as can be seen in FIG. 32.

Figure 32:
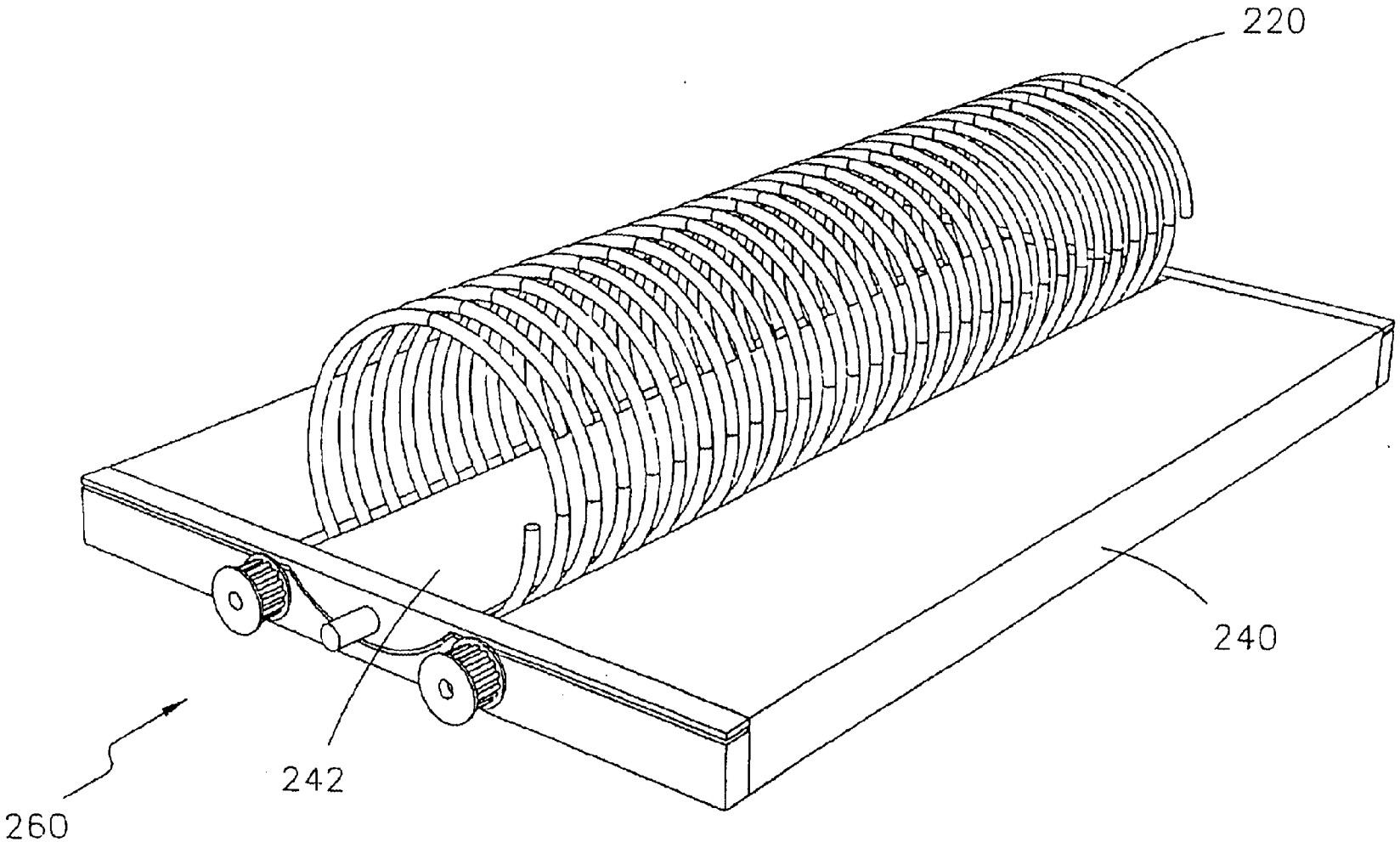
FIG. 32 is a perspective view of a single spiral transport system of the present invention.

FIG. 32 is a perspective view of a single spiral 220 of the spiral transport system 200 of the present invention. Again, spiral 220 is mounted in base 240 with a portion set below the base 240. An inner base portion 242 is located inside the spiral 220 to support the mailpieces being transferred by the spiral 220. Drive means 260 are located below the top plate of base 240 and drive the spiral 220 as described below.

Figure 33:
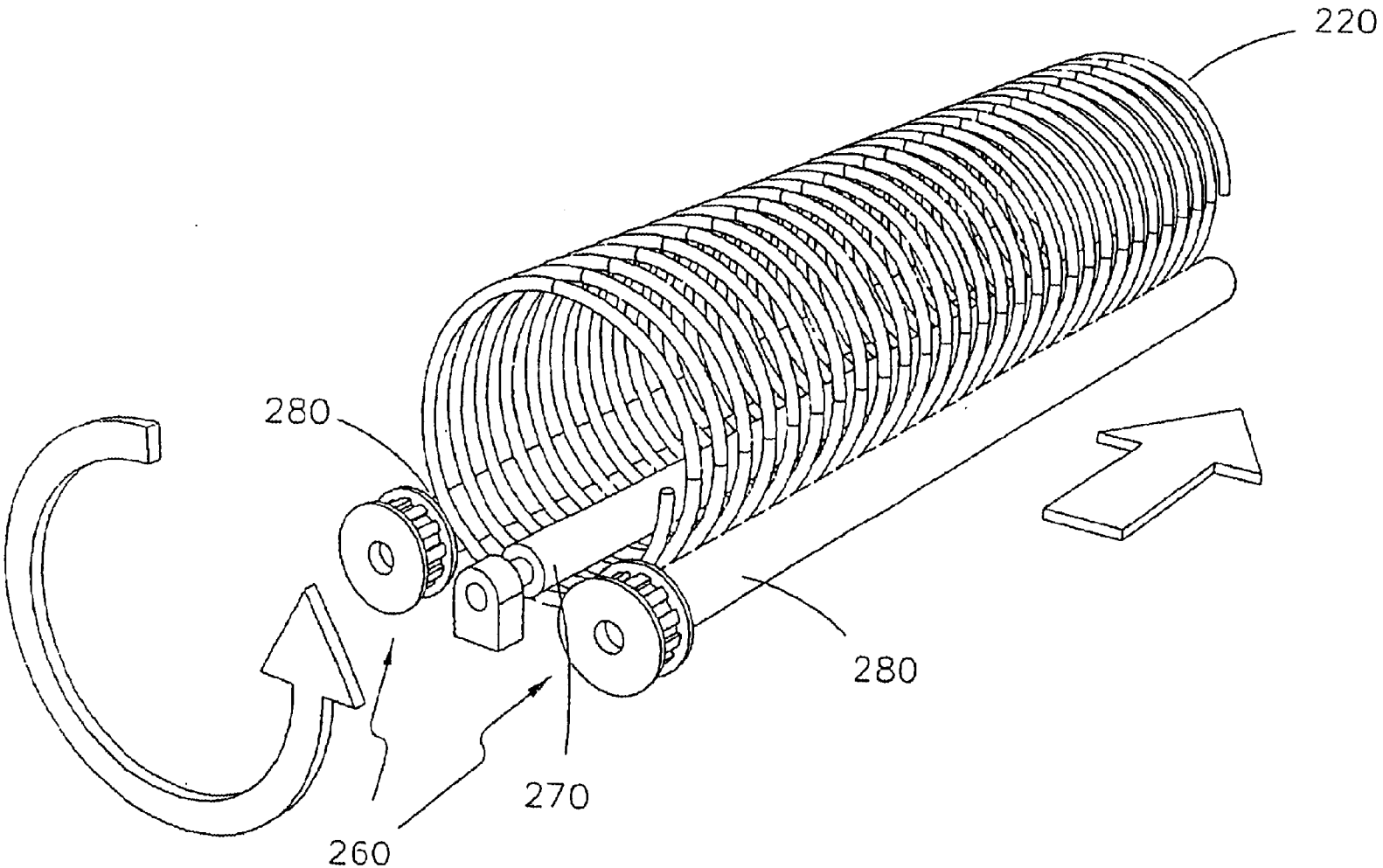
FIG. 33 is a perspective view of the spiral and drive/support shafts of the present invention.

FIG. 33 is a perspective view of a single spiral 220 of the spiral transport system 220 of the present invention in the absence of base 240. Drive means 260 can be seen in contact with the lower portion of the spiral 220. Drive means 260 comprise an inner pressure shaft 270, and two outer drive shafts 280. Inner shaft 270 and outer shafts 280, as shown, extend along substantially the entire length of the spiral 220. This allows the spiral 220 to assume any desired length, as the spiral is supported at all points along its length. Friction between the drive shafts 280 and the points of contact with the spiral 220 causes the spiral 220 to rotate about a central axis, which is not concentric with the axis of rotation of the drive shafts 280. Inner shaft 270 serves as an idler roller and pressures the spiral 220 against the drive shafts 280.

Figure 34:
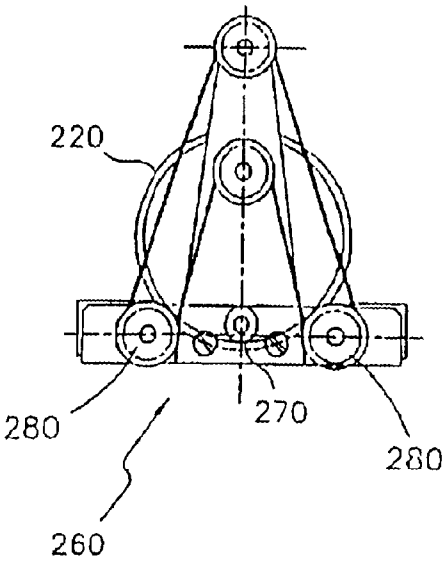
FIG. 34 is an end view of FIG. 33.

FIG. 34 is an end view of drive means 260 for the single spiral 220 of FIG. 33. Drive shafts 280 are driven in any suitable manner, for example by an operatively connected drive belt as illustrated. Shaft 270 is shown inside spiral 220.

It should be understood however, that drive means 260 could take any suitable form consistent with the principles of the present invention. For example, it is foreseen that the inner shaft 270 could be driven instead of or in addition to the outer shafts 280. Further, any number of inner and outer shafts are contemplated. Also, the inner and/or outer shafts can vary in length so long as the integrity of the spiral is not compromised. The following are illustrative alternate embodiments of the drive means.

Figure 34B:
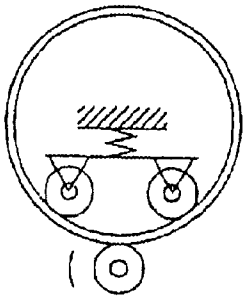
FIGS. 34A–34E are end views of alternate embodiments of the drive means of the spiral transport system of the present invention.
Figure 34E:
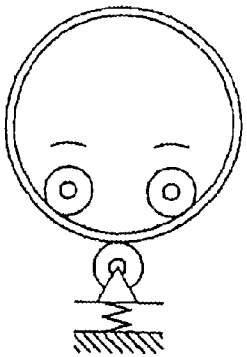
Figure 34D:
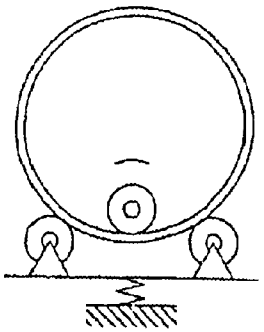
Figure 34A:
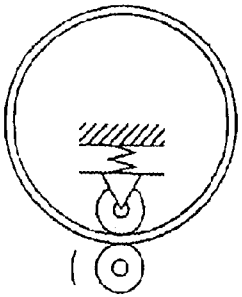
Figure 34C:
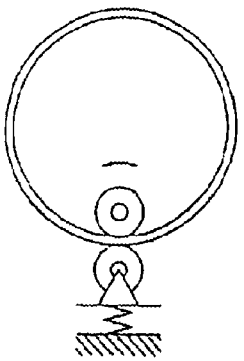

FIG. 34A shows one inner shaft that is idle, and one outer shaft which is driven. FIG. 34B shows two inner shafts which are idle, and one outer shaft which is driven. FIG. 34C shows one inner shaft which is driven, and one outer shaft which is idle. FIG. 34D shows one inner shaft which is driven, and two outer shafts which are idle. FIG. 34E shows two inner shafts which are driven, and one outer shaft which is idle.

Figure 35:
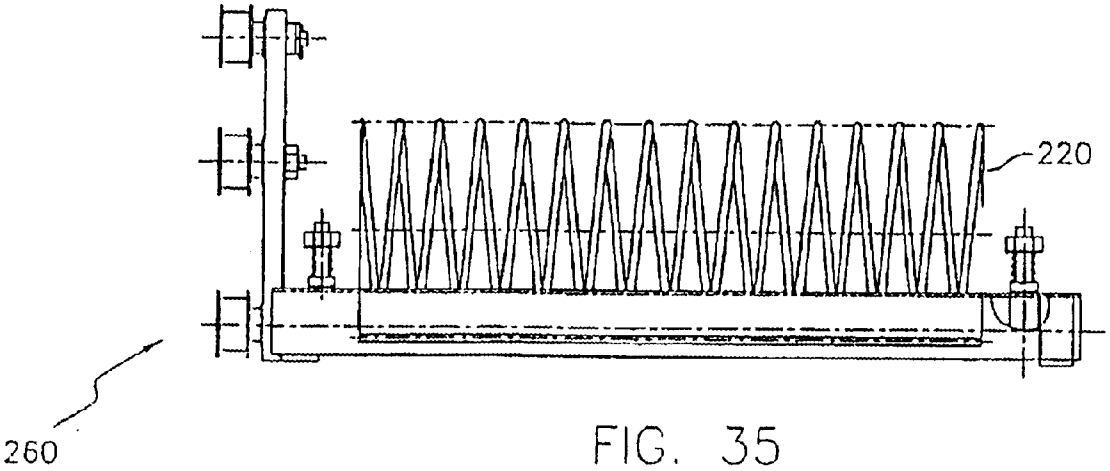
FIG. 35 is a side view of FIG. 33.
Figure 35A:
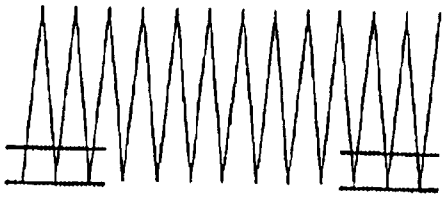
FIGS. 35A and 35D are side views of alternate embodiments of the drive means of the spiral transport system of the present invention.
Figure 35B:
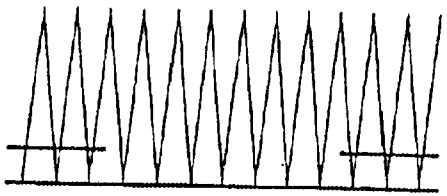

FIG. 35 is a side view of FIG. 33. Spiral 220 is driven by drive means 260 as described herein. Alternatively, FIG. 35A shows the inner and outer shafts engaging the spiral only along the end portions thereof. FIG. 35B shows the inner shaft engaging the spiral at its end portions, with the outer shaft extending along the entire spiral. Again, various configurations are contemplated.

Figure 36:
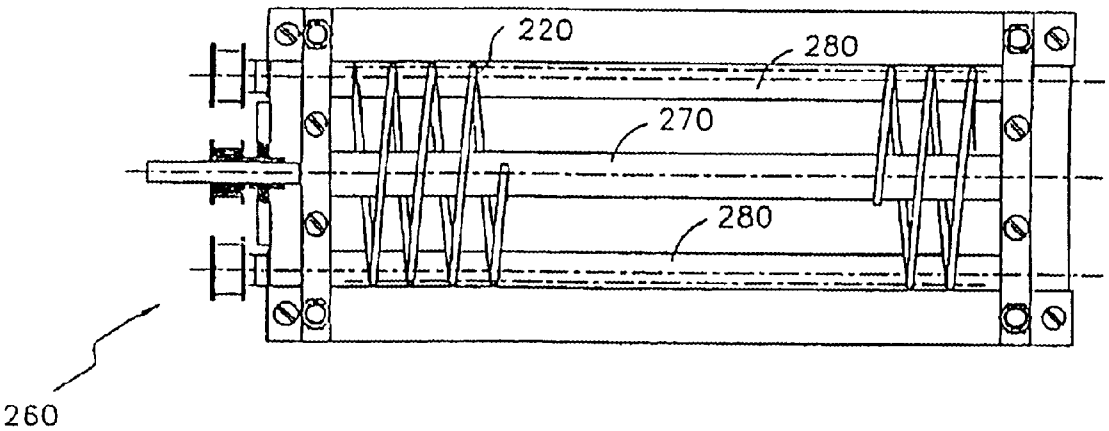
FIG. 36 is a top view of FIG. 33.

FIG. 36 is a top view of FIG. 33. Spiral 220 sits on outer drive shafts 280 and is held thereto by inner pressure shaft 270.

Figure 37:
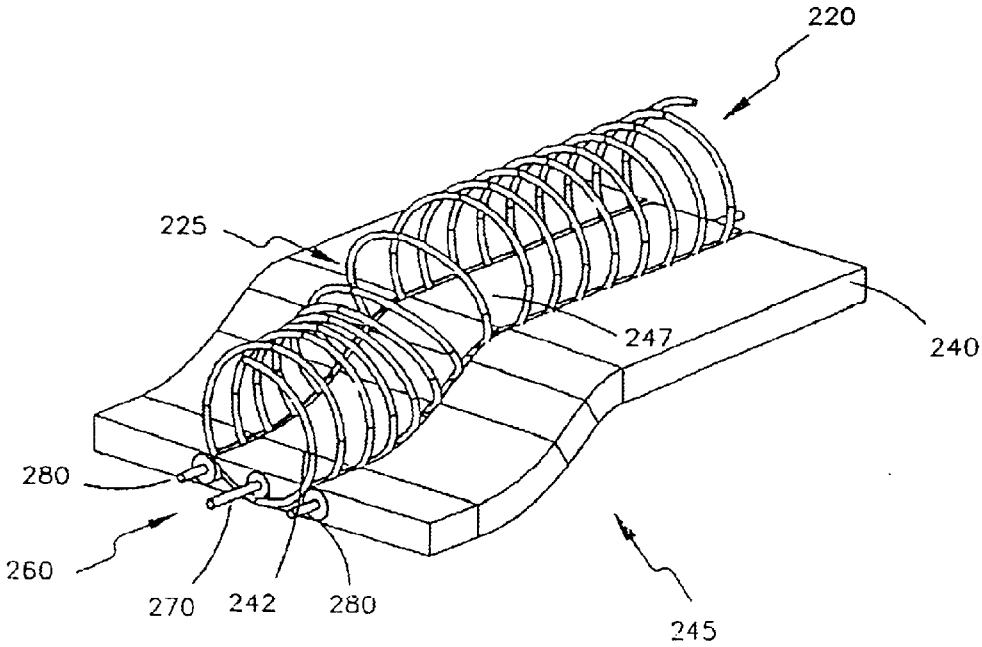
FIG. 37 is a perspective view of an alternate embodiment of the spiral transport of the present invention.

FIG. 37 is a perspective view of an alternate embodiment of the spiral transport system 200 of the present invention. The novel drive means 260 of the present invention allow the spiral 220 to assume a non-linear shape, i.e., the spiral can be bent or curved to move the mailpieces in any desired direction. As can be seen, spiral 220 includes a curved portion 225. Similarly, shafts 270 and 280 include curved portions 275 and 285 respectively (see FIG. 38), which correspond to the curved portion 225 of the spiral. Curved portions 275 and 285 are achieved by using flexible shafts. Additionally, base 240 and inner base portion 242 include a corresponding curved portion 245, 247 respectively.

Figure 38:
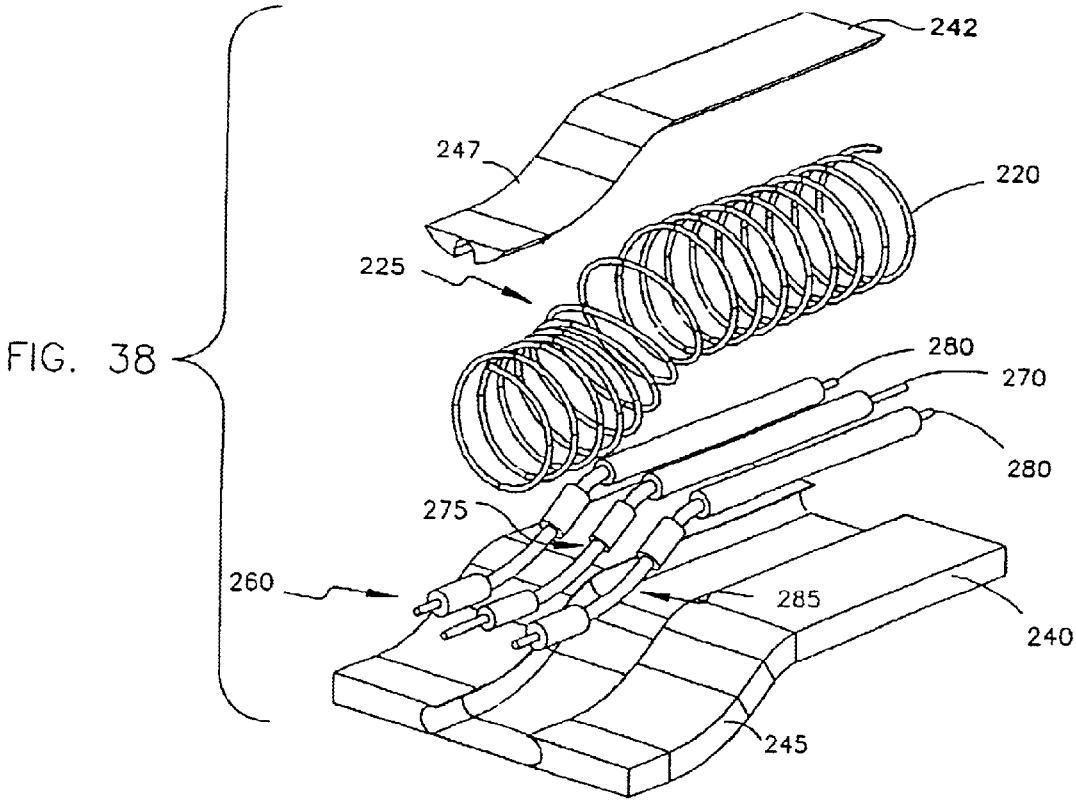
FIG. 38 is an exploded perspective view of FIG. 37.

FIG. 38 is an exploded perspective view of FIG. 37. Spiral 220 has a curved portion 225. Base 240 and inner base portion 242 have a corresponding curved portion 245, 247, as do shafts 270 and 280 have corresponding curved portions 275 and 285 respectively. It should be understood that any number of curved portions in any direction can be utilized along the length of the spiral. Further, the drive means of the spiral of the present invention allows the spiral to be flexible in that different portions of the spiral can be compressed or expanded, as desired to selectively control the transport of the mailpieces in the spiral at different locations along the spiral.

Figure 39:
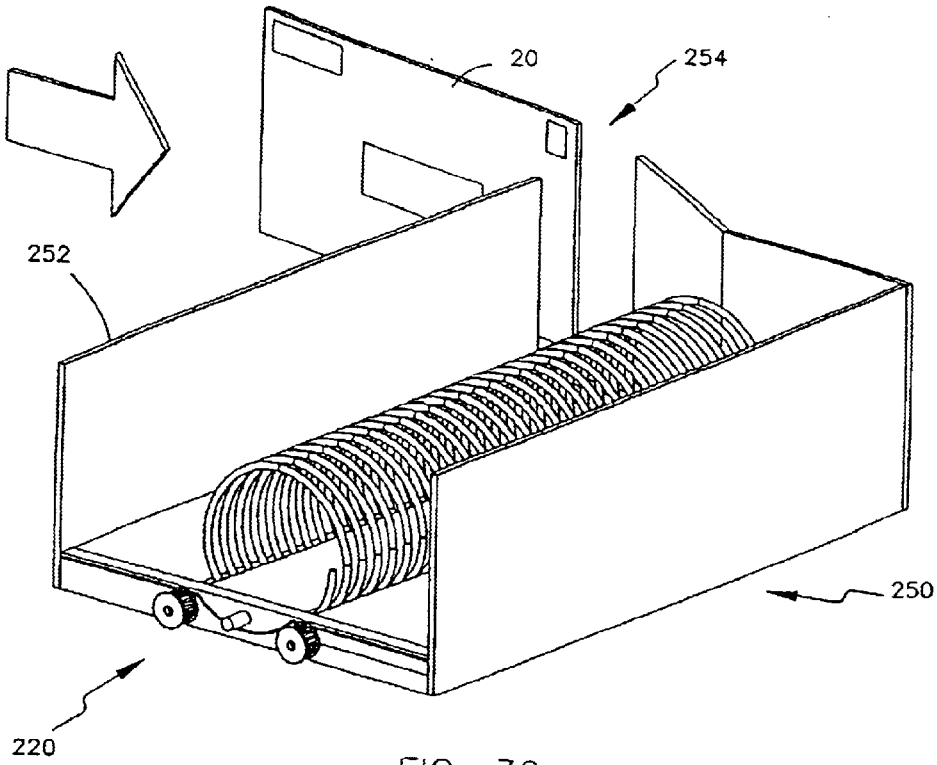
FIG. 39 is a perspective view of an alternate application of the spiral transport system of the present invention.

It should be understood that the spiral transport system 200 of the present invention can be used apart from the tray unloading apparatus 30 and/or the dual conveyor assembly 100 of the present invention. For example, FIG. 39 is a perspective view of an alternate application of the spiral transport system 200. Spiral 220 is set in a mail bin section 250 having sidewalls 252 and a side entrance 254. A mailpiece 20 is introduced into the spiral 220 through the side entrance 254. The spiral 220 transports the mail piece 20 along the entire bin section 250.

Figure 40:
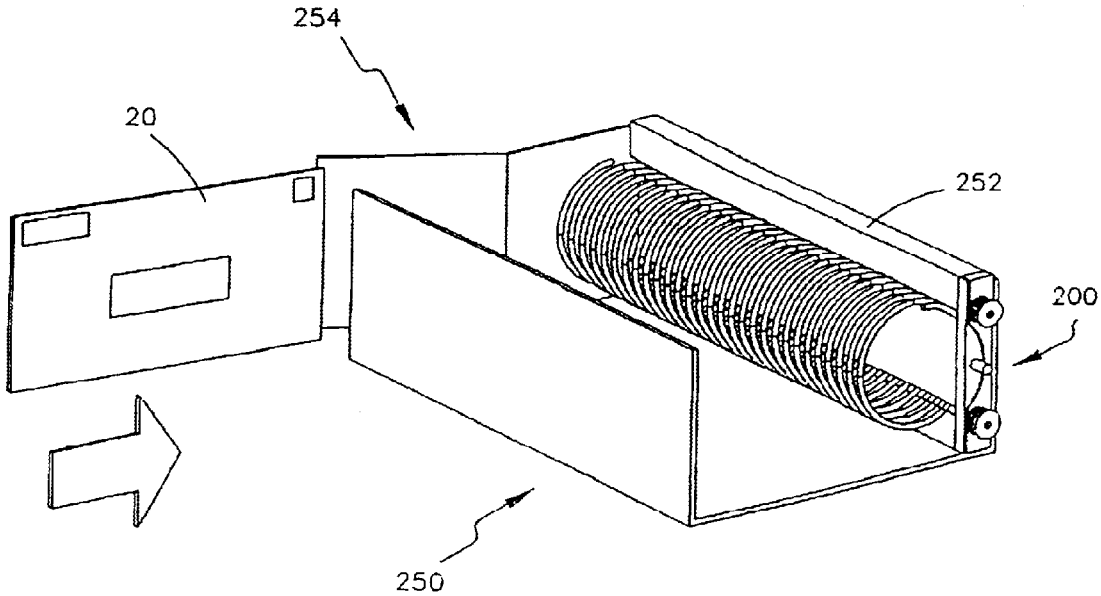
FIG. 40 is a perspective view of an alternate embodiment of the spiral transport system of the application of FIG. 39.

FIG. 40 is a perspective view of an alternate embodiment of the spiral transport system 220 of FIG. 39. Spiral 220 is set in the sidewall 252 of bin section 250. As in FIG. 39, a mailpiece 20 is introduced into the spiral 220 through the side entrance 254 and its transported through the bin section 250 via the spiral 220.

Figure 41A:
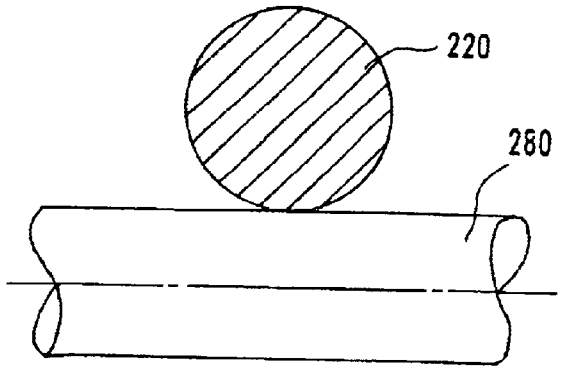
FIG. 41A is a cross sectional view of the preferred spiral shape of the present invention.
Figure 41B:
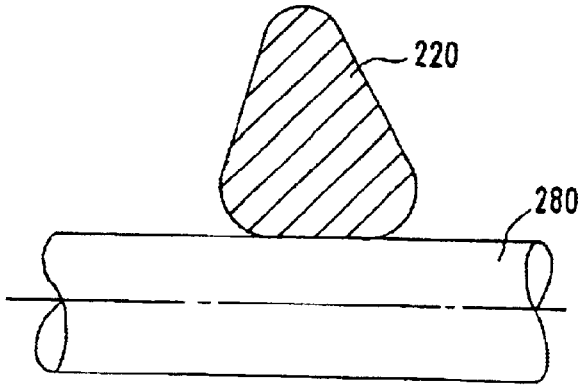
FIG. 41B is a cross sectional view of an alternate embodiment of the spiral shape of the present invention.
Figure 41C:
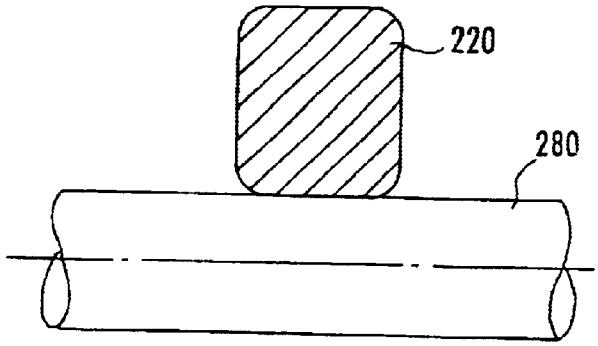
FIG. 41C is a cross sectional view of another alternate embodiment of the spiral shape of the present invention.

It is contemplated that the spiral 220 can assume any suitable cross section, from a generally circular cross section, to any geometrical shape or modified shape. FIG. 41A is a cross sectional view of the preferred spiral cross sectional shape, circular. FIG. 41B is an alternate cross sectional shape. As shown, the spiral has a modified triangular cross section where the corners of the triangle are rounded. Such a cross section could provide a larger drive surface edge, as well as a smaller mail receiving edge so as not to interfere with incoming mailpieces. FIG. 41C is another alternate cross sectional spiral shape of the present invention, where the spiral 220 has a square cross section.

Figure 42A:
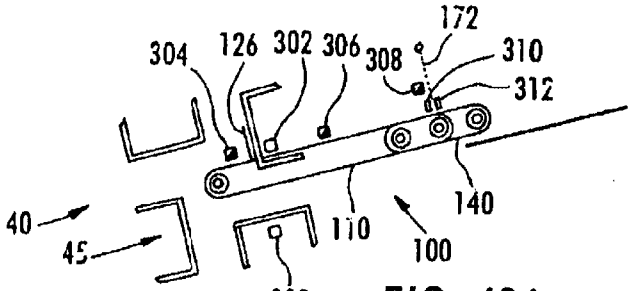
FIGS. 42A–42R are schematic views of the operation of the control system present invention, illustrating the present invention in use.
Figure 42B:
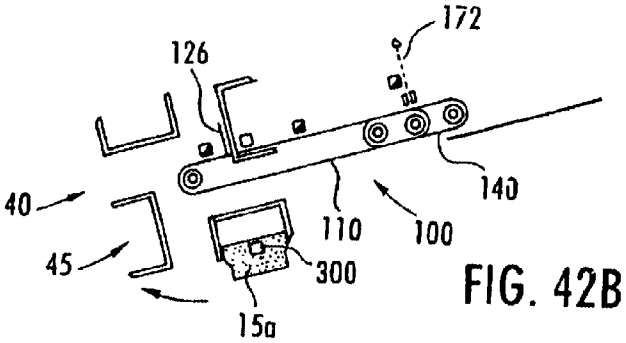
Figure 42C:
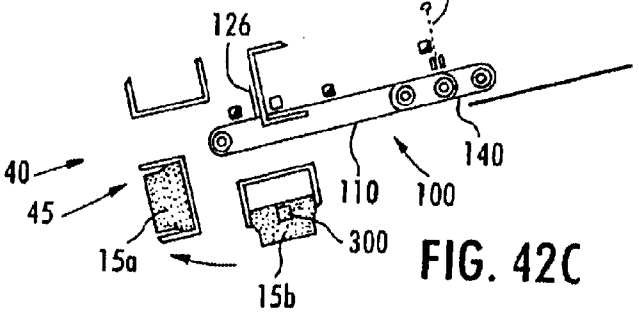
Figure 42D:
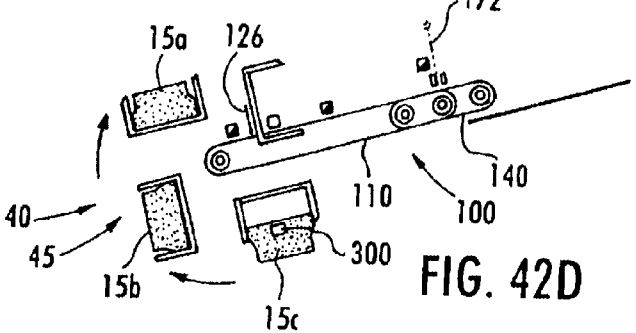
Figure 42E:
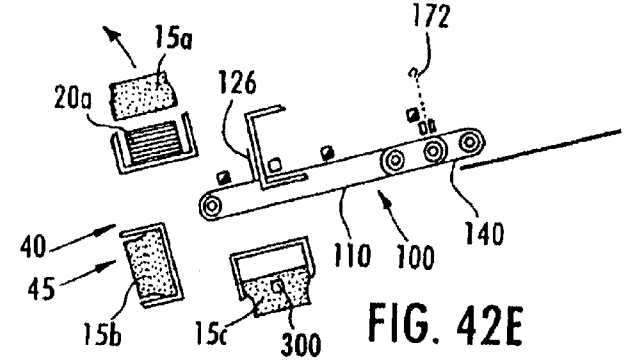
Figure 42F:
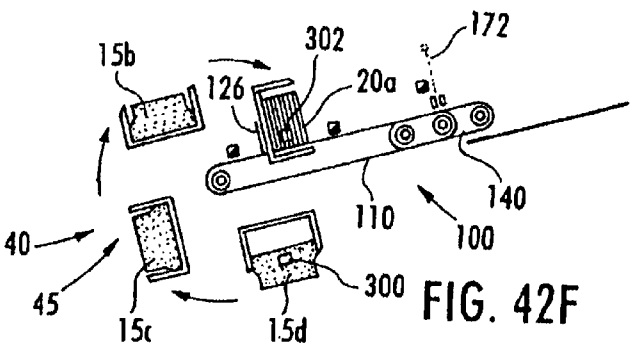
Figure 42G:
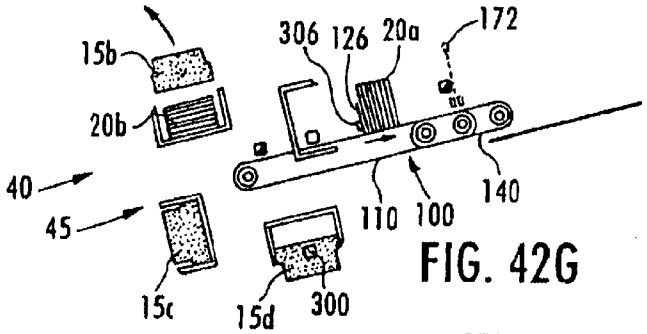
Figure 42H:
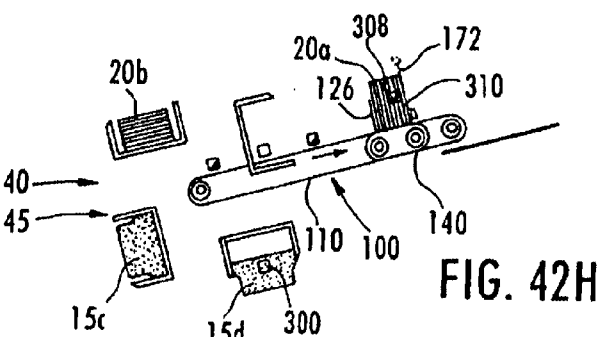
Figure 42I:
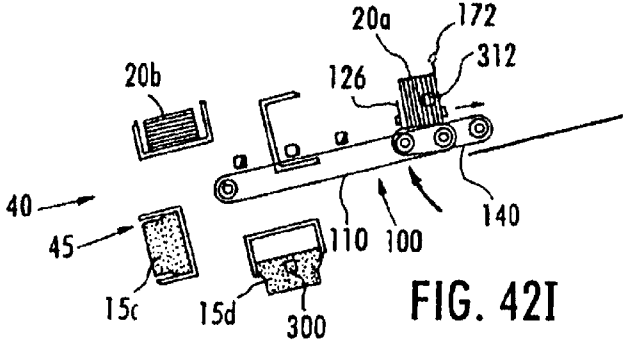
Figure 42J:
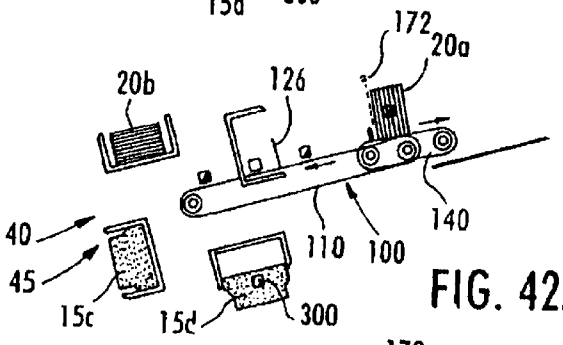
Figure 42K:
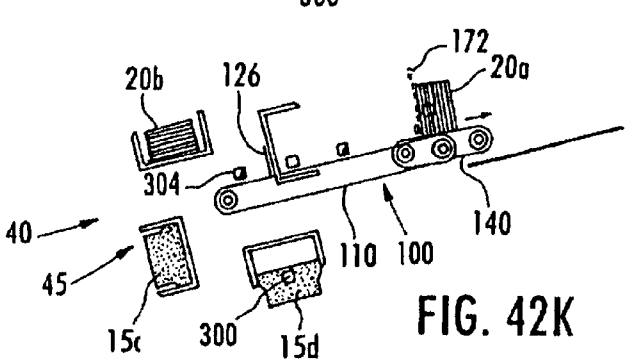
Figure 42L:
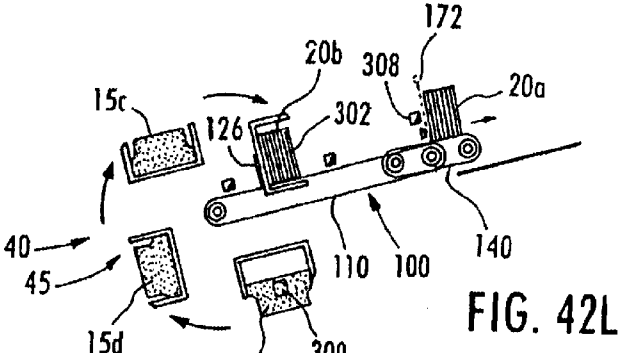
Figure 42N:
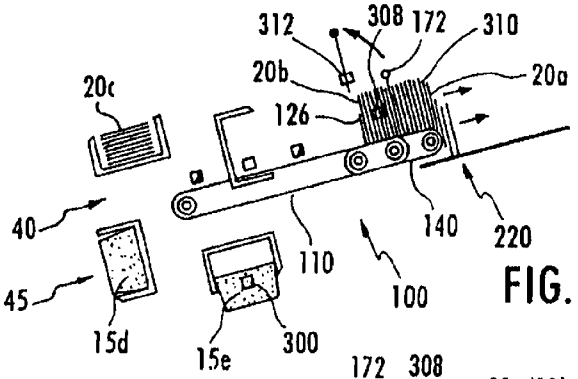
Figure 42P:
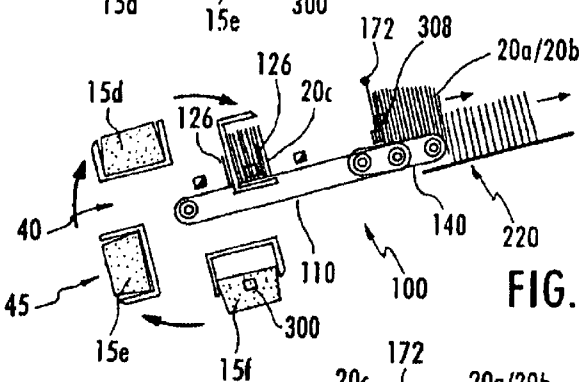
Figure 42R:
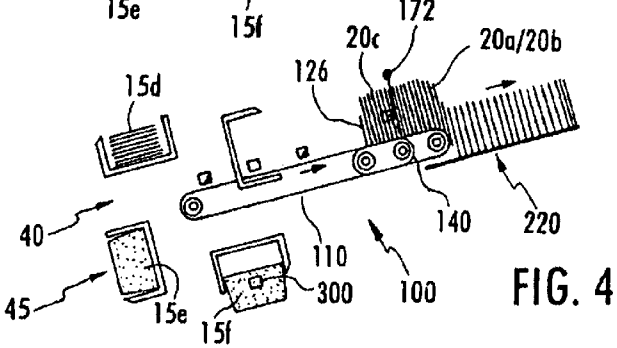

FIGS. 42A–42R are schematic views of the operation of the control system of the present invention, describing the sequence of events as mail is processed through the present invention. The control system, as illustrated, comprises seven sensors, although any suitable number of sensors are contemplated.

A first positioning sensor 300 is suitably mounted at first location 70 to sense when a tray has entered a port 45 at first location 70. A second position sensor 302 is suitably mounted at fourth location 76 to sense when the tray contents have been moved to fourth location 76.

Three motion control sensors 304, 306 and 308 are located along the conveyor assembly 100. Sensor 304 is suitably mounted proximate the beginning of the supply belt transport 110 to sense when the fingers 126 are in their home position. Sensor 306 is suitably mounted proximate a mid-section of the supply belt transport 110 to determine the thickness of the package of mail removed from a tray by measuring the time it takes the package to pass by the sensor, and using the speed of the belts 114. Sensor 308 is suitably mounted proximate the end of the supply belt transport 110 to sense when to lower the collector belt and start the supply belt transport 110, as described below.

Two paddle control sensors 310 and 312 are suitably mounted on paddle 172, on each side of the paddle respectively. Sensor 310 senses when the package of mail removed from the tray reaches the paddle 172. Sensor 312 senses when the paddle has been repositioned to the back of the large, uninterrupted package of mail.

Accordingly, FIG. 42A shows the present invention in a starting position, before a tray is loaded. Tray control module 40 has four ports 45. Conveyor assembly 100 is shown concentic with tray control module 40. Fingers 126 of supply belt transport 110 are positioned in their home position just behind the port 45 in the fourth location. Paddle 172 is positioned above collector belt transport 140. Sensor 300 is located at the first location. Sensor 302 is located at the fourth location. Sensor 304 is located behind fingers 126. Sensor 306 is located proximate the midsection of supply belt transport 110. Sensor 308 is located proximate the end of supply belt transport, to the left of paddle 172. Sensors 310 and 312 are located on opposite sides of the paddle 172.

In FIG. 42B, a first tray 15*a* enters the port 45 in the first location, and blocks sensor 300. Sensor 300 sends a signal to the control system to rotate the drum ninety degrees. As seen in FIG. 42C, the tray control apparatus 40 rotates ninety degrees, moving the first tray 15*a* to the second location and then momentarily stopping. A second tray 15*b* enters the tray holder member in the first location, and again blocks sensor 300 sending another signal to the control system to rotate the drum another ninety degrees. As seen in FIG. 42D, the tray control apparatus 40 rotates ninety degrees and then momentarily stopping, thus moving the first tray 15*a* to the third location, and the second tray 15*b* to the second location. A third tray 15*c* enters the tray holder member in the first location, blocking sensor 300. However, at this point, the drum temporarily remains stationary, as the control system signals the tray removal module to remove first tray 15*a*. FIG. 42E shows the first tray 15*a* being removed, leaving the first group of mailpieces 20*a* on the upper member 47 of tray holder member 46 at the third location.

As shown in FIG. 42F, after the first tray has been removed, the tray control apparatus 40 again rotates ninety degrees, moving the mailpieces 20*a* to the fourth location and on the supply belt transport 110. Senor 302 is now blocked by the mailpieces 20*a,* and sends a signal to the control system to start the supply belt transport 110. Second tray 15*b* moves to the third location, third tray 15*c* moves to the second location, and a fourth tray 15*d* enters the tray holder member in the first location, blocking sensor 300. Again, the drum assembly 42 temporarily remains stationary at this time.

FIG. 42G shows the mailpieces 20*a* being supported by fingers 126 and conveyed out of the tray holder member 46 by the supply belt transport 110, toward the collector belt transport 140. At this time, tray 15*b* is removed, leaving the second group of mailpieces 20*b* on the upper member 47*b* of tray holder members 46 in the third location. Sensor 302 is unblocked. Sensor 306 is blocked and unblocked by mailpieces 20*a* as they are conveyed by, and the thickness of mailpieces 20*a* is calculated. Drum assembly 42 remains temporarily stationary during the supply belt transport run.

FIG. 42H shows mailpieces 20*a* reaching the paddle 172 on collector belt transport 140. Sensor 308 is blocked by mailpieces 20*a,* and sends a signal to the control system to start the collector belt transport 140. The speed of the supply belt transport is reduced at this time. Sensor 310 is also triggered at this time, sending a signal to the control system to start the paddle repositioning. Drum assembly 42 remains temporarily stationary.

In FIG. 42I, paddle 172 is moved to the back of the mailpieces 20*a,* and sensor 312 is triggered, sending a signal to the control system to pivot the collector belt transport 140 upwards. At this time, the control system signals the supply belt transport to reverse direction. Collector belt transport 140 continues to run, and drum assembly remains stationary at this time.

FIG. 42J shows the paddle 172 in position behind mailpieces 20*a,* and fingers 126 returning to their original starting position. Again, collector belt transport 140 continues to run, and drum assembly remains stationary as the transport fingers return to their home position.

FIG. 42K shows the fingers 126 reaching their home position, as the collector belt transport 140 continues conveying mailpieces 20*a*. Sensor 304 is triggered sending a signal to the control system to rotate the drum assembly ninety degrees.

In FIG. 42L, the tray control module 40 is again rotated ninety degrees. Mailpieces 20*b* are moved into the fourth location, and onto the supply belt transport 110. Sensor 302 is blocked by mailpieces 20*b,* and sensor 308 is unblocked as the collector belt transport 140 continues to convey the mailpieces 20*a* toward the spiral transport system. This blocking of sensor 302 and the unblocking of sensor 308 triggers the next supply belt transport run. Also, third tray 15*c* has been moved to the third location, fourth tray 15*d* has been moved to the second location, and a fifth tray 15*e* enters the tray holder members in the first location, blocking sensor 300. Drum assembly 42 will remain stationary for the entire second supply transport belt run. At this time, the unblocked sensor 308 further signals the control system to lower collector belt 140.

Figure 42M:
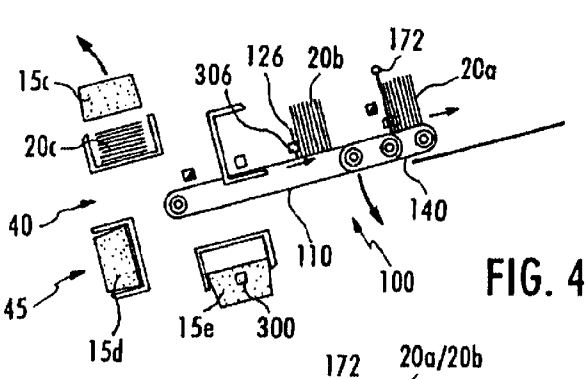

In FIG. 42M, fingers 126 support the second group of mailpieces 20*b* as supply belt transport 110 conveys the mailpieces 20*b* towards the first group of mailpieces 20*a*. Sensor 306 measures the time it takes for the mailpieces 20*b* to go by, so that the control system can calculate the thickness of mailpieces 20*b*. Collector belt transport 140 pivots down. At this time, tray 15*c* is removed, leaving a third group of mailpieces 20*c* on the upper member 47*b* of the tray holder members 46 in the third location.

In FIG. 42N, mailpieces 20*b* reach mailpieces 20*a,* thus blocking sensor 308 and triggering sensor 310. Upon sensor 310 being triggered, paddle 172 is moved out and to the back of the accumulated stack 20*a*/20*b,* triggering sensor 312. Sensor 312 sends a signal to the control system to pivot the collector belt transport 140 upwards. The mailpieces begin to enter spiral 220 as collector belt transport 140 continued to run.

Figure 42O:
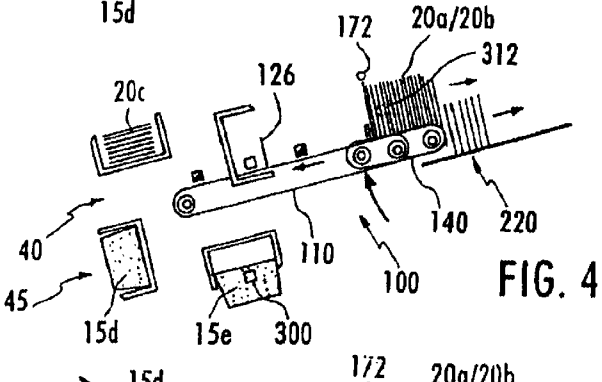

At this time the collector belt transport 140 pivots up, the control system signals the supply belt transport to reverse direction, and fingers 126 begin to return to their original starting location as shown in FIG. 42O.

When the fingers 126 reach their home position, the tray control module 40 is rotated ninety degrees once again, as shown in FIG. 42P. Mailpieces 20*c* are moved into the fourth location, and onto the supply belt transport 110, blocking sensor 302 to start the third supply belt transport run. Fourth tray 15*d* is moved to the third location, fifth tray 15*e* is moved to the second location, and a sixth tray 15*f* enters the tray holder members in the first location, blocking sensor 300. Drum assembly 42 will remain stationary for the entire third supply transport belt run. Sensor 308 becomes unblocked as collector belt transport 140 continues to convey accumulated mailpieces 20*a*/20*b,* to signal the control system to lower collector belt 140.

Figure 42Q:
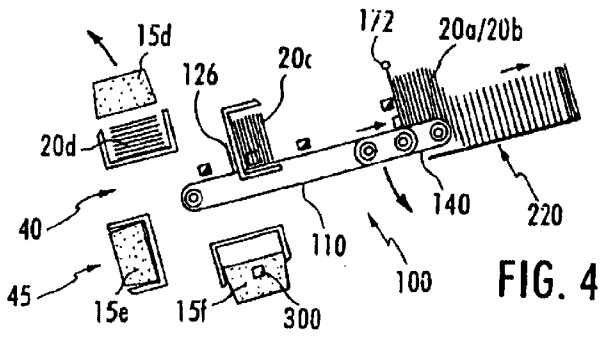

In FIG. 42Q, collector belt transport is lowered. Tray 15*d* is being removed, leaving a fourth group of mailpieces 20*d* on the upper member 47*b* of tray holder members 46 in the third location. Fingers 126 support the mailpieces 20*c* as the supply belt transport 110 begins to move the third group of mailpieces 20*c* towards the collected group of mailpieces 20*a*/20*b*.

In FIG. 42R, mailpieces 20*c* reach the collected group of mailpieces 20*a*/20*b*. Paddle 172 will move to the back of the newly accumulated stack when sensor 310 is triggered, and fingers 126 will return to their original starting location when sensor 312 is triggered and collector belt 140 is pivoted upwards when sensor 308 is triggered. The above described cycle continues for any desired duration.

Figure 43:
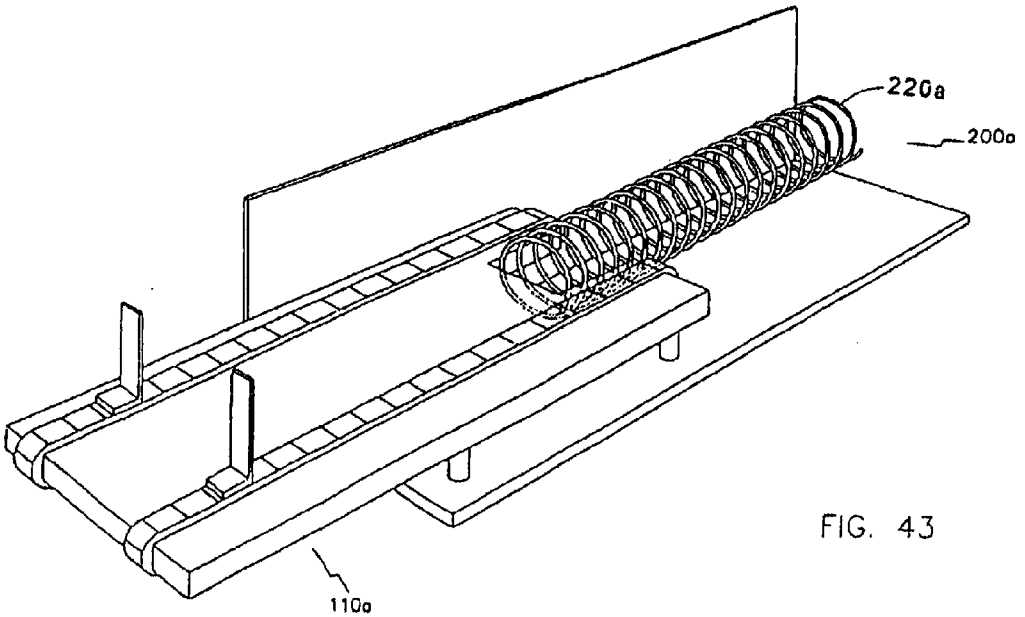
FIG. 43 is a perspective view of an alternate embodiment of the interface between the collector belt transport and the spiral transport system of the present invention.
Figure 44:
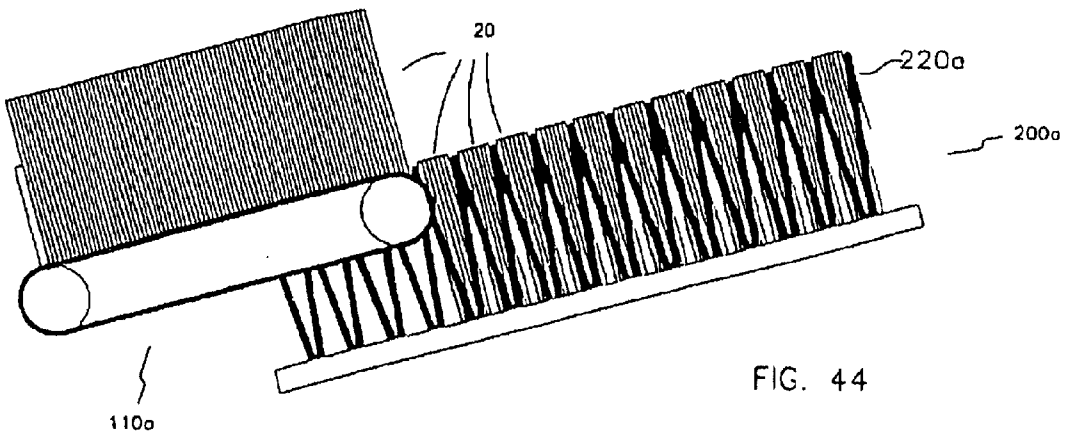
FIG. 44 is a side view of FIG. 43.

Referring now to FIG. 43, a perspective view of an alternate embodiment of the transport system 200*a* is shown. In this embodiment, the spiral 220*a* overlaps with the adjacent conveyor 110*a,* such that the mailpieces 20 engage the spiral 220*a* while still on the conveyor 110*a*, and then drop into the spiral 220*a* at the end of the conveyor. FIG. 44 illustrates a side view of FIG. 44.

FIG. 45 shows a perspective view of another alternate embodiment of the transport system 200*b*. Spiral 220*b* rises up from under conveyor 110*b,* such that mailpieces will enter the spiral right at the end of conveyor 100*b*. A second spiral 220*c* is provided along the side.

All drive means and sensors are operatively connected to suitable controllers, such as a central control computer or programable logic controllers to synchronize operation of all assemblies of the present invention. As described above, the present invention provides for constant control of each tray and mail pieces between the full tray incoming transport to the end of the spiral transport system. Any suitable number of sensors can be used in any suitable locations to synchronize operation of the present invention.

It should be understood that the embodiments herein described are merely illustrative of the principles of the present invention. Various modifications may be made by those skilled in the art without departing from the spirit or scope of the claims which follow. Other modifications or substitutions with equivalent elements are also contemplated.

What is claimed is:

1. A spiral transport system comprising:

a coil defining a length and being rotatable about a central axis for transporting articles along said spiral transport system during rotation; and a means for driving said coil, said means for driving said coil extending along at least a portion of the length of said coil, and providing support to a substantial portion of said coil.

2. The spiral transport system of claim 1, wherein the coil is adapted to engage and transport sheet material.

3. The spiral transport system of claim 2, wherein the sheet material is a least one envelope, and wherein a portion of the at least one envelope is within the coil, and a portion of the at least one envelope extends out from the coil.

4. The spiral transport system of claim 1, wherein said drive means causes said coil to assume a non-linear direction of transport.

5. A spiral transport system comprising:

a coil defining a length and being rotatable about a central axis for transporting articles along said spiral transport system during rotation; and a means for driving said coil, said means for driving said coil extending along at least a portion of the length of said coil, wherein said means for driving includes at least two rollers cooperating to support and drive said coil, wherein at least one-of said at least two rollers is positioned along an inner surface of said coil, and at least one of said at least two rollers is positioned along an outer surface of said coil.

6. A spiral transport system comprising:

a coil defining a length and being rotatable about a central axis for transporting articles along said spiral transport system during rotation; and a means for driving said coil, said means for driving said coil extending along at least a portion of the length of said coil, wherein said means for driving has an axis of rotation, and wherein said axis of rotation of said drive means is not concentric with the central axis of said coil.

7. A method of transporting articles comprising the steps of:

engaging the articles in a coil for transporting articles;

supporting said coil via a plurality of rollers extending along at least a portion of a length of said coil; and driving at least one of said plurality of rollers to rotate said coil.

8. The method of claim 7, wherein the articles are envelopes.

9. A material handling unit comprising:

a spiral transport mechanism comprising:

a coil defining a length and being rotatable about a central axis for transporting articles along the spiral transport mechanism during rotation, and a means for driving the coil, the means for driving the coil extending along at least a portion of the length of the coil;

a tray unloading mechanism comprising:

a guide member, a rotatable drum communicating with the guide member, and at least one tray engaging member on the rotatable drum configured to engage a tray and transport the tray from an upright position to an upside down position wherein articles contained by the tray are removed, wherein the articles removed from the tray are conveyed to the spiral transport mechanism.

10. The material handling unit of claim 9 wherein the at least one tray engaging member further comprises:

a generally C-shaped support member configured to engage and guide the tray from the upright position to the upside down position.

11. The material handling unit of claim 10 wherein the C-shaped support member further comprises means for allowing the articles to be removed from the C-shaped support member onto a conveyor.

12. The material handling unit of claim 11 wherein the means for allowing the articles to be removed from the C-shaped support member comprises an interface between the conveyor and the C-shaped support member which allows the C-shaped support member to pass through the conveyor.

13. The material handling unit of claim 9 wherein the rotatable drum further comprises a plurality of tray engaging members configured to sequentially unload a plurality of trays in a continuous flow.

14. The material handling unit of claim 9 further comprising a tray removal system configured to engage the tray in the upside down position and remove the tray from the tray engaging member.

15. The material handling unit as in claim 9, further comprising a conveyor system for transporting the articles removed from the tray to the spiral transport mechanism.

16. The material handling unit as in claim wherein the conveyor system comprises:

a first conveyor belt transport; and a second conveyor belt transport partially meshing with the first conveyor belt transport, wherein the articles are conveyed by the conveyor system and engage the spiral transport mechanism.

17. The material handling unit of claim 9, wherein the articles are envelopes.

18. A material handling unit comprising:

a spiral transport mechanism comprising:

a coil defining a length and being rotatable about a central axis for transporting articles along the spiral transport mechanism during rotation, and a means for driving the coil, the means for driving the coil extending along at least a portion of the length of the coil; and a conveyor system configured to deliver articles to the spiral transport mechanism, the conveyor system comprising:

a first conveyor belt transport; and a second conveyor belt transport partially overlapping the first conveyor belt transport, wherein the articles are conveyed by the conveyor system and engage spiral transport mechanism.

19. The material handling unit of claim 18 wherein the first conveyor belt transport is configured to transport a plurality of groups of articles to the second conveyor belt transport.

20. The material handling unit of claim 19 wherein the second conveyor belt transport is configured to transport the plurality of groups of articles and form a large group of articles from the plurality of groups of articles.

21. The material handling unit of claim 18 wherein the first conveyor belt transport is configured to move in a first direction to transport the articles to the second conveyor belt transport and is configured to move in a second direction opposite of the first direction when the articles disengage the first conveyor belt.

22. The material handling unit of claim 18 wherein the first conveyor belt transport further comprises a plurality of support members each configured to support at least one of the articles.

23. The material handling unit of claim 18 further comprising a support module operatively mounted proximate the second conveyor belt transport, the support member comprises a positionable support element for supporting a group of articles.

24. The material handling unit of claim 18, wherein the articles are envelopes.

25. The material handling unit of claim 24, wherein the conveyor system delivers the envelopes to the spiral transport mechanism on edge.

26. A system for transporting articles, comprising:

a spiral coil defining a length and being rotatable about a central axis, for receiving the articles spaced between coils of the spiral coil, and for transporting the received articles along the length during rotation of the spiral coil; and at least one rotatable drive member having a central axis different from the central axis of the spiral coil, the at least one drive member engaging points of a periphery of the spiral coil extending along a substantial portion of the length of the spiral coil, wherein rotation of the drive member imparts the rotation to the spiral coil.

27. The spiral transport system of claim 26, wherein the at least one drive member includes at least two rollers cooperating to support and drive the spiral coil, wherein at least one of the at least two rollers is positioned along an interior surface of the spiral coil, and at least one of the at least two rollers is positioned along an outer surface of the spiral coil.

28. A spiral transport system comprising:

a coil defining a length and being rotatable about a central axis for transporting articles along said spiral transport system during rotation; and a means for driving said coil, said means for driving said coil extending along at least a portion of the length of said coil, wherein said means for driving includes at least one drive roller being in contact with said coil along a substantial portion of the length of said coil.

* * * * *